US010737136B2

(12) United States Patent
Burkinshaw

(10) Patent No.: US 10,737,136 B2
(45) Date of Patent: Aug. 11, 2020

(54) FULL BODY EXERCISE APPARATUS AND SUSPENSION TRAINER

(71) Applicant: Colin M. Burkinshaw, Pflugerville, TX (US)

(72) Inventor: Colin M. Burkinshaw, Pflugerville, TX (US)

(73) Assignee: GOWOA, LLC, Pflugerville, TX (US)

( * ) Notice: Subject to any disclaimer, the term of this patent is extended or adjusted under 35 U.S.C. 154(b) by 31 days.

(21) Appl. No.: 16/358,655

(22) Filed: Mar. 19, 2019

(65) Prior Publication Data

US 2019/0240529 A1 Aug. 8, 2019

Related U.S. Application Data

(63) Continuation-in-part of application No. 15/803,397, filed on Nov. 3, 2017, now Pat. No. 10,471,296, (Continued)

(51) Int. Cl.
*A63B 21/00* (2006.01)
*A63B 23/12* (2006.01)
(Continued)

(52) U.S. Cl.
CPC .... *A63B 21/4035* (2015.10); *A63B 21/00069* (2013.01); *A63B 21/00185* (2013.01); (Continued)

(58) Field of Classification Search
CPC ..... A63B 21/4035; A63B 23/1218; A63B 21/1636; A63B 23/00; A63B 21/068; A63B 71/02; A63B 23/12; A63B 21/0552; A63B 21/0557; A63B 21/4009; A63B 21/00069; A63B 21/00185; A63B 21/4043; A63B 21/1645; A63B 21/1618; A63B 2225/68; A63B 2209/10; A63B 69/0028;
(Continued)

(56) References Cited

U.S. PATENT DOCUMENTS 1,701,747 A * 2/1929 Dobbins ..... A61H 1/0218 482/131
3,999,752 A * 12/1976 Kupperman ..... A63B 21/154 482/131
(Continued)

*Primary Examiner* — Garrett K Atkinson
(74) *Attorney, Agent, or Firm* — Clearpat Services, LLC

(57) ABSTRACT

A fully portable exercise system and apparatus utilized for exercising, stretching, and training multiple muscle groups of the body of a user. The apparatus has at least one closeable pocket and fixation rings for securing and carrying accessories, such as attachable handgrips, adjustable suspension straps or lines, and elastic bands. Another configuration illustrates a suspension training system comprising non-elastic suspension sub-assemblies, elastic suspension sub-assemblies and handgrips, configurable with or without the portable exercise apparatus. The apparatus and methods of use provide the user with a plurality of configurations for assisted exercise regimens and the flexibility to exercise anywhere. The apparatus is adaptable to be worn about the waist of a user, carried as a bandolier about the user's body or utilized as a releasably fixed suspension trainer.

20 Claims, 31 Drawing Sheets

Related U.S. Application Data which is a continuation of application No. 15/640,808, filed on Jul. 3, 2017, now Pat. No. 9,808,666, which is a continuation-in-part of application No. 14/690,452, filed on Apr. 19, 2015, now Pat. No. 9,724,554.

(60) Provisional application No. 62/645,828, filed on Mar. 21, 2018, provisional application No. 61/982,022, filed on Apr. 21, 2014.

(51) Int. Cl.

| | |
|---|---|
| ***A63B 21/16*** | (2006.01) |
| ***A63B 23/00*** | (2006.01) |
| ***A63B 21/068*** | (2006.01) |
| ***A63B 71/02*** | (2006.01) |
| ***A63B 21/055*** | (2006.01) |
| ***A63B 69/00*** | (2006.01) |
| ***A63B 23/02*** | (2006.01) |
| ***A63B 21/04*** | (2006.01) |
| ***A63B 71/00*** | (2006.01) |

(52) U.S. Cl.

CPC ..... *A63B 21/0552* (2013.01); *A63B 21/0557* (2013.01); *A63B 21/068* (2013.01); *A63B 21/1636* (2013.01); *A63B 21/4009* (2015.10); *A63B 21/4043* (2015.10); *A63B 23/00* (2013.01); *A63B 23/12* (2013.01); *A63B 23/1218* (2013.01); *A63B 71/02* (2013.01); *A63B 21/00043* (2013.01); *A63B 21/00181* (2013.01); *A63B 21/0442* (2013.01); *A63B 21/0555* (2013.01); *A63B 21/16* (2013.01); *A63B 21/1618* (2013.01); *A63B 21/1645* (2013.01); *A63B 23/0227* (2013.01); *A63B 23/0233* (2013.01); *A63B 23/1245* (2013.01); *A63B 23/1281* (2013.01); *A63B 69/004* (2013.01); *A63B 69/0028* (2013.01); *A63B 69/0048* (2013.01); *A63B 71/0009* (2013.01); *A63B 71/0054* (2013.01); *A63B 2023/003* (2013.01); *A63B 2023/006* (2013.01); *A63B 2207/02* (2013.01); *A63B 2208/029* (2013.01); *A63B 2208/0214* (2013.01); *A63B 2209/02* (2013.01); *A63B 2209/08* (2013.01); *A63B 2209/10* (2013.01); *A63B 2210/50* (2013.01); *A63B 2220/12* (2013.01); *A63B 2225/09* (2013.01); *A63B 2225/54* (2013.01); *A63B 2225/68* (2013.01); *A63B 2225/685* (2013.01); *A63B 2244/08* (2013.01)

(58) Field of Classification Search

CPC ..... A63B 2023/006; A63B 2209/08; A63B 2220/12; A63B 2210/50; A63B 2209/02; A63B 2208/029; A63B 2208/0214; A63B 2207/02; A63B 2023/003; A63B 23/1281; A63B 23/1245; A63B 23/0233; A63B 23/0227; A63B 21/16; A63B 21/0555; A63B 21/0442; A63B 71/0054; A63B 71/0009; A63B 69/0048; A63B 69/004; A63B 2225/54; A63B 2225/685; A63B 2244/08; A63B 21/00043; A63B 21/00181; A63B 2225/09

See application file for complete search history.

(56) References Cited

U.S. PATENT DOCUMENTS

| | | | | | |
|---|---|---|---|---|---|
| 4,266,867 | A * | 5/1981 | Reeberg | A45F 5/00 | 24/302 |
| 4,456,249 | A * | 6/1984 | Calabrese | A63B 21/154 | 482/124 |
| 5,141,223 | A * | 8/1992 | Block | A63B 21/0552 | 482/124 |
| 5,484,395 | A * | 1/1996 | DeRoche | A61F 5/028 | 128/100.1 |
| 5,507,707 | A * | 4/1996 | Miller | A63B 21/0004 | 482/10 |
| 5,560,046 | A * | 10/1996 | Iwamasa | A61F 5/028 | 128/101.1 |
| 5,776,087 | A * | 7/1998 | Nelson | A61F 5/028 | 2/255 |
| 5,782,243 | A * | 7/1998 | Bisyak | A61H 19/50 | 128/845 |
| 5,951,443 | A * | 9/1999 | Askins | A63B 23/047 | 482/124 |
| 6,840,894 | B2 * | 1/2005 | Lerner | A63B 21/0552 | 482/121 |
| 7,418,743 | B2 * | 9/2008 | Tsujimoto | A63B 71/1216 | 2/466 |
| 7,854,694 | B1 * | 12/2010 | Frunzi | A63B 21/0552 | 482/121 |
| 7,955,236 | B2 * | 6/2011 | DiGiovanni | A63B 21/0552 | 482/124 |
| 8,235,173 | B2 * | 8/2012 | Kopp | A45F 3/14 | 182/3 |
| D669,144 | S * | 10/2012 | Calvin | D21/662 | |
| 8,282,536 | B2 * | 10/2012 | Latronica | A63B 21/16 | 482/121 |
| 8,696,527 | B2 * | 4/2014 | Wu | A63B 21/068 | 482/131 |
| 8,876,679 | B2 * | 11/2014 | DeMarco | A63B 1/00 | 482/143 |
| D723,116 | S * | 2/2015 | Gillespie | D21/662 | |
| 8,979,716 | B1 * | 3/2015 | Rawlins | A63B 21/0442 | 482/91 |
| 9,114,270 | B2 * | 8/2015 | Aldridge | A61H 1/0237 | |
| 9,138,608 | B2 * | 9/2015 | Medina | A63B 21/065 | |
| 9,861,511 | B2 * | 1/2018 | Torres-Leon | A61F 5/4408 | |
| 9,937,096 | B2 * | 4/2018 | Aldridge | A61H 1/0237 | |
| 10,029,136 | B2 * | 7/2018 | Aldridge | A63B 21/00185 | |
| 10,226,394 | B2 * | 3/2019 | Aldridge | A61H 1/0237 | |
| 2003/0212355 | A1 * | 11/2003 | Shilling | A61F 5/026 | 602/19 |
| 2004/0063513 | A1 * | 4/2004 | Thony | A63B 69/0059 | 473/277 |
| 2005/0282689 | A1 * | 12/2005 | Weinstein | A63B 21/4009 | 482/124 |
| 2007/0083975 | A1 * | 4/2007 | Senegal | A63B 23/047 | 2/102 |
| 2010/0300802 | A1 * | 12/2010 | Kopp | A45F 3/14 | 182/3 |
| 2014/0274594 | A1 * | 9/2014 | Medina | A63B 23/0405 | 482/105 |

* cited by examiner

FULL BODY EXERCISE APPARATUS AND SUSPENSION TRAINER

CROSS-REFERENCE TO RELATED APPLICATIONS

This application claims priority to previously filed U.S. Patent Application Ser. No. 62/645,828, filed Mar. 21, 2018 and Ser. No. 15/803,397 filed Nov. 3, 2017, which is a CON of Ser. No. 15/640,808, filed Jul. 3, 2017; now U.S. Pat. No. 9,808,666 (granted Nov. 7, 2017), which is a CIP claiming priority to Ser. No. 14/690,452, file Apr. 19, 2015), now U.S. Pat. No. 9,724,554 (granted Aug. 8, 2017) claiming priority to U.S. Patent Application 61/982,022 filed Apr. 21, 2014, which applications and patents are all incorporated herein by reference in their entirety.

BACKGROUND OF THE INVENTION

The present invention relates to exercise equipment. More specifically, the present invention relates to an exercise system that provides the user with either a mountable or an easily portable exercise assistance apparatus.

Some specialized exercise systems incorporate accessories to add strength and flexibility options and to expand a basic existing exercise program. Unfortunately, due to their bulk, many of these accessories are quite heavy, difficult to transport and often limit their use to a single bulky apparatus or fixed location in a fitness gym, which in turn limits the general utility and versatility of such exercise systems.

SUMMARY OF THE INVENTION

Many exercise enthusiasts feel claustrophobic in the indoor fitness gym environment and wish to take at least some of their exercise programs outdoors but feel limited by the lack of available portable equipment. Some "hard-core" enthusiasts have even gone so far as to incorporate the use of existing structures and created exercise sports such as Parkour, Freerunning, Buildering, spelunking, rock climbing, urban rock climbing, and Plyometrics, also known as "jump training" or "plyos", in an attempt to combine their running and aerobic exercise routines with strength and agility training in less conventional urban and outdoor environments.

However, not every "weekend athlete" can train as intensely or has access to the training protocols or facilities utilized by many of these hard-core athletes. There remains a need for a portable apparatus that is lightweight, easy to use, and easily transportable that provides the exercise enthusiast, or those who prefer not to be restricted only to a conventional gym environment, with a system that can add greater variety to their routine and allow them to have a gym fitness experience while exercising anywhere.

Illustrated and described herein, is a versatile, lightweight, and durable exercise apparatus for exercising multiple muscle groups of the entire body. The exercise apparatus comprises a layered strap or strap-like apparatus adaptable for suspension from almost any secure overhead structure or temporary attachment to a vertical structure, a wall anchor, between a door and doorframe, worn about the waist, carried across the chest of the user's body as a bandolier, or simply carried and stored in a gym bag. The apparatus system comprises one or more pockets for securing and carrying accessories such as adjustable non-elastic suspension bands, straps or lines; elastic suspension bands or cords; and releasable handgrips; among other items. The accessories are attachable to multiple fixation rings attached at various points about the strap-like apparatus. The apparatus and methods of use described herein provide the user with a multitude of variable loading options to develop and improve muscle strength, flexibility, agility, and tone, while providing the user with the flexibility to exercise either in a gym, a garage, from a tree, in a park or anywhere that is convenient to the user.

The lightweight apparatus can be temporarily or permanently suspended from a secure overhead structure or vertical structure, a wall anchor, a floor anchor, between a door and doorframe, worn or carried anywhere by the user. The apparatus can provide either an indoor bodybuilder, or an outdoor enthusiast, with lightweight, portable exercise equipment configurable perform a plurality of suspension, resistance, and tension training protocols, utilizing coupled non-elastic straps, bands, or lines; elastic bands or cords; detachable and fixed handgrips with flexible straps. The apparatus is also a system that can be used for a plethora of exercise protocols and therapeutic applications.

Further, the system and apparatus are designed for use as a physical therapy device, adaptable for use in a physical therapy setting or in a home environment by physically compromised individuals or individuals recovering from injury. Additionally, the device is adaptable for use by individuals with limited physical capacity due to age, handicap or health concerns as part of regular health maintenance program. Further still, the apparatus is designed for easy incorporation into conventional programs such as yoga, Tai Chi, aerobics, kickboxing, martial arts or similar exercise programs to add additional strength, balance, agility, endurance and stretching regimens to such programs. Even further, the apparatus is designed to be compact and portable, for use while traveling, away from home on business, or in a hotel.

Provided here is a portable exercise system comprising a belt assembly comprising an adjustable connector strap having a first end and a second end spaced lengthwise from each other, at least one closeable pocket, affixed lengthwise along the adjustable connector strap between the first end and the second end, a first fixation ring affixed to the adjustable connector strap between the first end and a first exterior end margin of the at least one closeable pocket, and a second fixation ring affixed to the adjustable connector strap between the second end and a second exterior end margin of the at least one closable pocket; a first elastic suspension sub-assembly and a second elastic suspension sub-assembly, each sub-assembly comprising: a plurality of releasably attachable elastic bands or elastic cords, creating a set; a releasably attachable shroud comprising at least a first half of a releasable hook and loop closure mechanism and a releasably attachable suspension strap having a first end and a second end affixed to the shroud; a first non-elastic suspension strap assembly and a second non-elastic suspension strap assembly comprising a plurality of attachment features or loops; and a first adjustable-length handgrip assembly and a second adjustable-length handgrip assembly.

In some embodiments, the portable exercise system further comprises a coupling mechanism assembly comprising a first coupling component at the first end of the adjustable connector strap and a second coupling component slidably affixed along the adjustable connector strap in proximity to the second end for releasably securing the first end of the adjustable connector strap to a section of the adjustable connector strap near the second end; and a third fixation ring affixed to the adjustable connector strap at or about the approximate lengthwise center or the approximate lengthwise center of the closeable pocket, approximately equidistant between the first fixation ring and the second fixation ring.

In some embodiments of the portable exercise system, each one of the plurality of releasably attachable elastic bands or elastic cords creating the set of the first elastic suspension sub-assembly and the set of second elastic suspension sub-assembly comprises a first end and a second end, a specified length and a known tension property wherein each first end comprises a first attachment feature and each second end comprises a second attachment feature, and wherein each attachment feature further comprises a quick-release attachment coupling.

In some embodiments of the portable exercise system, each releasably attachable elastic band or elastic cord of the first elastic suspension sub-assembly comprises a different known tension property from the other releasably attachable elastic bands or elastic cords in the first sub-assembly, wherein each releasably attachable elastic band or elastic cord of the second elastic suspension sub-assembly comprises a different known tension property from the other releasably attachable elastic bands or elastic cords in the second sub-assembly, and wherein the tension properties of each set of releasably attachable elastic bands or elastic cords in the first elastic suspension sub-assembly and the second elastic suspension sub-assembly are the same.

In some embodiments of the portable exercise system, each releasably attachable suspension strap affixed to the shroud further comprises a second half of a releasable hook and loop closure mechanism, at or about an area of fixation to the shroud, to enclose the shroud around the plurality of releasably attachable elastic bands or elastic cords, and wherein the first end comprises a first attachment feature and the second end comprises a second attachment feature, and wherein each attachment feature further comprises a quick-release attachment coupling.

In some embodiments of the portable exercise system, the first non-elastic suspension strap assembly and the second non-elastic suspension strap assembly each comprises: a first non-elastic strap, band or line having a first end and a second end; the first end of the first non-elastic strap, band or line comprising a closed loop, and the second end of the first non-elastic strap, band or line having no attachments; a second non-elastic strap, band or line having a first end and a second end; and a strap buckle comprising a securing bar, and strap clasping mechanism; wherein the second end of the second non-elastic strap, band or line is folded over the securing bar, back onto a portion of the second non-elastic strap, band or line and permanently secured thereto, capturing the first securing bar, and wherein the second end of the first non-elastic strap, band or line is pulled through the strap buckle such that the second end is adjustably secured by the strap clasping mechanism.

In some embodiments of the portable exercise system, the first adjustable-length handgrip assembly and the second adjustable-length handgrip assembly each comprises: a handgrip with a flexible connector strap, wherein the handgrip is hollow, wherein the flexible connector strap further comprises a first attachment feature at the end of the flexible connector strap and at least a second attachment feature along the length of the flexible connector strap, and wherein the first attachment feature further comprises a quick-release attachment coupling.

In some embodiments of the portable exercise system, each of the first adjustable-length handgrip assembly and the second adjustable-length handgrip assembly further comprises an auxiliary loop feature suspended from the handgrip.

In some embodiments of the portable exercise system, the first adjustable-length handgrip assembly and the second adjustable-length handgrip assembly are releasably affixable to at least one of the first, second and third fixation rings.

In some embodiments of the portable exercise system, the first adjustable-length handgrip assembly and the second adjustable-length handgrip assembly are releasably affixable to any one or more of the plurality of attachment features or loops of the first non-elastic suspension strap sub-assembly or the second non-elastic suspension strap sub-assembly.

In some embodiments of the portable exercise system, the first adjustable-length handgrip with the flexible connector strap and the second adjustable-length handgrip assembly are releasably affixable to any one or more of the attachment features of the first elastic suspension sub-assembly.

In some embodiments, the portable exercise system further comprises a third fixation ring or an auxiliary attachment feature at any location along the length of the flexible connector strap.

In some embodiments, the portable exercise system further comprises a second closeable pocket, affixed along the adjustable connector strap between the first end and the second end.

In some embodiments, the portable exercise system further comprises at least one permanently affixed handgrip with a first flexible handgrip connector strap affixed to the adjustable connector strap.

In some embodiments, the portable exercise system further comprises a second permanently affixed handgrip with a second flexible handgrip connector strap affixed to the adjustable connector strap, wherein the first permanently affixed handgrip and the second permanently affixed handgrip are hollow.

In some embodiments, the portable exercise system further comprises a first auxiliary storage sleeve having a first end, a second end and a first cavity therebetween, and affixed on or about an exterior margin of the at least one closable pocket.

In some embodiments of the portable exercise system, the first auxiliary storage sleeve is sized and configured to store the at least one permanently affixed handgrip with the first flexible handgrip connector strap.

In some embodiments, the portable exercise system further comprises a second auxiliary storage sleeve having a third end, a fourth end and a second cavity therebetween and affixed on or about an exterior margin of the at least one closable pocket.

In some embodiments of the portable exercise system, the second auxiliary storage sleeve is sized and configured to store the second permanently affixed handgrip with the second flexible handgrip connector strap.

In some embodiments of the portable exercise system, any one or all of the first elastic suspension sub-assembly; the second elastic suspension sub-assembly; the first non-elastic suspension strap assembly; the second non-elastic suspension strap assembly; the first adjustable-length handgrip assembly; and the second adjustable-length handgrip assembly, are configurable to be stored and transported within the at least one closeable pocket, affixed along the adjustable connector strap.

Provided herein is an exercise apparatus comprising a strap-like apparatus or belt adaptable for suspension from almost any secure overhead structure or attachment to a vertical structure, a wall anchor, between a door and doorframe, worn about the waist, carried across the chest of the user's body as a bandolier, or simply carried and stored in a gym bag, wherein the apparatus comprises: an adjustable connector strap having a first end and a second end spaced lengthwise from each other; a coupling mechanism assembly comprising a first coupling component at or near the first end and a second coupling component at or near the second end of the adjustable connector strap, for releasably securing the first end of the adjustable connector strap to another section of the adjustable connector strap at or near the second end of the adjustable connector strap; a closeable pocket (pouch), affixed lengthwise to the adjustable connector strap comprising; a first medial exterior surface and a first lateral exterior surface, an interior space within the closeable pocket comprising a first medial interior surface and a first lateral interior surface, a first exterior end margin, and a second exterior end margin; wherein the first end margin and the second end margin are closed and spaced apart from each other at opposite ends of the pocket along the adjustable connector strap; a first exterior lengthwise margin comprising a first edge and a second edge, forming a first opening to the interior space; and a second exterior lengthwise margin spaced apart from the first exterior lengthwise margin forming a closed bottom to the interior space of the pocket; wherein the first and second lengthwise margins are positioned longitudinally between the first end margin and second end margin; at least one securing mechanism configured to releasably capture the first edge and the second edge to at least partially close the first opening to the interior space of the closeable pocket; wherein the adjustable connector strap is affixed lengthwise to either the medial interior surface of the closeable pocket, or to the medial exterior surface of the closeable pocket such that the first end and the second end of the adjustable connector strap protrude past the first exterior end margin and the second exterior end margin of the closeable pocket.

Provided herein is a portable exercise apparatus comprising: an adjustable connector strap comprising a first end and a second end spaced lengthwise from each other; a coupling mechanism assembly comprising a first coupling component at the first end of the adjustable connector strap and a second coupling component on the second adjustable connector strap for releasably securing the first end of the adjustable connector strap to a section of the second adjustable connector strap; at least one closeable pocket, affixed lengthwise along at least a first section of the adjustable connector strap, the pocket comprising; a first exterior end margin at a first end of the pocket and a second exterior end margin at a second end of the pocket; a first exterior lengthwise margin comprising a first edge and a second edge, forming an opening to the pocket; a second exterior lengthwise margin spaced apart from the first exterior lengthwise margin, forming a closed bottom to the pocket; a zipper along the first edge and the second edge of the pocket; an surface of the at least one closeable pocket being affixed lengthwise to the adjustable connector strap, such that the first end and the second end of the adjustable connector strap protrude past the first exterior end margin and the second exterior end margin, a first fixation ring affixed to the adjustable connector strap between the first coupling component and the first exterior end margin of the pocket; a second fixation ring affixed to the adjustable connector strap between the second coupling component and the second exterior end margin of the at least one pocket, and a third fixation ring affixed to the adjustable connector strap at or about the approximate lengthwise center or the approximate lengthwise center of the closeable pocket, approximately equidistant between the first fixation ring and the second fixation ring; and a first auxiliary storage sleeve having a first end, a second end and a first cavity therebetween and affixed on or about the second exterior lengthwise margin.

In some embodiments, the portable exercise apparatus further comprises a first non-elastic suspension sub-assembly.

In some embodiments, the portable exercise apparatus further comprises a first elastic suspension sub-assembly.

In some embodiments, the first non-elastic suspension sub-assembly comprises: a first non-elastic strap, band or line having a first end and a second end; the first end of the first non-elastic strap, band or line comprising a closed loop, and the second end of the first non-elastic strap, band or line having no attachments, a second non-elastic strap, band or line having a first end and a second end; and a first strap buckle comprising a first securing bar, and first strap clasping mechanism; wherein the second end of the second non-elastic strap, band or line is folded over the first securing bar, back onto a portion of the second non-elastic strap, band or line and permanently secured thereto, capturing the first securing bar, and wherein the second free end of the first non-elastic strap, band or line, having no attachments, is pulled through the first strap buckle such that the second end is adjustably secured by the first strap clasping mechanism.

In some embodiments, the first elastic suspension sub-assembly comprises a first releasably attachable elastic band or elastic cord having a first end and a second end, a specified length and a known tension property, wherein the first end comprises a first attachment feature and the second end comprises a second attachment feature.

In some embodiments, the portable exercise apparatus further comprises a plurality of additional releasably attachable elastic bands or elastic cords.

In some embodiments, each additional releasably attachable elastic band or elastic cord comprises a different known tension property from the first and any other additional releasably attachable elastic bands or elastic cords in the first sub-assembly.

In some embodiments, the additional releasably attachable elastic bands or elastic cords are each approximately the same length as the first releasably attachable elastic band or elastic cord.

In some embodiments, the portable exercise apparatus further comprises a first auxiliary strap with a first end and a second end, having a first auxiliary shroud with a first edge, a second edge, a first end and a second end, the first auxiliary shroud further comprising: a shroud releasable attachment feature configurable to secure one edge or end of the auxiliary shroud to another edge or end of the auxiliary shroud such that the first auxiliary shroud is wrapably securable around the plurality of releasably attachable elastic bands or elastic cords.

In some embodiments, the portable exercise apparatus further comprises an attachment feature at each first and second end of the first auxiliary strap.

In some embodiments, the portable exercise apparatus further comprises a first handgrip with a first flexible connector strap.

In some embodiments, the first handgrip is hollow.

In some embodiments, the first flexible connector strap further comprises an attachment feature at the end of the flexible connector strap.

In some embodiments, the first handgrip with the first flexible strap is permanently affixed to the adjustable connector strap between the first coupling component and the first exterior end margin of the pocket.

In some embodiments, the first handgrip with the first flexible strap is releasably affixable to at least one of the first, second and third fixation rings of the adjustable connector strap.

In some embodiments, the first handgrip with the first flexible strap is releasably affixable to at least one of any attachment feature of the first non-elastic suspension sub-assembly.

In some embodiments, the first handgrip with the first flexible strap is releasably affixable to at least one of any attachment feature of the first elastic suspension sub-assembly.

In some embodiments, the portable exercise apparatus further comprises a second attachment feature at any location along the length of the flexible connector strap.

In some embodiments, the first handgrip with the first flexible strap further comprises a first auxiliary loop feature suspended from the handgrip.

In some embodiments, the portable exercise apparatus further comprises at least one coupling attachment configurable for coupling at least one of: the first non-elastic suspension sub-assembly; the first elastic suspension sub-assembly, or the first handgrip, to any attachment feature, the first fixation ring, the second fixation ring or the third fixation ring of the portable exercise apparatus.

In some embodiments, the portable exercise apparatus further comprises a second closeable pocket attached to and spaced along a second section of the adjustable connector strap comprising: at least a second medial exterior surface and a second lateral exterior surface; a second interior space within the second closeable pocket comprising at least a second medial interior surface and a second lateral interior surface; a second exterior end margin and a second interior end margin; wherein the second exterior end margin and the second interior end margin are spaced apart lengthwise from each other at opposite ends of the second closeable pocket along the second section of the adjustable connector strap, a third exterior lengthwise margin adjoining the second exterior end margin and the second interior end margin; the third exterior lengthwise margin comprising a third edge and a fourth edge, forming a first opening to the second interior space within the second closeable pocket, and a fourth exterior lengthwise margin spaced apart from the third exterior lengthwise margin, forming a closed bottom to the second interior space of the second closeable pocket; wherein the third and fourth exterior lengthwise margins are positioned longitudinally along the second section of the adjustable connector between the second exterior end margin and second interior end margin; at least a second pocket securing mechanism configured to releasably capture the third edge and the fourth edge to at least partially close the first opening to the second interior space of the second closeable pocket; and a second auxiliary storage sleeve having a third end, a fourth end and a second cavity therebetween; the second auxiliary storage sleeve being spaced apart lengthwise from the first auxiliary storage sleeve and affixed on or about the second exterior lengthwise margin.

In some embodiments, the portable exercise apparatus further comprises a connecting section comprising at least a medial exterior surface and a lateral exterior surface positioned between the first interior end margin of the first closeable pocket and the second interior end margin of the second closeable pocket; wherein the adjustable connector strap is affixed lengthwise to the first medial interior surface of the first closeable pocket, optionally affixed to the lateral surface of the connecting section and affixed lengthwise to the second medial interior surface of the second closeable pocket, or wherein the adjustable connector strap is affixed lengthwise to the first medial exterior surface of the first closeable pocket, optionally affixed the lateral surface of the connecting section and affixed lengthwise to the second medial exterior surface of the second closeable pocket, or a combination thereof, such that the first end and the second end of the adjustable connector strap protrude past the first exterior end margin of the first pocket and the second exterior end margin of the second pocket.

In some embodiments, the portable exercise apparatus further comprises a second non-elastic suspension sub-assembly identical to the first non-elastic suspension sub-assembly.

In some embodiments, the portable exercise apparatus further comprises a second elastic suspension sub-assembly identical to the first elastic suspension sub-assembly.

In some embodiments, the portable exercise apparatus further comprises a plurality of additional releasably attachable elastic bands or elastic cords, identical to the first elastic suspension sub-assembly.

In some embodiments, each additional releasably attachable elastic band or elastic cord comprises the same known tension property as the corresponding additional releasably attachable elastic bands or elastic cords in the first sub-assembly.

In some embodiments, the additional releasably attachable elastic bands or elastic cords are each approximately the same length as the first releasably attachable elastic bands or elastic cords in the first elastic suspension sub-assembly.

In some embodiments, the portable exercise apparatus further comprises a second auxiliary strap with a first end and a second end, having a second auxiliary shroud with a first edge, a second edge, a first end and a second end, the second auxiliary shroud further comprising: a shroud releasable attachment feature configurable to secure one edge or end of the auxiliary shroud to another edge or end of the auxiliary shroud such that the second auxiliary shroud is wrapably securable around the plurality of releasably attachable elastic bands or elastic cords.

In some embodiments, the portable exercise apparatus further comprises a second handgrip with a second flexible connector strap.

In some embodiments, the second handgrip is hollow.

In some embodiments, the second flexible connector strap further comprises an attachment feature at the end of the flexible connector strap.

In some embodiments, the second handgrip with the second flexible strap is permanently affixed to the adjustable connector strap between the second coupling component and the second exterior end margin of the second pocket.

In some embodiments, the second handgrip with the second flexible strap is releasably affixable to at least one of the first, second and third fixation rings of the adjustable connector strap.

In some embodiments, the second handgrip with the second flexible strap is releasably affixable to at least one of any attachment feature of the second non-elastic suspension sub-assembly.

In some embodiments, the second handgrip with the second flexible strap is releasably affixable to at least one of any attachment feature of the second elastic suspension sub-assembly.

In some embodiments, the portable exercise apparatus further comprises a second attachment feature at any location along the length of the flexible connector strap.

In some embodiments, the second handgrip with the second flexible strap further comprises a first auxiliary loop feature suspended from the handgrip.

In some embodiments, the portable exercise apparatus further comprises at least one coupling attachment configurable for coupling at least one of: the second non-elastic suspension sub-assembly; the second elastic suspension sub-assembly, or the second handgrip; to any attachment feature, the first fixation ring, the second fixation ring or the third fixation ring of the portable exercise apparatus.

In some embodiments, the first handgrip is configurable for storage within the first auxiliary storage sleeve.

In some embodiments, the second handgrip is configurable for storage within the second auxiliary storage sleeve.

In some embodiments of the apparatus, the first strap buckle comprises a cam style buckle.

In some embodiments of the apparatus, the second strap buckle comprises a cam style buckle.

In some embodiments of the apparatus, one out of each elastic band or elastic cord is configurable for attachment to an available closed loop of the first non-elastic sub-assembly.

In some embodiments of the apparatus, one out of each elastic band or elastic cord is configurable for attachment to an available closed loop of the second non-elastic sub-assembly.

In some embodiments of the apparatus,

In some embodiments, the portable exercise apparatus further comprises additional accessory components comprising: a third handgrip with a third flexible strap; at least one additional suspension strap; a suspension harness; parachute cord; a running parachute; at least one accessory attachment connection device; at least one glove; two or more carabiners; and at least one doorframe attachment device; the doorframe attachment device comprising a flexible connector strap and a thickened section of the flexible strap configured for placement between a doorframe and a closed door.

In some embodiments, the at least one suspension line further comprises a friction hitch or knot attachment for length adjustment.

In some embodiments, the friction hitch or knot attachment comprises a prusik knot.

In any one of the embodiments of the apparatus, the coupling mechanism for releasably securing the ends of the connector strap of the apparatus comprises: a belt buckle; a cam buckle; a Velcro attachment; a Velcro hook and loop; airline seat buckle; a side release buckle; a double loop and strap of material; and a snap hook and ring.

In some embodiments, the belt buckle further comprises a frame-style buckle; a plate-style buckle; a box-out buckle or a box-frame buckle.

In some embodiments of the apparatus, the coupling mechanism is length-adjustable.

In any one of embodiments of the apparatus, the quick-release attachment coupling comprises a carabiner; a snap hook; a bolt snap; a spring snap; a spring clip; a harness clip; a releasable captured hook and variations thereof.

In any one of embodiments of the apparatus, the quick-release attachment coupling is adapted to couple to any of the fixation rings on the layered strap-like apparatus or belt-like strap, or an accessory device.

In any one of embodiments of the apparatus, the quick-release attachment coupling is adapted to couple to any stationary structure comprising a feature that can act as an anchoring point or a fixation ring.

In any one of embodiments of the apparatus, the quick-release attachment coupling is adapted to couple to any other attachment feature, coupling mechanism, fixation ring, coupling strap, or handgrip to facilitate wrapping the layered strap-like apparatus or strap-like belt around a stationary structure that can act as an anchoring point or a fixation ring.

In any one of embodiments of the apparatus, the fixation ring comprises: a circular ring; a reinforced material ring; a D-ring; a carabiner; a spring clip; a harness clip; a snap hook; and a releasable captured hook.

In any one of embodiments of the apparatus, the quick-release attachment couplings and fixation rings comprise materials of sufficient strength to support a human and provide a factor of safety, such as alloy aluminum, steels and other metals known to those skilled in the art for safety equipment, sky diving and mountain climbing, or any of the materials described below.

In any one of embodiments of the apparatus, the strap-like apparatus is adapted to be worn about the waist of the user's body. In any one of embodiments of the apparatus, the strap-like apparatus is adapted to be worn as a bandolier about the user's body. In any one of embodiments of the apparatus, the strap-like apparatus is adapted to be carried in a gym bag, backpack, or similar equipment-carrying apparatus.

In some embodiments of the apparatus, the at least one releasably attachable elastic band comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

In some embodiments, the apparatus comprises at least one releasably attachable non-elastic suspension band and/or at least one releasably attachable elastic band.

In some embodiments of the apparatus, the at least one releasably attachable non-elastic suspension band or releasably attachable elastic band comprises a protective sleeve to prevent or at least reduce wear, abrasion, tearing and scoring of the non-elastic suspension or elastic bands during use. In some embodiments, the sleeve prevents overstretching of the non-elastic suspension or elastic bands during use. In some embodiments, the protective sleeve has an elastic quality to allow it to stretch with the underlying band. In some embodiments, the elastic protective sleeve prevents overstretching of the non-elastic suspension or elastic bands during use.

In some embodiments of the apparatus, the elastic band comprises a non-elastic suspension inner band to prevent or at least reduce overstretching and possible failure of the elastic bands during use.

In some embodiments of the apparatus, an accessory article comprises an elastic band, a non-elastic suspension band, at least one detachable flexible or solid handgrip with flexible straps, a running parachute, a suspension cord, a suspension harness, a parachute cord, an additional coupling device, an additional quick-release attachment coupling mechanism, a flexible water canteen, and a glove.

In some embodiments of the apparatus, a quick-release attachment coupling mechanism comprises a circular ring; a D-ring; a carabiner; a spring clip; a harness clip; a snap hook; or a releasable captured hook.

In some embodiments of the apparatus, the strap-like apparatus comprises wear-resistant material comprising: nylon; moleskin; polyester; polypropylene; aramid polymer fabric; Kevlar®; technical fabric; SuperFabric®; Cordura®, Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix© Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) or leather.

In some embodiments of the strap-like apparatus, the apparatus further comprises one or more of a plurality of safety features comprising reflective tape; neon coloring; florescent coloring; a flashing light unit; a RFID tracking device; a GPS tracking device; or a geolocation device.

Provided herein is a suspension training system comprising: a first non-elastic suspension sub-assembly, a second non-elastic suspension sub-assembly, a first elastic suspension sub-assembly, a second elastic suspension sub-assembly, a first handgrip and a second handgrip; the first non-elastic suspension sub-assembly configurable for suspension from a first overhead structure, the first elastic suspension sub-assembly configurable for releasable attachment to the first non-elastic suspension sub-assembly, the first handgrip configurable for releasable attachment to either the first non-elastic suspension sub-assembly or the first elastic suspension sub-assembly; the second non-elastic suspension sub-assembly configurable for suspension from the first overhead structure or a second overhead structure, the second elastic suspension sub-assembly configurable for releasable attachment to the second non-elastic suspension sub-assembly, and the second handgrip configurable for releasable attachment to either the second non-elastic suspension sub-assembly or the second elastic suspension sub-assembly.

In some embodiments, the first non-elastic suspension sub-assembly comprises: a first non-elastic strap, band or line having a first end and a second end; the first end of the first non-elastic strap, band or line comprising a closed loop, and the second end of the first non-elastic strap, band or line having no attachments, a second non-elastic strap, band or line having a first end and a second end; and a first strap buckle comprising a first securing bar, and first strap clasping mechanism; wherein the second end of the second non-elastic strap, band or line is folded over the first securing bar, back onto a portion of the second non-elastic strap, band or line and permanently secured thereto, capturing the first securing bar, wherein the second free end of the first non-elastic strap, band or line, having no attachments, is pulled through the first strap buckle such that the second end is adjustably secured by the first strap clasping mechanism; and wherein the second non-elastic suspension sub-assembly comprises: a second non-elastic strap, band or line having a first end and a second end; the first end of the second non-elastic strap, band or line comprising a closed loop, and the second end of the second non-elastic strap, band or line comprising a free end, a fourth non-elastic strap, band or line having a first end and a second end; and a second strap buckle comprising a second securing bar, and second strap clasping mechanism; wherein the second end of the fourth non-elastic strap, band or line is folded over the second securing bar, back onto a portion of the fourth non-elastic strap, band or line and permanently secured thereto, capturing the second securing bar, wherein the second free end of the second non-elastic strap, band or line, having no attachments, is pulled through the second strap buckle such that the second end is adjustably secured by the second strap clasping mechanism.

In some embodiments, the first elastic suspension sub-assembly comprises: a first plurality of releasably attachable elastic bands or elastic cords, each having a first end and a second end, an approximately similar specified length, and a different known tension property from the remaining plurality of releasably attachable elastic bands or elastic cords in the first elastic suspension sub-assembly; wherein the first end of each releasably attachable elastic band or elastic cord comprises a first attachment feature and the second end comprises a second attachment feature; and wherein the second elastic suspension sub-assembly comprises: a second plurality of releasably attachable elastic bands or elastic cords, each having; a first end and a second end, an approximately similar specified length, and a different known tension property from the remaining plurality of releasably attachable elastic bands or elastic cords in the second elastic suspension sub-assembly, but having a matching tension to a corresponding releasably attachable elastic band or elastic cord in the first elastic suspension sub-assembly; wherein the first end of each releasably attachable elastic band or elastic cord comprises a first attachment feature and the second end comprises a second attachment feature.

In some embodiments, each elastic suspension sub-assembly of the suspension training system comprises an identical auxiliary strap with a first end and a second end, having an auxiliary shroud with a first edge, a second edge, a first end and a second end, the auxiliary shroud further comprising: a shroud releasable attachment feature configurable to secure one edge or end of the auxiliary shroud to another edge or end of the auxiliary shroud such that the auxiliary shroud is wrapably securable around the plurality of releasably attachable elastic bands or elastic cords.

In some embodiments, the auxiliary strap further comprises an attachment feature at each first and second end of the auxiliary strap.

In some embodiments of the suspension training system, the first handgrip and the second handgrip, each further comprises a flexible connector strap.

In some embodiments, the first handgrip and the second handgrip each further comprises an auxiliary loop feature suspended from the handgrip.

In some embodiments of the suspension training system, the first elastic suspension sub-assembly and the second elastic suspension sub-assembly are separable from the first non-elastic suspension sub-assembly and the second non-elastic suspension sub-assembly.

In some embodiments of the suspension training system, the first handgrip and the second handgrip are releasably attachable to the first non-elastic suspension sub-assembly and the second non-elastic suspension sub-assembly.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention is obtained by reference to the following detailed description that sets forth illustrative embodiments, in which the principles of the invention are taught, and the accompanying drawings of which:

Figure 1:
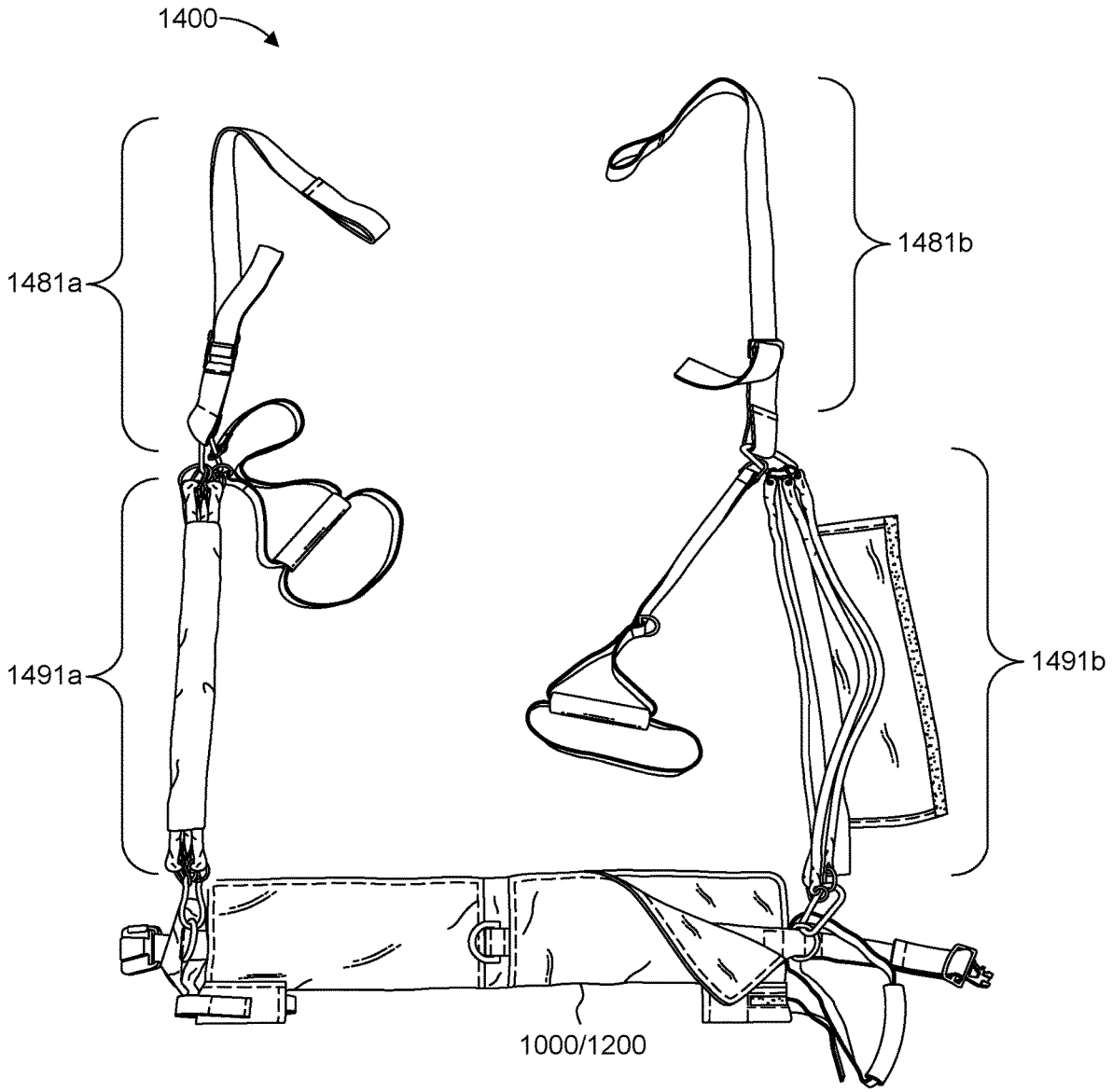
FIG. 1 is an illustrative plan view, demonstrating one embodiment of a portable exercise system as described herein.
Figure 2:
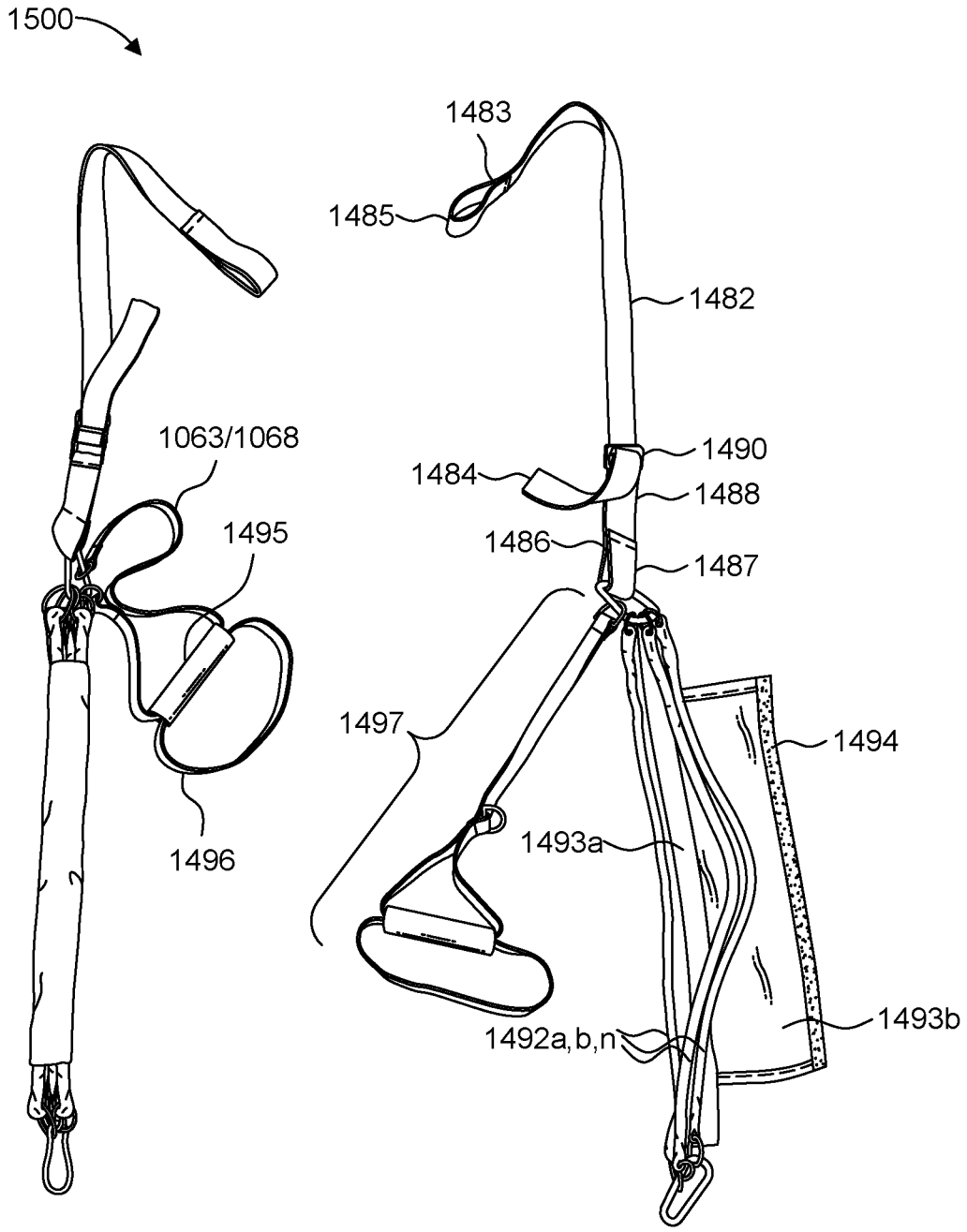
FIG. 2 is an illustrative plan view, demonstrating one embodiment of a suspension system comprising both non-elastic and elastic sub-assemblies, with both open and closed auxiliary shrouds surrounding the elastic sub-assemblies, configurable for independent suspension or for attachment to an embodiment of a portable exercise apparatus as described herein.
Figure 3A:
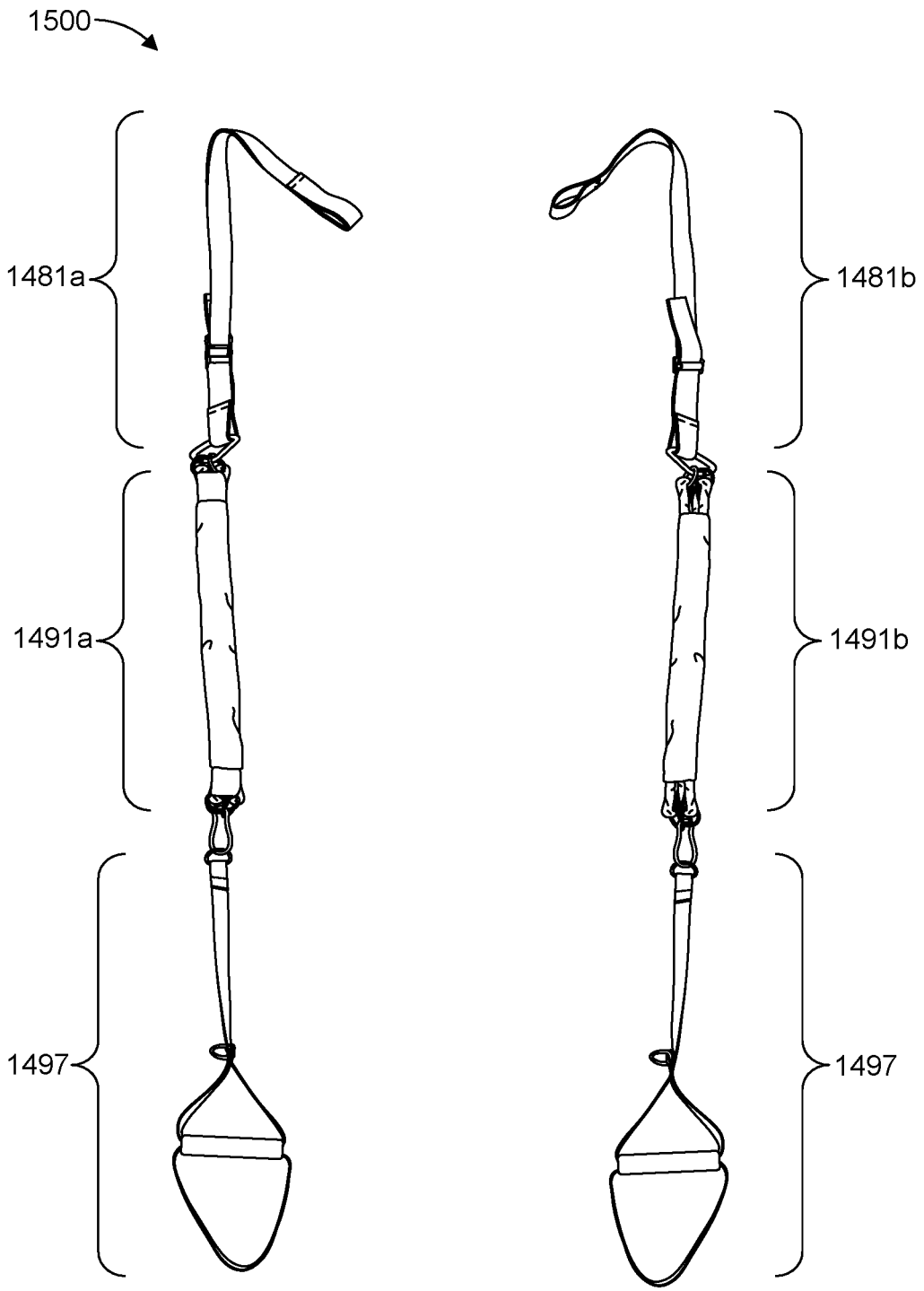
FIG. 3A is an illustrative plan view, demonstrating the suspension system of FIG. 2, with closed auxiliary shrouds surrounding the elastic sub-assemblies.
Figure 3B:
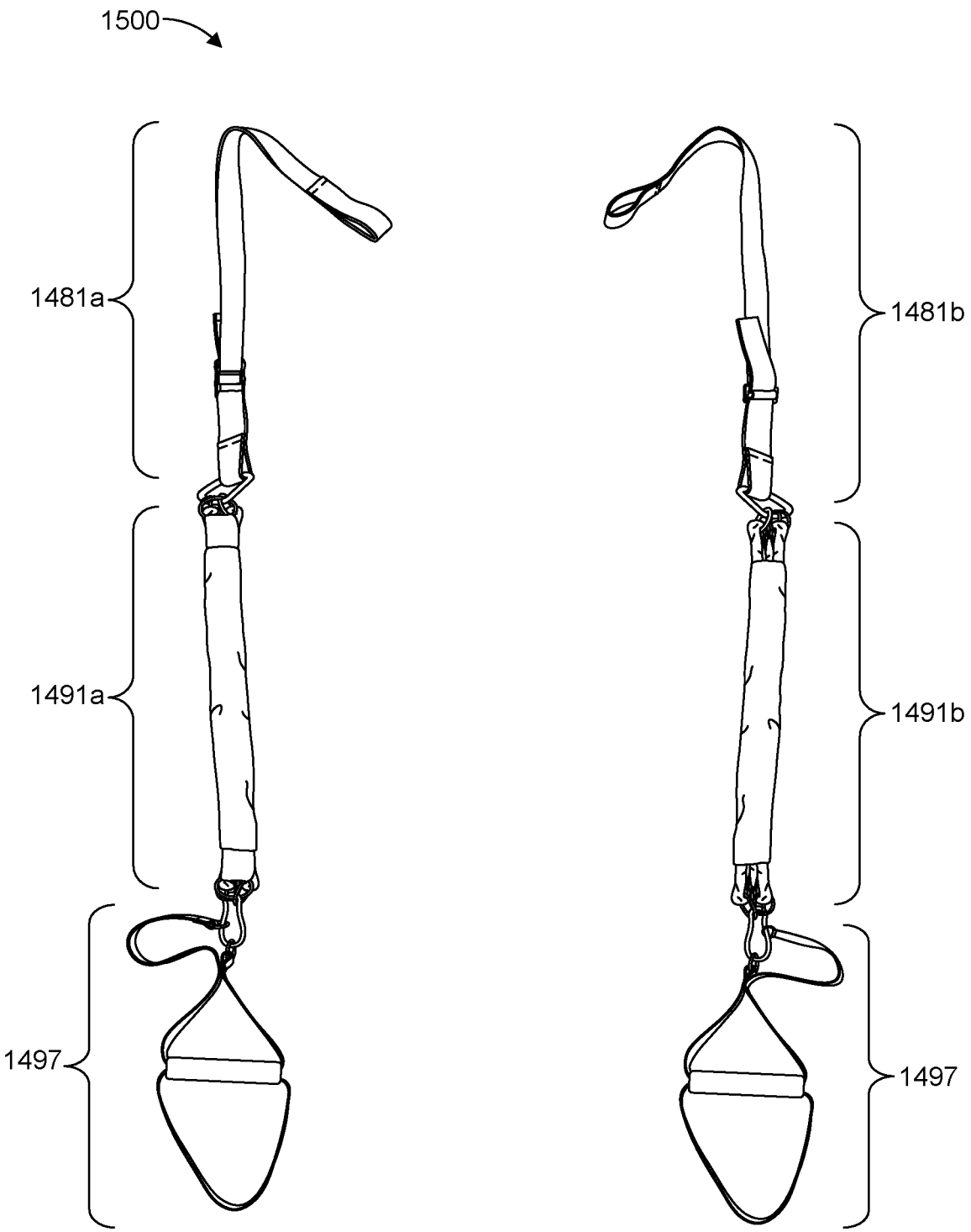
FIG. 3*b* is an illustrative plan view of the suspension system of FIG. 3A, demonstrating the adjustability of the strap lengths of the non-elastic sub-assemblies and adjustable length handgrip assemblies.
Figure 4A:
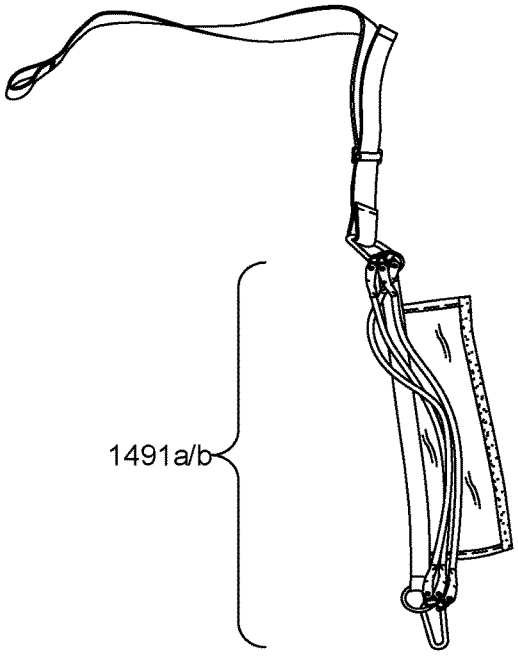
FIG. 4A is an illustrative front plan view, of an elastic sub-assembly with the auxiliary shroud opened, exposing the plurality of elastic bands or cords removably affixed to the auxiliary strap.
Figure 4B:
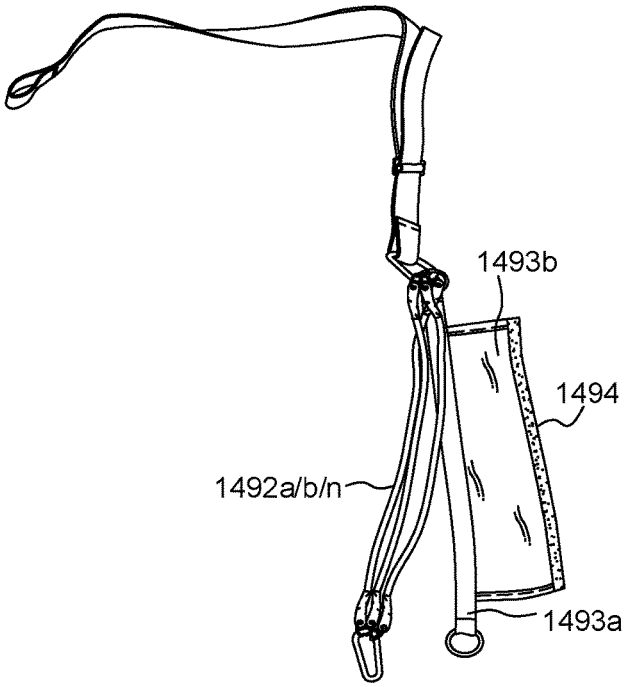
FIG. 4B is an illustrative front plan view, of an elastic sub-assembly with the auxiliary shroud opened, wherein all of the elastic bands or cords have been detached from one end of the auxiliary strap.
Figure 4C:
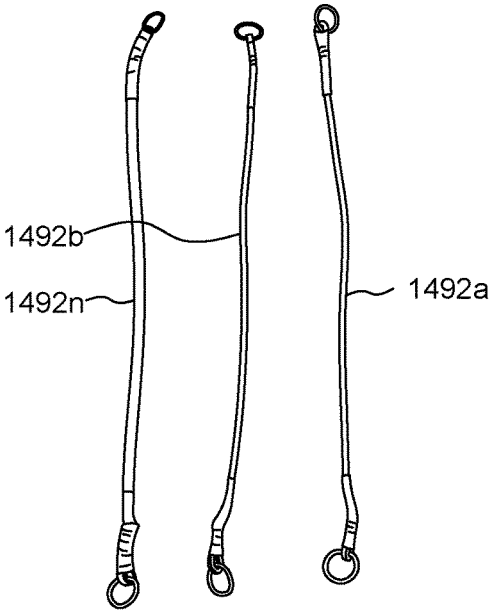
FIG. 4C is a perspective view of three representative elastic bands or cords, each having a different known tension and approximately similar lengths.

These representative views are not intended as limiting representations. One skilled in the art would recognize that this apparatus could be fabricated in a wide variety of combinations and configurations as illustrated herein, or from any number of recognized materials, or be configured similarly to any of the described shapes or configurations. In addition, the methods described herein are not intended to be limiting in any way. One skilled in the art would recognize that this apparatus could be utilized in many ways and could have many uses beyond those described herein.

DETAILED DESCRIPTION OF THE INVENTION

The present invention provides a novel and a versatile exercise apparatus for exercising multiple muscle groups of the user's body that comprises an exercise apparatus with closeable pockets, an attached connector strap, fixed and releasably attachable handgrips and multiple accessories adapted to be worn about the waist or carried across the chest of the user's body as a bandolier. The portable apparatus is lightweight, easy to use, and easily transportable and provides the general user, subject, patient, or athletic enthusiast with accessories that can add variety to their exercise regimen or therapy and allow them to have a versatile fitness experience anywhere.

As used herein, and unless otherwise specified, the terms "exercise apparatus," "exercise apparatus assembly," "strap-like belt," "layered strap," "layered strap-like belt" or "strap apparatus" are understood to have a synonymous interpretation meaning an apparatus comprising at least two layers with at least one pocket therebetween when assembled, with a connector strap and coupling mechanism attached thereto, adaptable to be worn about the body of a person; attachable to, or suspendable from a stable support structure and configurable to be utilized as an exercise or physical therapy device, as would be commonly understood by one skilled in the art.

As used herein, and unless otherwise specified, the term "tension band," "elastic band," "elastic tension band," "resistance band," and similar terms are understood to have a synonymous interpretation meaning flexible bands having an elastic tension utilized for resistance training or physical therapy. Resistance training (also called strength training or weight training) is the use of resistance to muscular contraction to build the strength, anaerobic endurance, and size of skeletal muscles.

As used herein, and unless otherwise specified, the term "about" or "approximately" means an acceptable error for a particular value as determined by one of ordinary skill in the art, which depends in part, on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 inches, 30.0 inches, 20.0 inches, 10.0 inches, 5.0 inches, 1.0 inches, 0.9 inches, 0.8 inches, 0.7 inches, 0.6 inches, 0.5 inches, 0.4 inches, 0.3 inches, 0.2 inches or 0.1 inches of a given value or range. In certain embodiments, the term "about" or "approximately" means within 40.0 mm, 30.0 mm, 20.0 mm, 10.0 mm, 5.0 mm, 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 40.0 lbs., 30.0 lbs., 20.0 lbs., 10.0 lbs., 5.0 lbs., 1.0 lbs., 0.9 lbs., 0.8 lbs., 0.7 lbs., 0.6 lbs., 0.5 lbs., 0.4 lbs., 0.3 lbs., 0.2 lbs. or 0.1 lbs. of a given value or range. In certain embodiments, the term "about" or "approximately" means within 20.0 kg., 10.0 kg., 5.0 kg., 1.0 kg., 0.9 kg., 0.8 kg., 0.7 kg., 0.6 kg., 0.5 kg., 0.4 kg., 0.3 kg., 0.2 kg., 0.1 kg., or 0.05 kg., of a given value or range.

As used herein, and unless otherwise specified, the term "about" when used with respect to a weight or tension load means variations up to 5%, up to 10%, up to 15%, up to 20%, up to 25%, and up to 30%. For example: If the amount of weight or tension load is "10.0 lbs.," this may include variations of up to 5%, i.e. 9.5-10.5 lbs., variations of up to 10%, i.e. 9.0-11.0 lbs., variations of up to 15%, i.e. 8.5-11.5 lbs., variations of up to 20%, i.e. 8.0-12.0 lbs., variations of up to 25%, i.e. 7.5-12.5 lbs., or variations of up to 30%, i.e. 7.0-13.0 lbs.

As used herein, and unless otherwise specified, the term "about" when used with respect to a length means variations up to 5%, up to 10%, up to 15%, up to 20%, up to 25%, and up to 30%. For example: If the amount of the length is "10.0 ft.," this may include variations of up to 5%, i.e. 9.5-10.5 ft., variations of up to 10%, i.e. 9.0-11.0 ft., variations of up to 15%, i.e. 8.5-11.5 ft., variations of up to 20%, i.e. 8.0-12.0 ft., variations of up to 25%, i.e. 7.5-12.5 ft., or variations of up to 30%, i.e. 7.0-13.0 ft.

As used herein, the terms "comprises", "comprising", or any other variation thereof, are intended to cover a nonexclusive inclusion, such that a process, method, article, or apparatus that comprises a list of elements does not include only those elements but may include other elements not expressly listed or inherent to such process, method, article, or apparatus.

As used herein, and unless otherwise specified, the term "plurality", and like terms, refers to a number (of things) comprising at least one (thing), or greater than one (thing), as in "two or more" (things), "three or more" (things), "four or more" (things), etc.

As used herein, the terms "user," "subject," "subjects," "athlete" or "patient", are used interchangeably.

As used herein, the terms "user," "subject" and "subjects," "athlete" or "patient", refer to a primate (e.g., a human). In certain embodiments, the primate is 0 to 6 months old, 6 to 12 months old, 1 to 5 years old, 5 to 10 years old, 10 to 15 years old, 15 to 20 years old, 20 to 25 years old, 25 to 30 years old, 30 to 35 years old, 35 to 40 years old, 40 to 45 years old, 45 to 50 years old, 50 to 55 years old, 55 to 60 years old, 60 to 65 years old, 65 to 70 years old, 70 to 75 years old, 75 to 80 years old, 80 to 85 years old, 85 to 90 years old, 90 to 95 years old or 95 to 100 years old. In a preferred embodiment, the user, subject, athlete, or patient is a human.

As used herein, the terms "therapies," "therapy," "treatment(s)" and "treating" can refer to any protocol(s), method (s), compositions, exercises, and/or agent(s) that can be used in the prevention, treatment, management, or amelioration of a sub-optimal physical condition, (e.g.: weight management, arthritis; orthopedic surgery recovery; stroke, heart attack, amputation, etc.). In certain embodiments, the terms "therapies" and "therapy" refer to physical therapy, supportive therapy, and/or other therapies useful in treatment, management, prevention, or amelioration of a sub-optimal physical condition, known to one of skill in the art.

As used herein, and unless otherwise specified, the term "anterior" refers to human anatomy and means the front surface of the body; often used to indicate the position of one structure relative to another, that is, situated nearer the front part of the body. Alternately, it may also refer in a similar fashion to an apparatus or structure.

As used herein, and unless otherwise specified, the term "posterior" refers to human anatomy and means the back surface of the body; Often used to indicate the position of one structure relative to another, that is, nearer the back of the body. Alternately, it may also refer in a similar fashion to an apparatus or structure.

As used herein, and unless otherwise specified, the term "superior" refers to human anatomy and means situated nearer the vertex of the head in relation to a specific reference point; opposite of inferior. It may also mean situated above or directed upward. Alternately, it may also refer in a similar fashion to an apparatus or structure.

As used herein, and unless otherwise specified, the term "inferior" refers to human anatomy and means situated nearer the soles of the feet in relation to a specific reference point; opposite of superior. It may also mean situated below or directed downward. Alternately, it may also refer in a similar fashion to an apparatus or structure.

As used herein and unless otherwise specified, the term "medial" refers to human anatomy and refers to being situated toward the median plane or midline of the body. Alternately, it may also refer in a similar fashion to an apparatus or structure. In some embodiments, medial refers to an inside surface of an apparatus, closest to the midline of the body to which the apparatus is applied.

As used herein, and unless otherwise specified, the term "lateral" refers to human anatomy and means denoting a position farther from the median plane or midline of the body or a structure. Alternately, it may also refer in a similar fashion to an apparatus or structure. It can also mean, "pertaining to a side." In some embodiments, lateral refers to an outside surface of an apparatus, farthest from the midline of the body to which the apparatus is applied.

As used herein, and unless otherwise specified, the term "transverse plane" (also called the horizontal plane, axial plane, or transaxial plane), is an imaginary plane that divides the body into superior and inferior parts and is perpendicular to the coronal and sagittal planes.

As used herein, and unless otherwise specified, the term "coronal plane" (also known as the frontal plane, sometimes referred to as a longitudinal plane because it is perpendicular to the transverse plane), is any vertical plane that divides the body into ventral and dorsal (belly and back) sections.

As used herein, and unless otherwise specified, the term "sagittal plane" (also known as median plane or mid-sagittal plane), is an anatomical plane which divides the body into right and left halves. This plane cuts the body into halves (assuming bilateral symmetry), passing through midline structures such as the navel and spine. The term "parasagittal" as used herein is meant to describe any plane parallel to the sagittal plane.

As used herein, and unless otherwise specified, the term "prone" means lying on the stomach and the term "supine" means lying on the back.

As used herein, the term "proximity" means nearness in space or relationship, but not excluding the potential to be touching. Proximity is also alternatively meant to mean that one thing may be as close to another thing as to be "in direct or nearly direct contact" (in proximity) with another thing along some point. To "place something in proximity" is also meant to mean that items are "paired" or "mated together" either in their paired function or at some point of contact.

As used herein, and unless otherwise specified, the terms "connection device," "connector" and "attachment coupling" mean a device intended for connecting parts together or for the pairing of two items; a device that serves to connect the ends of adjacent parts or objects.

As used herein, and unless otherwise specified, the term "securing mechanism" means a method, tool, or device intended to close, fix, fasten or join two or more components together in a secure manner, in order to assure that they not become loose, not open unintentionally, give way, or be lost. The term "securing mechanism" is used broadly and may include locks, attachment couplings, buckles, closure mechanisms, threads, stitches, Velcro or "hook and loop" connectors, straps, strings, ties, zippers, hitches, snaps, etc.

As used herein, and unless otherwise specified, the term "closure mechanism", "cavity closure mechanism" and similar terms, means a method, tool or device intended to close an opening or secure two or more edges together in order to close an opening or pocket. A closure mechanism may include attachment couplings, closure mechanisms, threads, stitches, zippers, snaps, etc.

As used herein, and unless otherwise specified, the term "pocket" means a small bag or "pouch" that is typically sewn onto or inserted in the apparatus, such that it is open at the top and/or side and intended for carrying items. A pocket may be open or closeable, comprising a closure mechanism intended to close the pocket in order to secure items within the pocket, but openable to allow for the extraction of said items when desired.

As used herein, and unless otherwise specified, the term "margin" or "end margin" means a border or edge or a garment or piece of material, as for example, the edge of a pocket or pouch where a seam, edge, or closure mechanism exists.

As used herein, and unless otherwise specified, the term "carabiner" refers to a specialized type of shackle, a metal loop with a spring-loaded gate used to quickly and reversibly connect components, most notably in safety-critical systems. The word is a shortened form of Karabinerhaken (or also short Karabiner), a German phrase for a "spring hook" to attach items to a belt or bandolier. They are predominantly made from both steel and aluminum, but other high strength materials, such as titanium, could also be utilized. In any one of the embodiments, the carabiner can comprise "auto-locking," "manual locking," or "non-locking" mechanisms.

As used herein, and unless otherwise specified, the term "pocket" or "pouch" refers to a small bag or containment space sewn into or on clothing or into or on an item to form part of the item, used for carrying small articles or accessories.

In some embodiments, the exercise apparatus comprises at least one pocket between the layers of the strap-like apparatus for securing and carrying exercise accessories, such as releasable handgrips, various attachment devices, ropes, "first aid" materials, suspension lines, bands, or elastic bands attachable to multiple fixation rings located about the strap-like apparatus. In some embodiments, the apparatus and described methods of use provide the user with balanced loading options to develop even muscle tone or muscle stretching options, while providing the user with the flexibility to exercise, indoors, outdoors or anywhere.

Alternatively, one skilled in the art would understand that in some embodiments, the exercise apparatus is a multi-purpose training apparatus configurable by the user or a trained professional as a physical therapy device.

Alternatively, one skilled in the art would understand that in some embodiments, the strap-like apparatus described herein comprises a single "base" layer, with one or more pockets comprising at least one auxiliary layer formed on one or both sides of the base layer of the strap-like apparatus.

The exercise apparatus can be worn or carried anywhere by the user and is configurable to provide an individual with portable exercise equipment to perform balanced resistance training, stretching and tension training utilizing, among other things, elastic and non-elastic suspension bands, suspension lines, as well as detachable and affixed flexible or solid handgrips used in various exercise protocols and therapeutic applications.

Provided herein is a fully portable exercise apparatus utilized for exercising, stretching, and training multiple muscle groups of the body of a user. The apparatus has at least one closeable pocket and fixation rings for securing and carrying accessories, such as attachable handgrips, adjustable suspension straps or lines, and elastic bands or cords.

Another configuration provided herein illustrates a suspension training system comprising; non-elastic suspension sub-assemblies, elastic suspension sub-assemblies and handgrips, configurable with or without the portable exercise apparatus.

The apparatus and methods of use provide the user with a plurality of configurations for assisted exercise regimens and the flexibility to exercise anywhere. The apparatus described herein are adaptable to be worn about the waist of a user, carried as a bandolier about the user's body or utilized as a releasably fixed suspension trainer.

As illustrated in FIGS. 1, 8A-8D and 10-27, provided here is a portable exercise system 1400 comprising a belt assembly 1000, 1200 comprising; an adjustable connector strap 1001 having a first end 1002 and a second end 1003 spaced lengthwise from each other, at least one closeable pocket 1010, 1030, affixed lengthwise along the adjustable connector strap between the first end and the second end, a first fixation ring 1051 affixed to the adjustable connector strap between the first end 1002 and a first exterior end margin 1016 of the at least one closeable pocket, and a second fixation ring 1052 affixed to the adjustable connector strap between the second end 1003 and a second exterior end margin 1017 of the at least one closable pocket; a first elastic suspension sub-assembly 1491*a* and a second elastic suspension sub-assembly 1491*b*, each sub-assembly comprising: a plurality of releasably attachable elastic bands or elastic cords 1492*a/b/n*, creating a set; a releasably attachable shroud 1493*b* comprising at least a first half of a releasable hook and loop closure mechanism 1494 and a releasably attachable suspension strap 1493*a* having a first end and a second end affixed to the shroud; a first non-elastic suspension strap assembly 1481*a* and a second non-elastic suspension strap assembly 1491*b* comprising a plurality of attachment features or loops; and a first adjustable-length handgrip assembly 1497 and a second adjustable-length handgrip assembly 1497.

In some embodiments, the portable exercise system further comprises a coupling mechanism assembly 1006 comprising a first coupling component 1007 at the first end of the adjustable connector strap and a second coupling component 1008 slidably affixed along the adjustable connector strap in proximity to the second end for releasably securing the first end of the adjustable connector strap to a section of the adjustable connector strap near the second end; and a third fixation ring 1053 affixed to or about the approximate lengthwise center of the adjustable connector strap, or affixed to the approximate lengthwise center of the closeable pocket, approximately equidistant between the first fixation ring 1051 and the second fixation ring 1052.

As illustrated in FIGS. 2, 3A, 3B, and 4A-4C, in some embodiments of the portable exercise system, each one of the plurality of releasably attachable elastic bands or elastic cords 1492*a/b/n* creating the set of the first elastic suspension sub-assembly 1491*a* and the set of second elastic suspension sub-assembly 1491*b* comprises a first end and a second end, a specified length and a known tension property, wherein each first end comprises a first attachment feature, such as an auxiliary fixation ring 1071 and each second end comprises a second attachment feature, such as 1071, and wherein each attachment feature further comprises a quick-release attachment coupling, such as a carabiner 1072.

In some embodiments of the portable exercise system, each releasably attachable elastic band or elastic cord 1492*a/b/n* of the first elastic suspension sub-assembly comprises a different known tension property from the other releasably attachable elastic bands or elastic cords in the first sub-assembly, wherein each releasably attachable elastic band or elastic cord of the second elastic suspension sub-assembly comprises a different known tension property from the other releasably attachable elastic bands or elastic cords in the second sub-assembly, and wherein the tension properties of each set of releasably attachable elastic bands or elastic cords in the first elastic suspension sub-assembly and the second elastic suspension sub-assembly are the same. Non-limiting examples of such tension properties for the bands 1492*a/b/n* in each sub-assembly set 1491*a*, 1491*b* can include tension loads such as 5 lbs., 10 lbs., 15, lbs. 20 lbs., 25., 30 lbs. 35 lbs., 40 lbs., 45 lbs., 50 lbs., 55 lbs., 60 lbs., 65 lbs., 70 lbs., or 75 lbs. Further still, tension properties for the bands 1492*a/b/n* in each sub-assembly set 1491*a*, 1491*b* can comprise an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs. Alternatively, such tension properties can be measured in kilograms. Further still, incremental differences between bands can be in any variable amount, wherein, ideally the tension properties of each set of bands in the first elastic suspension sub-assembly, match the tension properties of the mating set of bands in the second elastic suspension sub-assembly.

Further still the lengths of each releasably attachable elastic band or elastic cord 1492*a/b/n* of the first elastic suspension sub-assembly and second elastic suspension sub-assembly are approximately the same length. In some embodiments of the portable exercise system, each releasably attachable elastic band or elastic cord 1492 *a/b/n*, ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

Figure 5A:
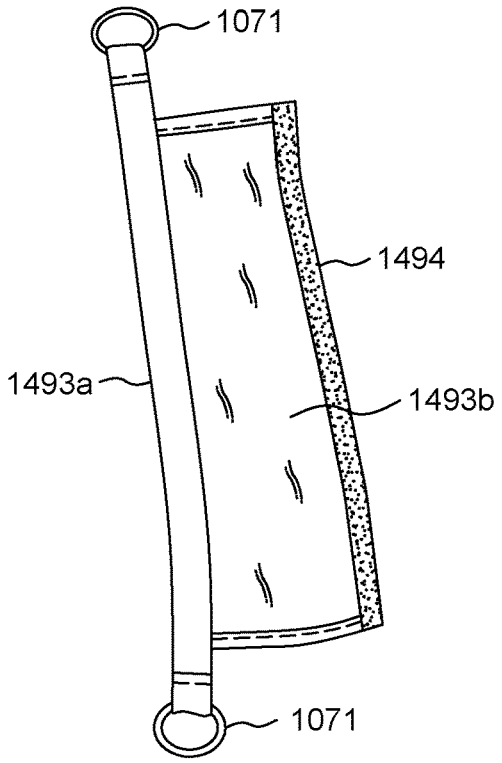
FIG. 5A is an illustrative inside view of an open auxiliary shroud on an auxiliary strap, with a hook and loop attachment feature on the shroud.
Figure 5B:
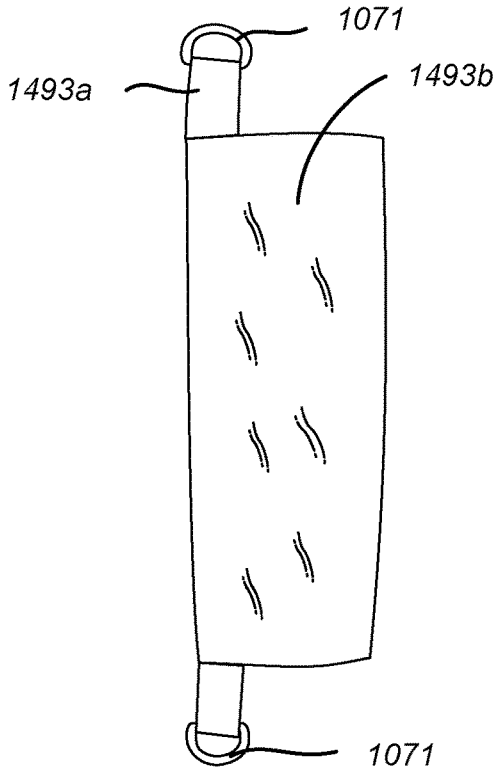
FIG. 5B is an illustrative outside view of an open auxiliary shroud on an auxiliary strap.
Figure 5C:
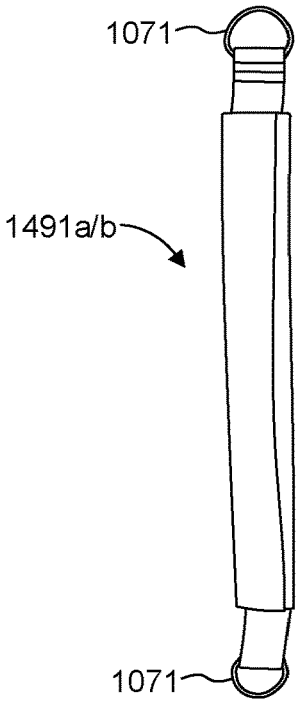
FIG. 5*c* is an illustrative view of a closed auxiliary shroud on an auxiliary strap.
Figure 6A:
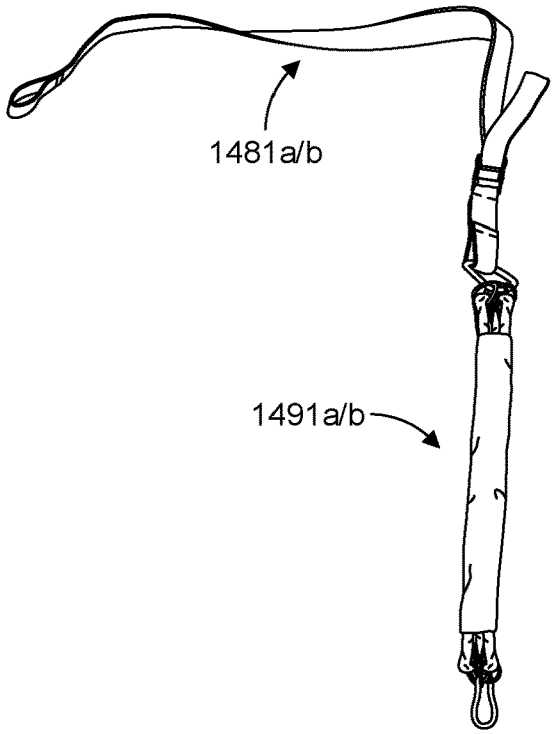
FIG. 6A is an illustrative plan view, demonstrating one embodiment of a suspension system comprising both non-elastic and elastic sub-assemblies configured without a handgrip attachment.
Figure 6B:
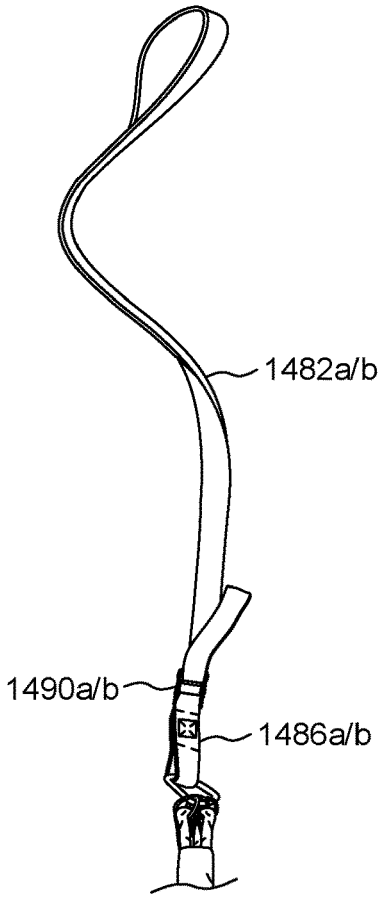
FIG. 6B is an illustrative plan view, demonstrating the embodiment of FIG. 6A demonstrating a near-full length of the non-elastic strap sub-assembly.
Figure 6C:
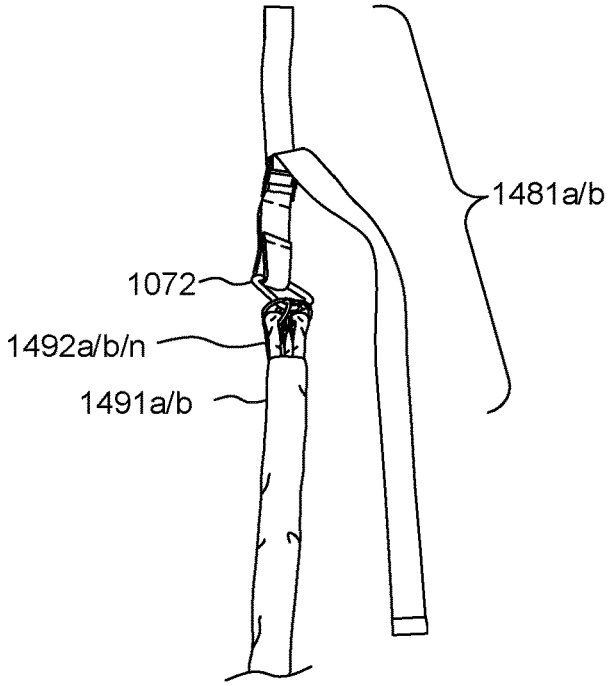
FIG. 6C is an illustrative plan view, demonstrating the embodiment of FIG. 6A demonstrating a shortened length of the non-elastic strap sub-assembly attached to an end of an elastic sub-assembly.
Figure 7A:
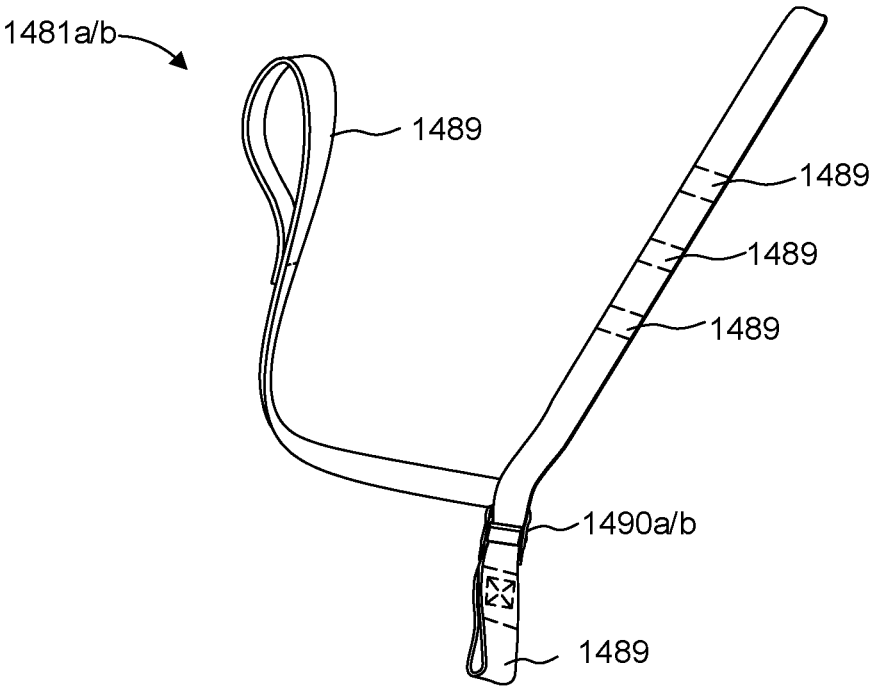
FIG. 7A is a representative plan view of the exemplary of the strap buckle in the non-elastic strap sub-assembly.
Figure 7B:
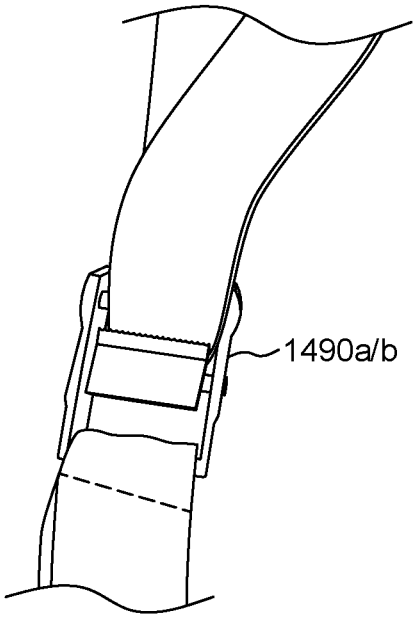
FIG. 7B is a detail top view of the exemplary strap buckle in the non-elastic strap sub-assembly.
Figure 7C:
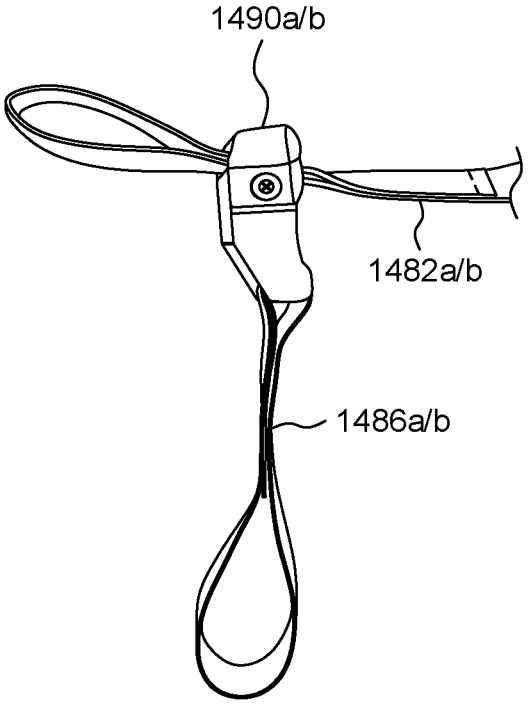
FIG. 7C is a detail side view of the exemplary of the strap buckle, with the representative first or second and third or fourth non-elastic strap, band or line coupled to the representative strap buckle in an assembly.
Figure 7D:
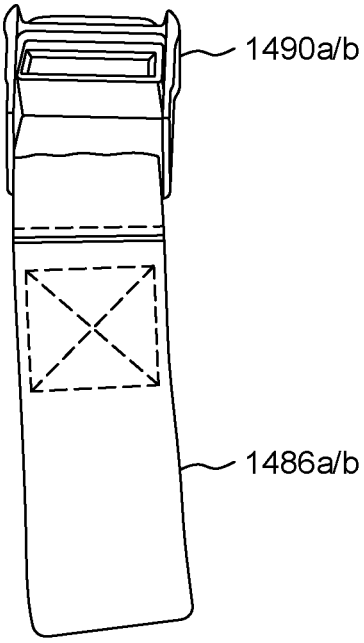
FIG. 7D is an illustrative top view of the representative third or fourth non-elastic strap, band or line coupled to the representative strap buckle.
Figure 7E:
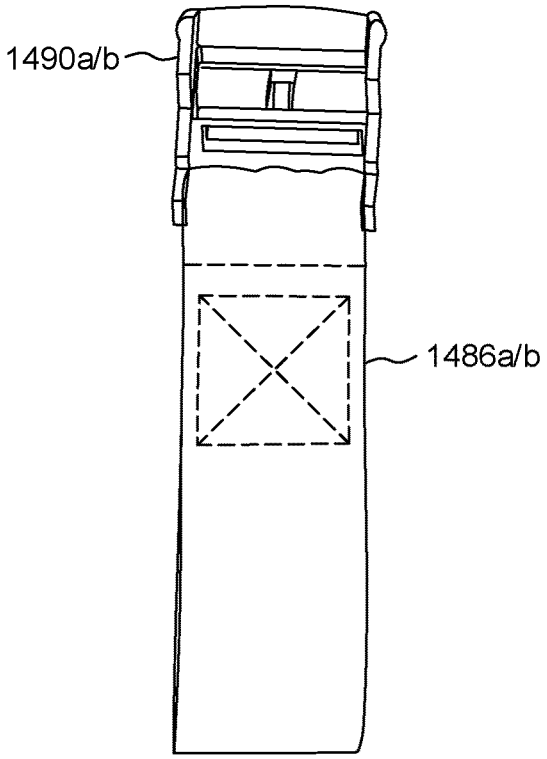
FIG. 7E is an illustrative bottom view of the representative third or fourth non-elastic strap, band or line coupled to the representative strap buckle.
Figure 7F:
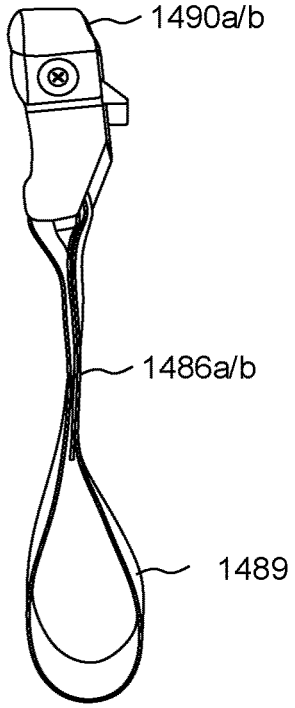
FIG. 7F is an illustrative side view of the representative third or fourth non-elastic strap, band or line coupled to the representative strap buckle of one configuration of the assembly.
Figure 8A:
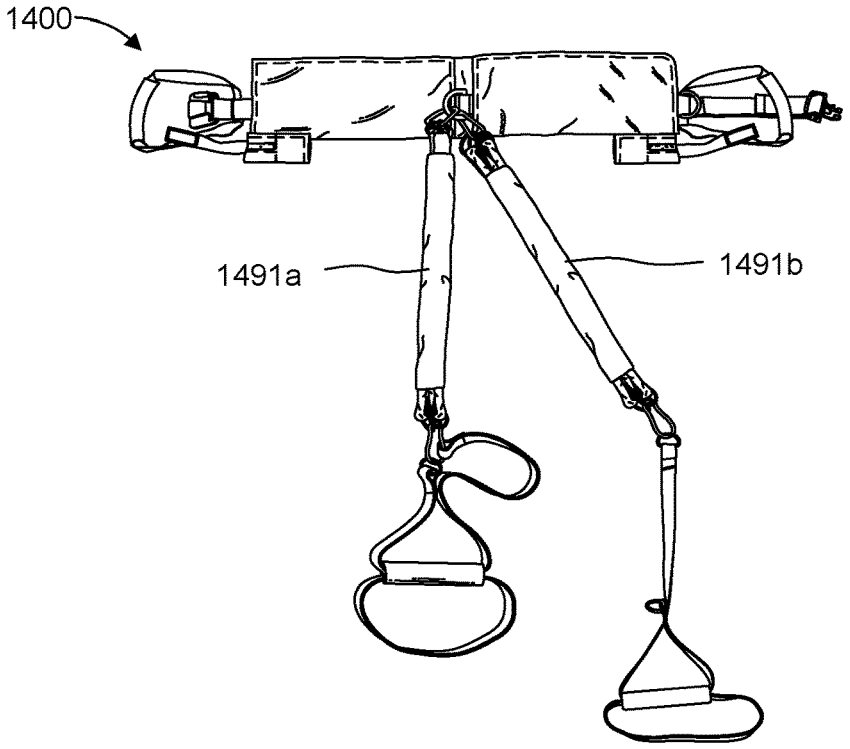
FIG. 8A is an illustrative view of the portable exercise apparatus comprising two sub-assemblies suspended from the third fixation ring, each sub-assembly comprising elastic sub-assemblies and adjustable length handgrips.
Figure 8B:
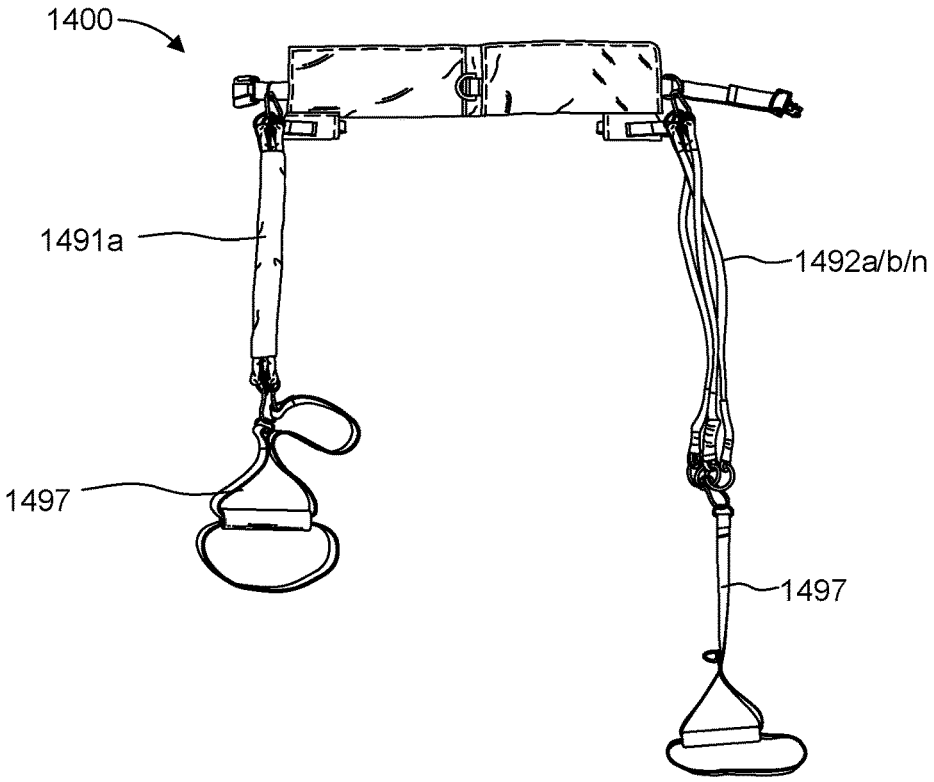
FIG. 8B is an illustrative view of two sub-assemblies, each sub-assembly suspended from the first and third fixation ring respectively, each sub-assembly comprising elastic sub-assemblies, (one with and one without an auxiliary shroud and auxiliary strap), and adjustable length handgrips.
Figure 8C:
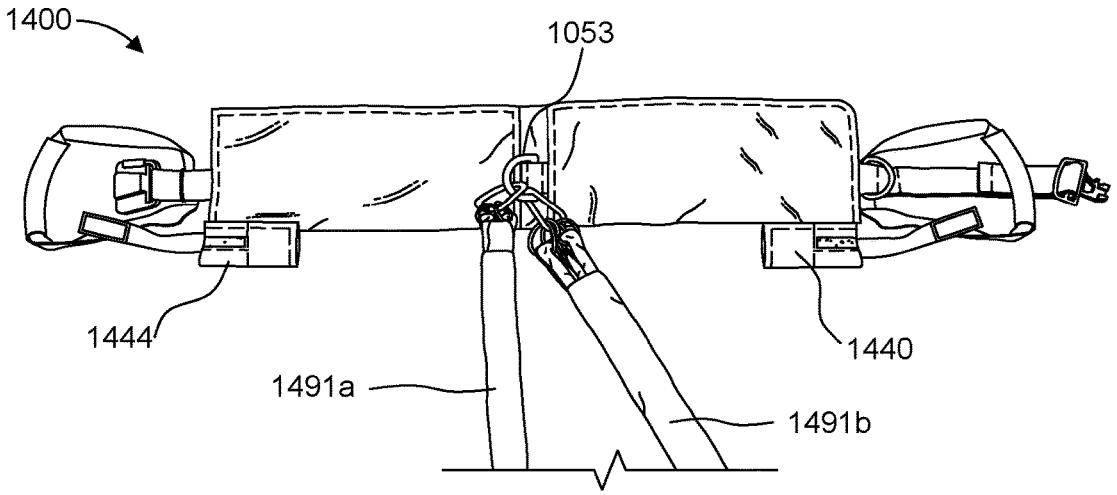
FIG. 8C is a detailed illustrative view of the attachment of the two elastic sub-assemblies suspended from the third fixation ring, as shown in FIG. 8A.
Figure 8D:
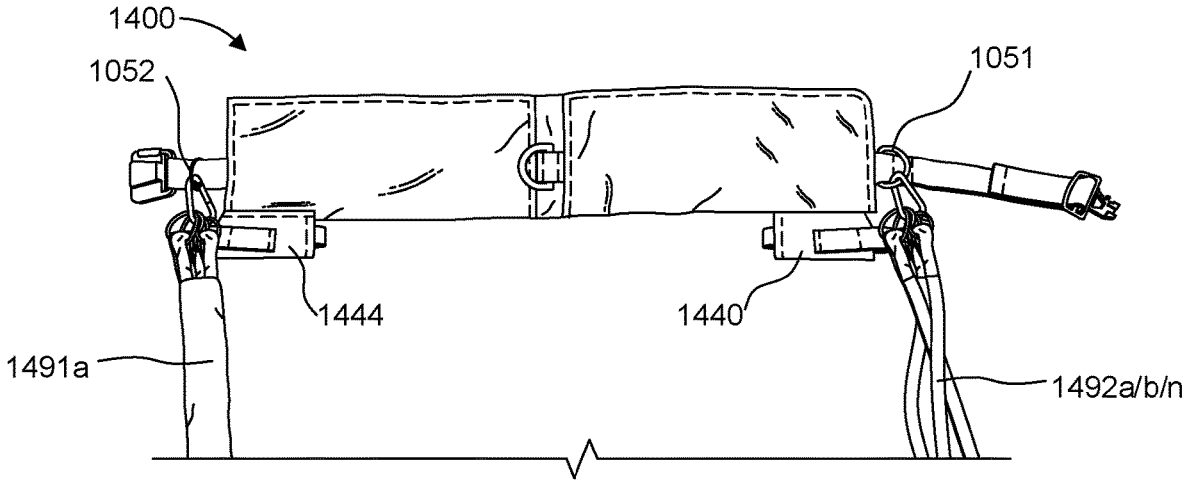
FIG. 8D is a detailed illustrative view of the attachment of the two elastic sub-assemblies, (one with and one without an auxiliary shroud and auxiliary strap), suspended from the first and third fixation ring respectively, each adjacent to an auxiliary handle storage sleeve, as shown in FIG. 8B.

As illustrated in FIGS. 5A-5C, in some embodiments of the portable exercise system, each releasably attachable suspension strap 1493*a* affixed to the shroud 1493*b* further comprises a second half of a releasable hook and loop closure mechanism 1494, such as along an edge or on one side of the suspension strap, to enclose the shroud around the plurality of releasably attachable elastic bands or elastic cords, and wherein the first end comprises a first attachment feature 1071 and the second end comprises a second attachment feature 1071, and wherein each attachment feature further comprises a quick-release attachment coupling 1072.

As will become apparent upon reading this disclosure, the shroud 1493*b* and suspension strap 1493*a* are provided for multiple purposes depending on the desired embodiment. In one embodiment, the purpose of using the shroud alone and disengaging at least one end of the suspension strap, serves as a means to temporarily confine the loosely hanging plurality of bands, or any sub-number of bands in the set, and prevent entanglement with the user or other nearby items when used as an elastic sub-assembly. In another embodiment, the suspension strap can be utilized to convert the entire assembly of elastic bands into a non-elastic sub-assembly by engaging the fixation rings at both ends of the suspension strap, along with the hanging plurality of bands. Further still, combining the shroud wrapped around the plurality of bands and the suspension strap, provides an easy method for securing the entire sub-assembly for transport or storage within a pocket of the portable exercise system 1400.

Figure 9A:
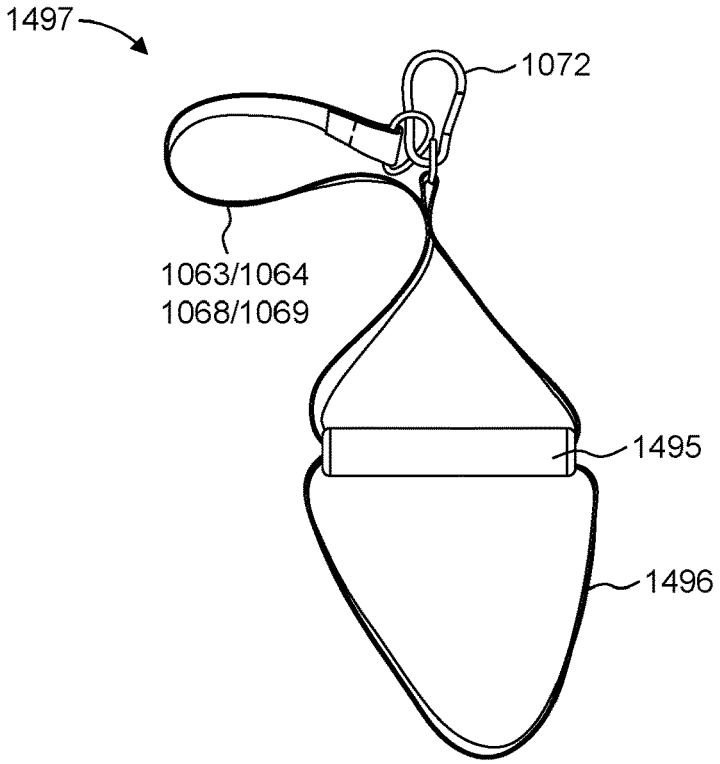
FIG. 9A is a plan view of a first handgrip with a first flexible strap comprising a first and second attachment feature, both coupled together with a carabiner to form a shortened suspension length.
Figure 9B:
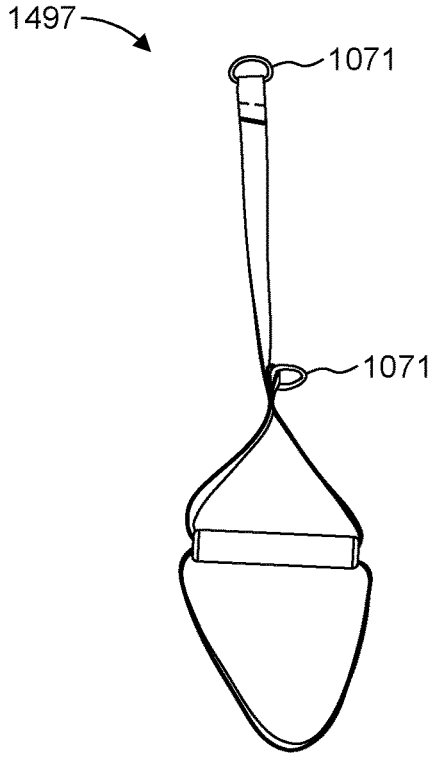
FIG. 9B is a plan view of the first handgrip of FIG. 11, fully extended.

As further illustrated in FIGS. 6A-6C and 7A-7E, in some embodiments of the portable exercise system, the first non-elastic suspension strap assembly 1481*a* and the second non-elastic suspension strap assembly 1481*b* each comprises: a first non-elastic strap 1482*a*, band or line having a first end 1483 and a second end 1484; the first end 1487 of the first non-elastic strap, band or line comprising a closed loop 1485, and the second end 1488 of the first non-elastic strap, band or line having no attachments; a second non-elastic strap, band or line having a first end and a second end; and a strap buckle 1490*a/b* comprising a securing bar, and strap clasping mechanism; wherein the second end of the second non-elastic strap, band or line is folded over the securing bar, back onto a portion of the second non-elastic strap, band or line and permanently secured thereto, capturing the first securing bar, and wherein the second end of the first non-elastic strap, band or line is pulled through the strap buckle such that the second end is adjustably secured by the strap clasping mechanism. In some embodiments, the first and second non-elastic suspension strap assemblies 1481*a/b* and the third and fourth non-elastic strap 1486 *a/b* each have a plurality of pockets or openings 1489 formed between folded and sewn layers of the non-elastic straps or at the ends, to provide attachment points for quick-release attachment coupling 1072, such as a carabiner As shown in FIGS. 9A-9B, in some embodiments of the portable exercise system, the first adjustable-length handgrip assembly 1497 and the second adjustable-length handgrip assembly 1497 each comprises: a handgrip 1495 with a flexible connector strap 1068, 1069, wherein the handgrip is hollow, wherein the flexible connector strap further comprises a first attachment feature 1071 at the end of the flexible connector strap and at least a second attachment feature 1071 along the length of the flexible connector strap, and wherein the first attachment feature further comprises a quick-release attachment coupling 1072, such as a carabiner.

In some embodiments of the portable exercise system, each of the first adjustable-length handgrip assembly and the second adjustable-length handgrip assembly further comprises an auxiliary loop feature 1496 suspended from the handgrip.

In some embodiments of the portable exercise system, the first adjustable-length handgrip assembly and the second adjustable-length handgrip assembly are releasably affixable to at least one of the first, second and third fixation rings 1051, 1052, 1053.

In some embodiments of the portable exercise system, the first adjustable-length handgrip assembly and the second adjustable-length handgrip assembly are releasably affixable to any one or more of the plurality of attachment features or loops 1489 of the first non-elastic suspension strap sub-assembly or the second non-elastic suspension strap sub-assembly 1481*a/b*.

In some embodiments of the portable exercise system, the first adjustable-length handgrip with the flexible connector strap and the second adjustable-length handgrip assembly are releasably affixable to any one or more of the attachment features 1071, 1072 of the first elastic suspension sub-assembly 1491*a/b*.

In some embodiments, the portable exercise system further comprises a third fixation ring 1053 or an auxiliary attachment feature 1071, 1072 at any location along the length of the flexible connector strap.

In some embodiments, the portable exercise system further comprises a second closeable pocket 1010, 1030, affixed along the adjustable connector strap between the first end and the second end.

In some embodiments, the portable exercise system further comprises at least one permanently affixed handgrip 1061, with a first flexible handgrip connector strap 1063, affixed to the adjustable connector strap 1001.

In some embodiments, the portable exercise system further comprises a second permanently affixed handgrip 1062, with a second flexible handgrip connector strap 1064, affixed to the adjustable connector strap, wherein the first permanently affixed handgrip and the second permanently affixed handgrip are hollow.

In some embodiments, the portable exercise system further comprises a first auxiliary storage sleeve 1040 having a first end 1041, a second end 1042 and a first cavity 1043 therebetween, and affixed on or about an exterior margin 1031 of the at least one closable pocket 1010.

In some embodiments of the portable exercise system, the first auxiliary storage sleeve is sized and configured to store the at least one permanently affixed handgrip with the first flexible handgrip connector strap.

In some embodiments, the portable exercise system further comprises a second auxiliary storage sleeve 1044, having a third end 1045, a fourth end 1046, and a second cavity 1047 therebetween and affixed on or about an exterior margin 1031, of the at least one closable pocket 1010.

In some embodiments of the portable exercise system, the second auxiliary storage sleeve is sized and configured to store the second permanently affixed handgrip with the second flexible handgrip connector strap.

In some embodiments of the portable exercise system, any one or all of the first elastic suspension sub-assembly; the second elastic suspension sub-assembly; the first non-elastic suspension strap assembly; the second non-elastic suspension strap assembly; the first adjustable-length handgrip assembly; and the second adjustable-length handgrip assembly, are configurable to be stored and transported within the at least one closeable pocket, affixed along the adjustable connector strap.

Figure 15:
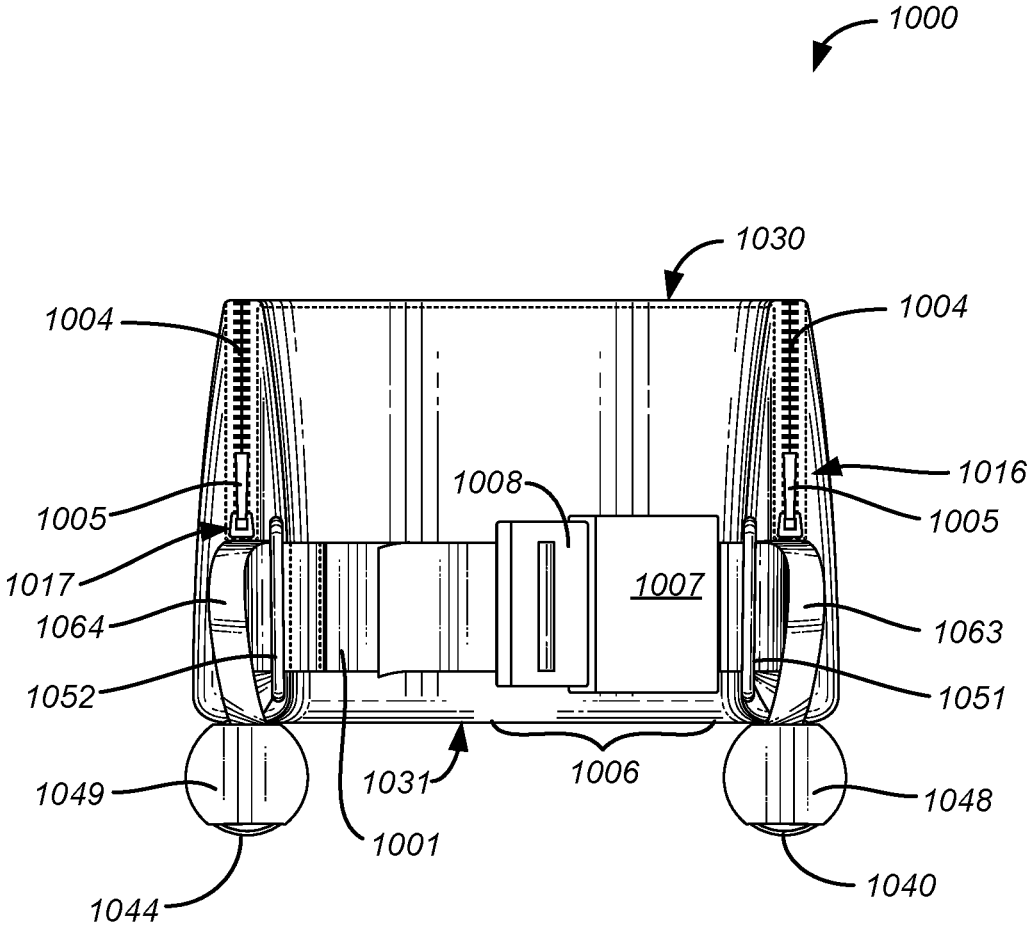
FIG. 15 is a front elevation view of the exemplary portable exercise apparatus of FIG. 10 with a single closeable continuous pocket.

Provided herein is a portable exercise apparatus 1400, as illustrated in FIGS. 1 and 8A-8D, comprising: an adjustable connector strap 1001 having a first end 1002 and a second end 1003 spaced lengthwise from each other; a coupling mechanism assembly 1006, as illustrated in FIG. 15, comprising a first coupling component 1007 at the first end of the adjustable connector strap and a second coupling component 1008 on the second adjustable connector strap for releasably securing the first end 1002 of the adjustable connector strap to another section of the adjustable connector strap at or near the second end 1003 of the adjustable connector strap; at least one closeable pocket 1010, affixed lengthwise along at least a first section of the adjustable connector strap, the pocket comprising; a first exterior end margin 1016 at a first end of the pocket and a second exterior end margin 1017 at a second end of the pocket; a first exterior lengthwise margin 1030 comprising a first edge 1032 and a second edge 1033, forming a first opening 1018 to the pocket; a second exterior lengthwise margin 1031 spaced apart from the first exterior lengthwise margin 1030 forming a closed bottom to the interior space of the pocket; a zipper 1004 along the first edge 1032 and the second edge 1033 of the pocket configured to releasably capture the first edge 1032 and the second edge 1033 to at least partially close the interior space 1013 of the closeable pocket 1010; a surface of the at least one closeable pocket being affixed lengthwise to the adjustable connector strap, such that the first end and the second end of the adjustable connector strap protrude past the first exterior end margin and the second exterior end margin, a first fixation ring 1051 affixed to the adjustable connector strap between the first coupling component and the first exterior end margin of the pocket; a second fixation ring 1052 affixed to the adjustable connector strap between the second coupling component and the second exterior end margin of the at least one pocket, and a third fixation ring 1053 affixed to the adjustable connector strap at or about the approximate lengthwise center or the approximate lengthwise center of the closeable pocket, approximately equidistant between the first fixation ring and the second fixation ring; and a first auxiliary storage sleeve 1040 having a first end 1041, a second end 1042 and a first cavity 1043 therebetween and affixed on or about the second exterior lengthwise margin 1031.

In some embodiments, the portable exercise apparatus further comprises a first non-elastic suspension sub-assembly 1481*a/b*, as illustrated in FIGS. 2-4B, 6A-6C and 7A.

In some embodiments, the portable exercise apparatus further comprises a first elastic suspension sub-assembly.

In some embodiments, the first non-elastic suspension sub-assembly 1481*a/b* comprises: a first non-elastic strap, band or line 1482*a/b*, having a first end 1483 and a second end 1484; the first end of the first non-elastic strap, band or line comprising a closed loop 1485, and the second end of the first non-elastic strap, band or line comprising a free end (having no attachments), a third non-elastic strap, band or line 1486*a/b*, having a first end 1487 and a second end 1488; and a first strap buckle 1490*a/b*, comprising a first securing bar, and first strap clasping mechanism; wherein the second end of the third non-elastic strap, band or line is folded over the first securing bar, back onto a portion of the third non-elastic strap, band or line and permanently secured thereto, capturing the first securing bar, and wherein the second free end of the first non-elastic strap, band or line, (having no attachments), is pulled through the first strap buckle such that the second end is adjustably secured by the first strap clasping mechanism.

In some embodiments, the first elastic suspension sub-assembly 1491*a* comprises: a first releasably attachable elastic band or elastic cord 1492*a*, having a first end and a second end, a specified length and a known tension property; wherein the first end comprises a first attachment feature 1071 and the second end comprises a second attachment feature 1071.

In some embodiments, the portable exercise apparatus and/or the first elastic suspension sub-assembly 1491*a* further comprises a plurality of additional releasably attachable elastic bands or elastic cords 1492*b/n*.

In some embodiments, each additional releasably attachable elastic band or elastic cord 1492*b/n* comprises a different known tension property from the first 1492*a* and any other additional releasably attachable elastic bands or elastic cords 1492*n* in the first sub-assembly 1491*a*.

In some embodiments, the additional releasably attachable elastic bands or elastic cords 1492*b/n* are each approximately the same length as the first releasably attachable elastic band or elastic cord 1492*a*.

In some embodiments, the portable exercise apparatus 1400 or the first elastic suspension sub-assembly 1491*a* further comprises a first auxiliary strap 1493*a* with a first end and a second end, having a first auxiliary shroud 1494*b* with a first edge, a second edge, a first end and a second end, the first auxiliary shroud further comprising: a shroud releasable attachment feature 1494 configurable to secure one edge or end of the auxiliary shroud to another edge or end of the auxiliary shroud, such that the first auxiliary shroud 1494*b* is wrapably securable around the plurality of releasably attachable elastic bands or elastic cords 1492*a/b/n*.

In some embodiments of the portable exercise apparatus, the first auxiliary strap 1493*a* further comprises an attachment feature 1071 at each first and second end.

In some embodiments, the portable exercise apparatus further comprises a first handgrip 1495 with a first flexible connector strap 1063/1064/1068 or 1069.

In some embodiments, the first handgrip 1495 is hollow.

In some embodiments, the first flexible connector strap 1063/1064/1068 or 1069 further comprises an attachment feature 1071 at the end of the flexible connector strap.

In some embodiments, the first handgrip 1495 with the first flexible strap 1063/1064/1068 or 1069 is permanently affixed to the adjustable connector strap 1001 between the first coupling component and the first exterior end margin of the pocket.

In some embodiments, the first handgrip 1495 with the first flexible strap is releasably affixable to at least one of the first, second and third fixation rings 1051, 1052, 1053 on the adjustable connector strap.

In some embodiments, the first handgrip 1495 with the first flexible strap is releasably affixable to at least one of any attachment feature (e.g.: 1071, 1072, 1485) of the first non-elastic suspension sub-assembly 1481*a*.

In some embodiments, the first handgrip with the first flexible strap is releasably affixable to at least one of any attachment feature (e.g.: 1071, 1072) of the first elastic suspension sub-assembly 1491*a*.

In some embodiments, the portable exercise apparatus further comprises a second attachment feature 1071 at any location along the length of the flexible connector strap (e.g.: 1063/1064/1068 or 1069).

In some embodiments, the first handgrip 1485 with the first flexible strap 1063/1064/1068 or 1069, further comprises a first auxiliary loop feature suspended from the handgrip 1496, forming an extended handgrip assembly 1497.

In some embodiments, the portable exercise apparatus further comprises at least one coupling attachment 1072 configurable for coupling at least one of: the first non-elastic suspension sub-assembly 1481*a/b*; the first elastic suspension sub-assembly 1491*a/b*, or the first handgrip 1485 or extended handgrip assembly 1487, to any attachment feature 1071, the first fixation ring 1051, the second fixation ring 1052 or the third fixation ring 1053 of the portable exercise apparatus 1400.

In some embodiments, the portable exercise apparatus further comprises a second closeable pocket (pouch) 1210*b* attached to and spaced along a second section of the adjustable connector strap 1201 comprising: at least a second medial exterior surface 1211*b* and a second lateral exterior surface 1212*b*, a second interior space 1213*b* within the second closeable pocket 1210*b* comprising at least a second medial interior surface 1214*b* and a second lateral interior surface 1215*b*, a second exterior end margin 1236 and a second interior end margin 1237; wherein the second exterior end margin 1236 and the second interior end margin 1237 are spaced apart lengthwise from each other at opposite ends of the second closeable pocket (pouch) 1210*b* along the second section of the adjustable connector strap 1201, a third exterior lengthwise margin 1230*b* adjoining the second exterior end margin 1236 and the second interior end margin 1237, the third exterior lengthwise margin comprising a third edge 1224 and a fourth edge 1225, forming a first opening 1218*b* to the second interior space 1213*b* within the second closeable pocket 1210*b*; and a fourth exterior lengthwise margin 1231*b* spaced apart from the third exterior lengthwise margin 1230*b*, forming a closed bottom to the second interior space 1213*b* of the second closeable pocket 1210*b*; wherein the third exterior lengthwise margin 1230*b* and fourth exterior lengthwise margin 1231*b* are positioned longitudinally along a second section of the adjustable connector strap 1201 between the second exterior end margin 1236 and second interior end margin 1237; at least a second pocket securing mechanism (zipper) 1204*b* configured to releasably capture the third edge 1224 and the fourth edge 1225 to at least partially close the first opening 1218*b* to the second interior space 1213*b* of the second closeable pocket 1210*b*; and a second 621044 having a third end 1045, a fourth end 1046 and a second cavity therebetween; the second auxiliary storage sleeve 1044 being spaced apart lengthwise from the first auxiliary storage sleeve 1040 and affixed on or about the second exterior lengthwise margin 1031.

Figure 23:
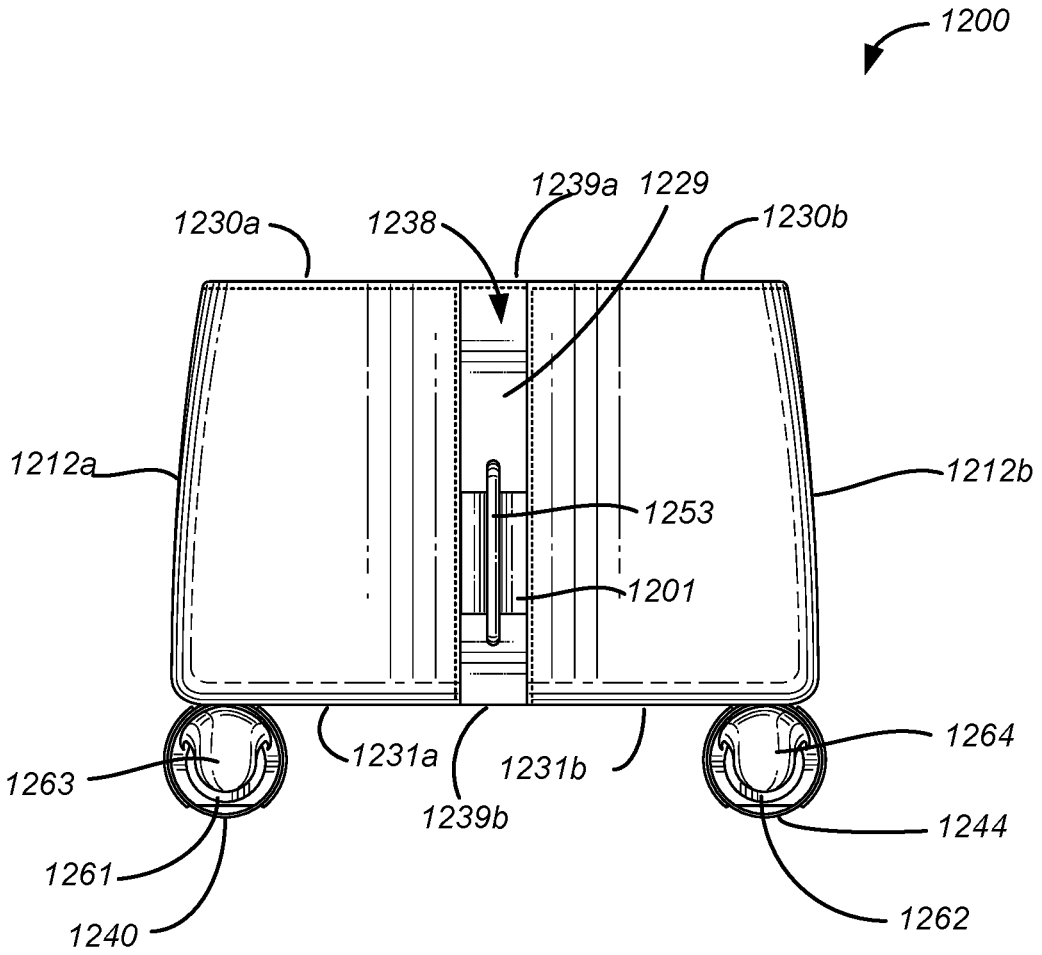
FIG. 23 is a rear elevation view of the exemplary portable exercise apparatus of FIG. 19 with two closeable pockets.

In some embodiments, the portable exercise apparatus further comprises a connecting section 1238, as illustrated in FIG. 23, comprising at least a medial surface 1228 and a lateral exterior surface 1229, a superior margin 1239*a* and an inferior margin 1239*b* spaced apart from each other and positioned between the first interior end margin 1235 of the first closeable pocket 1210*a* and the second interior end margin 1237 of the second closeable pocket 1210*b*; wherein the adjustable connector strap 1201 is affixed lengthwise to the first medial interior surface 1214*a* of the first closeable pocket (pouch) 1210*a*, optionally affixed to the lateral surface 1229 or the medial surface 1228 of the connecting section 1238 and the second medial interior surface 1215*b* of the second closeable pocket (pouch) 1210*b*, or wherein the adjustable connector strap 1201 is affixed lengthwise to the first medial exterior surface 1211*a* of the first closeable pocket (pouch) 1210*a*, the lateral surface 1229 or the medial surface 1228 of the connecting section 1238 and the second medial exterior surface 1211*b* of the second closeable pocket (pouch) 1210*b*, or, a combination thereof, such that the first end 1202 and the second end 1203 of the adjustable connector strap 1201 protrude past the first exterior end margin 1234 of the first pocket 1210*a* and the second exterior end margin 1236 of the second pocket 1210*b*.

In some embodiments, as illustrated in FIGS. 1-5C, the portable exercise apparatus 1400 further comprises a second non-elastic suspension sub-assembly 1481*b*, identical to the first non-elastic suspension sub-assembly.

In some embodiments, the portable exercise apparatus 1400 further comprises a second elastic suspension sub-assembly 1491*b*, identical to the first elastic suspension sub-assembly.

In some embodiments, the portable exercise apparatus 1400 or second elastic suspension sub-assembly 1491*b* further comprises a plurality of additional releasably attachable elastic bands or elastic cords 1492*b/n*, identical to the first elastic suspension sub-assembly 1491*a*.

In some embodiments, each additional releasably attachable elastic band or elastic cord 1492*b/n*, comprises the same known tension property as the corresponding additional releasably attachable elastic bands or elastic cords 1492*b/n*, in the first elastic suspension sub-assembly 1491*a*.

In some embodiments, the additional releasably attachable elastic bands or elastic cords 1492*b/n*, of the second elastic suspension sub-assembly 1491*b* are each approximately the same length as the first releasably attachable elastic bands or elastic cords in the first elastic suspension sub-assembly 1491*a*.

In some embodiments, the portable exercise apparatus 1400 further comprises a second auxiliary strap 1493*a* with a first end and a second end, having a second auxiliary shroud 1493*b* with a first edge, a second edge, a first end and a second end, the second auxiliary shroud 1493*b* further comprising: a shroud releasable attachment feature 1494 configurable to secure one edge or end of the auxiliary shroud to another edge or end of the auxiliary shroud such that the second auxiliary shroud 1493*b* is wrapably securable around the plurality of releasably attachable elastic bands or elastic cords 1492*a/b/n*.

In some embodiments, the portable exercise apparatus 1400 further comprises a second handgrip 1495 with a second flexible connector strap, or extended handgrip assembly 1497.

In some embodiments, the second handgrip 1495 is hollow.

In some embodiments, the second flexible connector strap 1062/1065/1068 or 1069 further comprises an attachment feature 1071 at the end of the flexible connector strap.

In some embodiments, the second handgrip with the second flexible strap 1062/1065/1068 or 1069 is permanently affixed to the adjustable connector strap 1001, 1201 between the second coupling component 1008 and the second exterior end margin 1017/1217 of the second pocket.

In some embodiments, the second handgrip with the second flexible strap is releasably affixable to at least one of the first 1051, second 1052 and third fixation rings 1052 of the adjustable connector strap 1001, 1201.

In some embodiments, the second handgrip 1495 with the second flexible strap or the extended handgrip assembly 1497 is releasably affixable to at least one of any attachment feature 1071 of the second non-elastic suspension sub-assembly 1481*b*.

In some embodiments, the second handgrip 1495 with the second flexible strap or the extended handgrip assembly 1497 is releasably affixable to at least one of any attachment feature 1071 of the second elastic suspension sub-assembly 1491*b*.

In some embodiments, the portable exercise apparatus 1400 further comprises a second attachment feature at any location along the length of the flexible connector strap 1062/1065/1068 or 1069 affixed to a handgrip 1495.

In some embodiments, the second handgrip 1495 with the second flexible strap 1062/1065/1068 or 1069, or the extended handgrip assembly 1497, further comprises a first auxiliary loop feature 1496 suspended from the handgrip.

In some embodiments, the portable exercise apparatus 1400 further comprises at least one coupling attachment 1071 configurable for coupling at least one of: the second non-elastic suspension sub-assembly 1481*b*; the second elastic suspension sub-assembly 1491*b*, or the second handgrip 1495; to any attachment feature 1071, the first fixation ring 1051, the second fixation ring 1052 or the third fixation ring 1053 of the portable exercise apparatus.

In some embodiments, the first handgrip 1061, 1495 is configurable for storage within the first auxiliary storage sleeve 1040.

In some embodiments, the second handgrip 1064, 1495 is configurable for storage within the second auxiliary storage sleeve 1044.

In some embodiments of the apparatus 1400, 1500, the first strap buckle 1490 comprises a cam style buckle.

In some embodiments of the apparatus 1400, 1500, the second strap buckle 1490 comprises a cam style buckle.

In some embodiments of the apparatus 1400, 1500, one out of each elastic band or elastic cord 1492*a/b/n* is configurable for attachment to an available closed loop 1495 of the first non-elastic sub-assembly 1481*a*.

In some embodiments of the apparatus 1400, 1500, one out of each elastic band or elastic cord 1492*a/b/n* is configurable for attachment to an available closed loop 1495 of the second non-elastic sub-assembly 1482*b*.

In some embodiments, the portable exercise apparatus further comprises additional accessory components comprising: a third handgrip with a third flexible strap; at least one additional suspension strap; a suspension harness; parachute cord; a running parachute; at least one accessory attachment connection device; at least one glove; two or more carabiners; and at least one doorframe attachment device; the doorframe attachment device comprising a flexible connector strap and a thickened section of the flexible strap configured for placement between a doorframe and a closed door.

In some embodiments, the at least one suspension line further comprises a friction hitch or knot attachment for length adjustment.

In some embodiments, the friction hitch or knot attachment comprises a prusik knot.

In any one of the embodiments of the apparatus, the coupling mechanism for releasably securing the ends of the connector strap of the apparatus comprises: a belt buckle; a cam buckle; a Velcro attachment; a Velcro hook and loop; airline seat buckle; a side release buckle; a double loop and strap of material; and a snap hook and ring.

In some embodiments, the belt buckle or coupling mechanism for the adjustable connector strap 1006, 1206 further comprises a frame-style buckle; a plate-style buckle; a box-out buckle or a box-frame buckle.

In some embodiments of the apparatus, the coupling mechanism is length-adjustable.

In any one of embodiments of the apparatus, the quick-release attachment coupling comprises a carabiner 1072; a snap hook; a bolt snap; a spring snap; a spring clip; a harness clip; a releasable captured hook and variations thereof.

In any one of embodiments of the apparatus, the quick-release attachment coupling is adapted to couple to any of the fixation rings 1071, 1051, 1052, 1053 on the layered strap-like apparatus or belt-like strap, or an accessory device.

In any one of embodiments of the apparatus, the quick-release attachment coupling is adapted to couple to any stationary structure comprising a feature that can act as an anchoring point or a fixation ring.

In any one of embodiments of the apparatus, the quick-release attachment coupling is adapted to couple to any other attachment feature, coupling mechanism, fixation ring, coupling strap, handgrip or handgrip to facilitate wrapping the layered strap-like apparatus or strap-like belt around a stationary structure that can act as an anchoring point or a fixation ring.

In any one of embodiments of the apparatus, the fixation ring comprises: a circular ring; a reinforced material ring; a D-ring; a carabiner 1072; a spring clip; a harness clip; a snap hook; and a releasable captured hook.

In any one of embodiments of the apparatus, the quick-release attachment couplings and fixation rings comprise materials of sufficient strength to support a human and provide a factor of safety, such as alloy aluminum, steels and other metals known to those skilled in the art for safety equipment, sky diving and mountain climbing, or any of the materials described below.

In any one of embodiments of the apparatus, the strap-like apparatus is adapted to be worn about the waist of the user's body. In any one of embodiments of the apparatus, the strap-like apparatus is adapted to be worn as a bandolier about the user's body. In any one of embodiments of the apparatus, the strap-like apparatus is adapted to be carried in a gym bag, backpack, or similar equipment-carrying apparatus.

In some embodiments of the apparatus, the at least one releasably attachable elastic band comprises an elastic tension ranging from about: 1.0-5.0 lbs.; 2.0-10.0 lbs.; 5.0-15.0 lbs.; 10.0-20.0 lbs.; 15.0-30.0 lbs.; 20.0-40.0 lbs.; 25.0-50.0 lbs.; 30.0-60.0 lbs.; 35.0-70.0 lbs.; 40.0-80.0 lbs.; 45.0-90.0 lbs.; 50.0-100.0 lbs.; 60.0-120.0 lbs.; 75.0-150.0 lbs.; 100.0-200.0 lbs.; 150.0-250.0 lbs.; 200.0-400.0 lbs.; and from about 1.0-400 lbs.

In some embodiments of the apparatus, the at least one releasably attachable elastic band ranges in length from about: 0.5-2.0 feet, 1.0-2.0 feet, 1.5-2.0 feet; 1.5-3.0 feet; 1.5-4.0 feet; 1.5-5.0 feet; 1.5-6.0 feet; 1.5-7.0 feet; 1.5-8.0 feet; 1.5-9.0 feet; and from about 0.5-10.0 feet.

In some embodiments, the apparatus comprises at least one releasably attachable non-elastic suspension band and/or at least one releasably attachable elastic band.

In some embodiments of the apparatus, the at least one releasably attachable non-elastic suspension band or releasably attachable elastic band comprises a protective sleeve to prevent or at least reduce wear, abrasion, tearing and scoring of the non-elastic suspension or elastic bands during use. In some embodiments, the sleeve prevents overstretching of the non-elastic suspension or elastic bands during use. In some embodiments, the protective sleeve has an elastic quality to allow it to stretch with the underlying band. In some embodiments, the elastic protective sleeve prevents overstretching of the non-elastic suspension or elastic bands during use.

In some embodiments of the apparatus, the elastic band comprises a non-elastic suspension inner band to prevent or at least reduce overstretching and possible failure of the elastic bands during use.

In some embodiments of the apparatus, an accessory article comprises an elastic band, a non-elastic suspension band, at least one detachable flexible or solid handgrip with flexible straps, a running parachute, a suspension cord, a suspension harness, a parachute cord, an additional coupling device, an additional quick-release attachment coupling mechanism, a flexible water canteen, and a glove.

In some embodiments of the apparatus, a quick-release attachment coupling mechanism comprises a circular ring; a D-ring; a carabiner; a spring clip; a harness clip; a snap hook; or a releasable captured hook.

In some embodiments of the apparatus, the strap-like apparatus comprises wear-resistant material comprising: nylon; moleskin; polyester; polypropylene; aramid polymer fabric; Kevlar®; technical fabric; SuperFabric®; Cordura®, Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix© Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) or leather.

Provided herein is a suspension training system 1500 comprising: a first non-elastic suspension sub-assembly 1481*a*, a second non-elastic suspension sub-assembly 1481*b*, a first elastic suspension sub-assembly 1491*a*, a second elastic suspension sub-assembly 1491*b*, a first and a second handgrip 1495, or a first and second extended handgrip assembly 1497. The first non-elastic suspension sub-assembly 1481*a*, configurable for suspension from a first overhead structure, a first wall mount, or between a door and doorframe; the first elastic suspension sub-assembly 1491*a*, configurable for releasable attachment to the first non-elastic suspension sub-assembly 1481*a*, the first handgrip 1495 or first extended handgrip assembly 1497, configurable for releasable attachment to either the first non-elastic suspension sub-assembly 1481*a* or the first elastic suspension sub-assembly 1491*a*; the second non-elastic suspension sub-assembly 1481*b*, configurable for suspension from the first overhead structure or a second overhead structure, the first wall mount, a second wall mount, or between the door and doorframe; the second elastic suspension sub-assembly 1491*b* configurable for releasable attachment to the second non-elastic suspension sub-assembly 1481*b*, and the second handgrip 1495 or second extended handgrip assembly 1497, configurable for releasable attachment to either the second non-elastic suspension sub-assembly 1481*b* or the second elastic suspension sub-assembly 1491*b*.

In some embodiments, the first non-elastic suspension sub-assembly 1491*a* comprises: a first non-elastic strap, band or line 1482*a* having a first end 1483 and a second end 1484; the first end of the first non-elastic strap, band or line comprising a closed loop 1485, and the second end of the first non-elastic strap, band or line comprising a free end having no attachments, a third non-elastic strap, band or line 1486*a* having a first end 1487 and a second end 1488; and a first strap buckle 1490 comprising a first securing bar, and first strap clasping mechanism; wherein the second end 1488 of the third non-elastic strap, band or line 1486 is folded over the first securing bar, back onto a portion of the third non-elastic strap, band or line 1486 and permanently secured thereto, capturing the first securing bar, wherein the second free end 1484 of the first non-elastic strap, band or line, (having no attachments), is pulled through the first strap buckle 1490 such that the second end 1484 is adjustably secured by the first strap clasping mechanism 1490; and wherein the second non-elastic suspension sub-assembly comprises 1481*b*: a second non-elastic strap, band or line 1482*b* having a first end 1482 and a second end 1484; the first end 1483 of the second non-elastic strap, band or line 1486*b* comprising a closed loop 1485, and the second end 1488 of the second non-elastic strap, band or line 1486*b* comprising a free end, a fourth non-elastic strap, band or line having a first end and a second end; and a second strap buckle 1490*b* comprising a second securing bar, and second strap clasping mechanism; wherein the second end 1488 of the fourth non-elastic strap, band or line 1486*b* is folded over the second securing bar, back onto a portion of the fourth non-elastic strap 1488, band or line and permanently secured thereto, capturing the second securing bar, wherein the second free end 1488 of the second non-elastic strap, band or line 1482*b*, (having no attachments), is pulled through the second strap buckle 1490*b* such that the second end is adjustably secured by the second strap clasping mechanism.

In some embodiments, the first elastic suspension sub-assembly 1491*b* comprises: a first plurality of releasably attachable elastic bands or elastic cords 1492*a/b/n*, each having; a first end and a second end, an approximately similar specified length, and a different known tension property from the remaining plurality of releasably attachable elastic bands or elastic cords in the first elastic suspension sub-assembly 1492*a*; wherein the first end of each releasably attachable elastic band or elastic cord 1492*a/b/n* comprises a first attachment feature 1071 and the second end comprises a second attachment feature 1071; and wherein the second elastic suspension sub-assembly 1491*b* comprises: a second plurality of releasably attachable elastic bands or elastic cords 1492*a/b/n*, each having; a first end and a second end, an approximately similar specified length, and a different known tension property from the remaining plurality of releasably attachable elastic bands or elastic cords 1492*a/b/n* in the second elastic suspension sub-assembly 1491*b*, but having a matching tension to a corresponding releasably attachable elastic band or elastic cord in the first elastic suspension sub-assembly 1491*a*; wherein the first end of each releasably attachable elastic band or elastic cord comprises a first attachment feature 1071 and the second end comprises a second attachment feature 1071.

In some embodiments, each elastic suspension sub-assembly 1491*a/b* of the suspension training system 1500 comprises an identical auxiliary strap 1493*a* with a first end and a second end, having an auxiliary shroud 1493*b* with a first edge, a second edge, a first end and a second end, the auxiliary shroud 1493*b* further comprising a shroud releasable attachment feature 1494*b*, such as a hook and loop attachment configuration, configurable to secure one edge or end of the auxiliary shroud to another edge or end of the auxiliary shroud such that the auxiliary shroud 1493*b* is wrapably securable around the plurality of releasably attachable elastic bands or elastic cords 1492*a/b/n*.

In some embodiments, the auxiliary strap 1493*a* further comprises an attachment feature 1071 at each first and second end of the auxiliary strap.

In some embodiments of the suspension training system 1500, the first handgrip 1495 and the second handgrip each further comprises a flexible connector strap 1063/1064/1068 or 1069.

In some embodiments, the first handgrip and the second handgrip each further comprises an auxiliary loop feature 1496 suspended from the handgrip. In some embodiments, a first and second extended handgrip assembly 1497 comprises the handgrip, the auxiliary loop feature 1496 and an extended flexible connector strap 1063/1064/1068 or 1069.

In some embodiments of the suspension training system 1500, the first elastic suspension sub-assembly 1491*a* and the second elastic suspension sub-assembly 1491*b* are separable from the first non-elastic suspension sub-assembly 1481*a* and the second non-elastic suspension sub-assembly 1481*b*.

In some embodiments of the suspension training system 1500, the first handgrip 1485 and the second handgrip 1485 are releasably attachable to the first non-elastic suspension sub-assembly 1481*a* and the second non-elastic suspension sub-assembly 1481*b*.

In some embodiments of the suspension training system 1500, the first elastic suspension sub-assembly 1491*a* and the second elastic suspension sub-assembly 1491*b* are separable from the first non-elastic suspension sub-assembly 1481*a* and the second non-elastic suspension sub-assembly 1481*b*.

In some embodiments of the suspension training system 1500, the first and second extended handgrip assembly 1497 are releasably attachable to the first non-elastic suspension sub-assembly 1481*a* and the second non-elastic suspension sub-assembly 1481*b*.

In some embodiments of the suspension training system 1500, the first and second extended handgrip assembly 1497 are releasably attachable to the first elastic suspension sub-assembly 1491*a* and the second elastic suspension sub-assembly 1491*b*.

Figure 10:
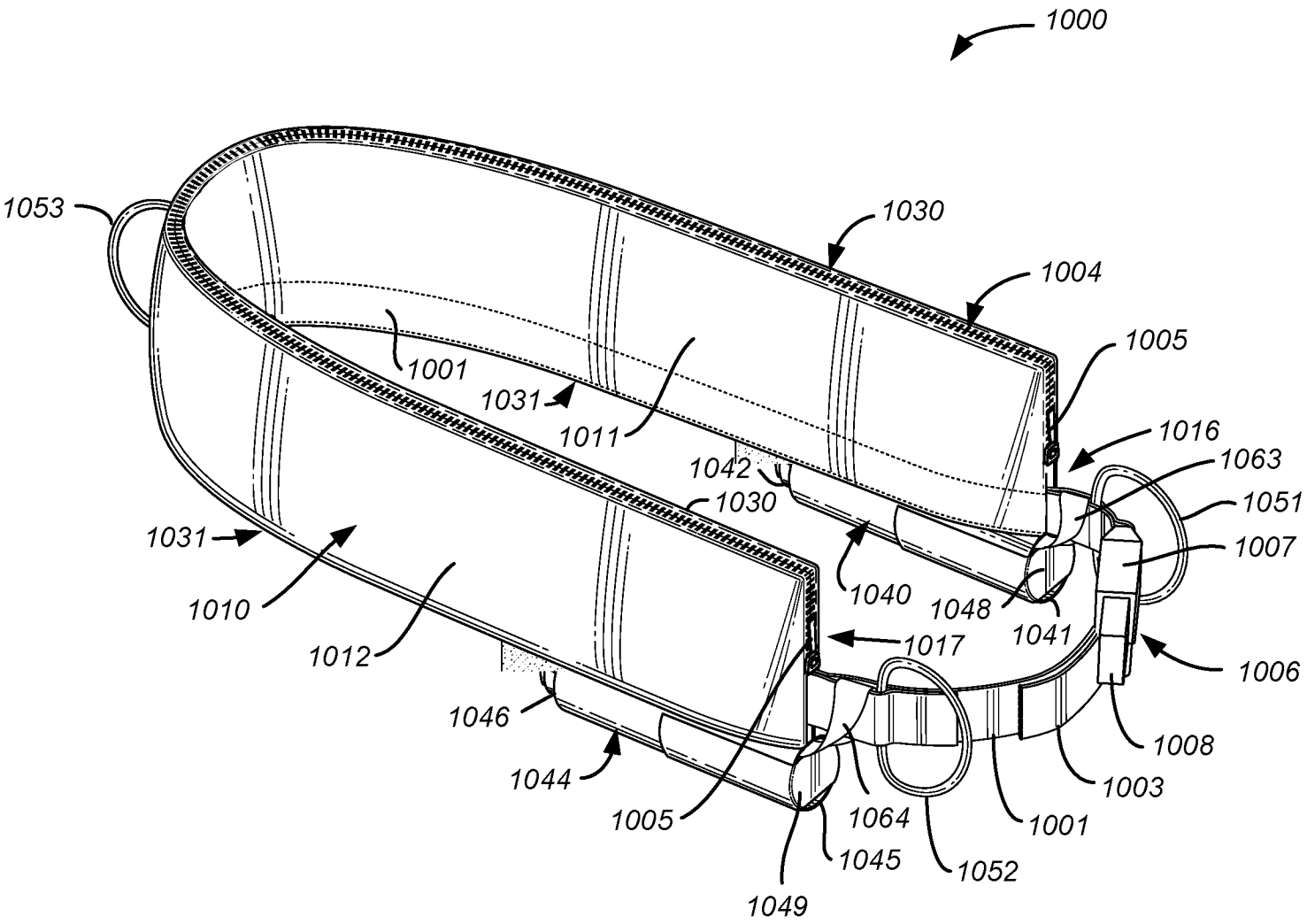
FIG. 10 is a perspective view of another exemplary portable exercise apparatus having a single closeable continuous pocket affixed to an adjustable connector strap with a coupling mechanism assembly and auxiliary storage sleeves configured along the inferior edge of the single closeable continuous pocket.
Figure 11:
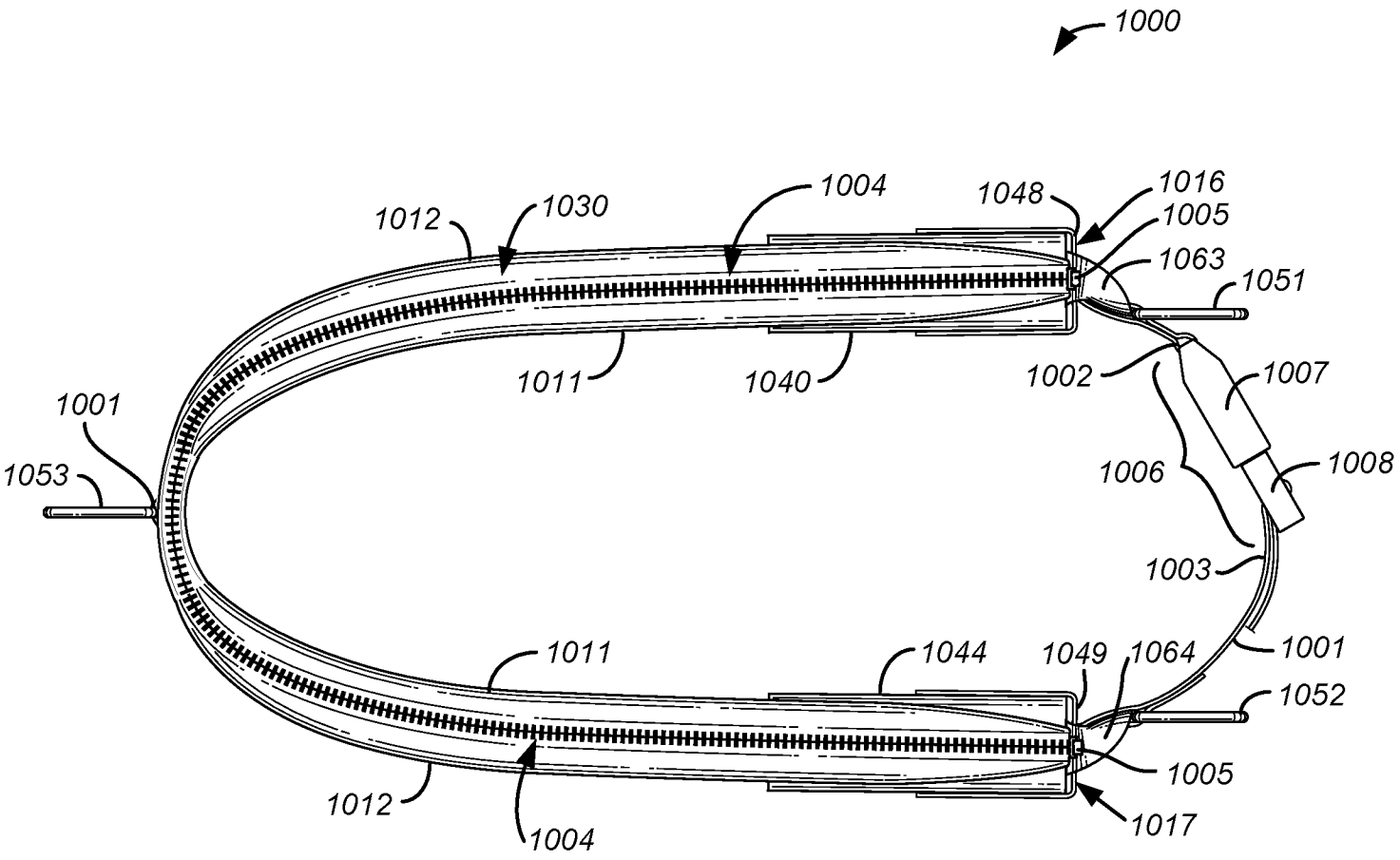
FIG. 11 is a top plan view of the exemplary portable exercise apparatus of FIG. 10 with a single closeable continuous pocket.
Figure 17:
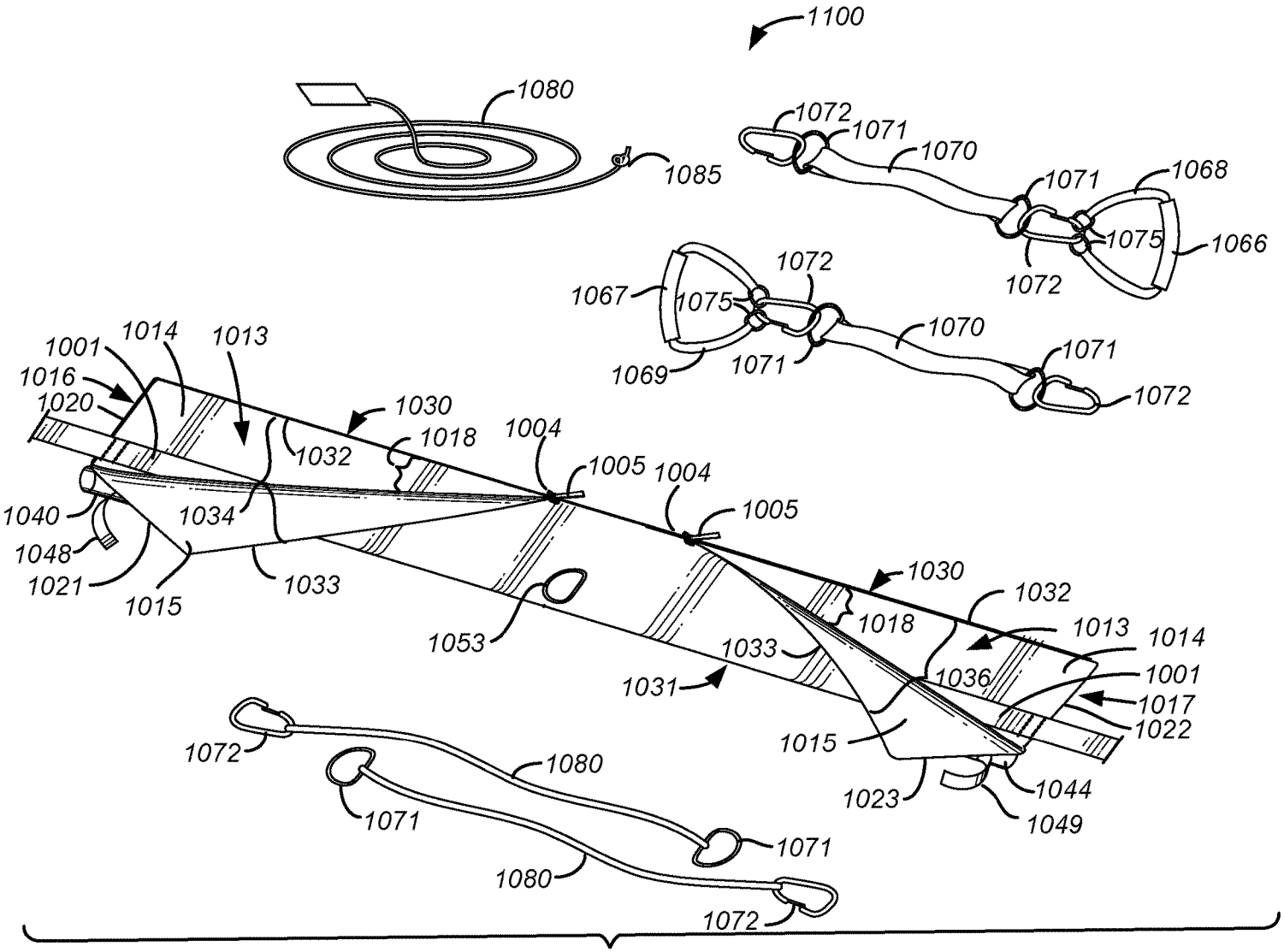
FIG. 17 is another perspective view of the exemplary portable exercise apparatus of FIG. 10 in a fully extended state illustrating the single open, closeable pocket for holding accessories, with the two securing mechanisms in an open pocket state and the attachment strap affixed therein and a plurality of accessories comprising tension bands, suspension lines, and additional releasable handgrips.

Provided herein is a portable exercise apparatus 1000, as illustrated in FIGS. 10, 11 and 17 comprising: an adjustable connector strap 1001 having a first end 1002 and a second end 1003 spaced lengthwise from each other; a coupling mechanism assembly 1006, as illustrated in FIG. 15, comprising a first coupling component 1007 and a second coupling component 1008 for releasably securing the first end 1002 of the adjustable connector strap to another section of the adjustable connector strap at or near the second end 1003 of the adjustable connector strap; a closeable pocket 1010, affixed lengthwise to the adjustable connector strap comprising; at least a first medial exterior surface 1011 and a first lateral exterior surface 1012, an interior space 1013 within the closeable pocket comprising at least a first medial interior surface 1014 and a first lateral interior surface 1015, a first exterior end margin 1016, and a second exterior end margin 1017; wherein the first end margin and the second end margin are closed and spaced apart from each other at opposite ends of the pocket 1010 along the adjustable connector strap; a first exterior lengthwise margin 1030 comprising a first edge 1032 and a second edge 1033, forming a first opening 1018 to the interior space; and a second exterior lengthwise margin 1031 spaced apart from the first exterior lengthwise margin 1030 forming a closed bottom to the interior space of the pocket; wherein the first lengthwise margin 1030 and second lengthwise margin 1031 are positioned longitudinally along the adjustable connector strap between the first exterior end margin 1016 and second exterior end margin 1017; at least one securing mechanism 1004 configured to releasably capture the first edge 1032 and the second edge 1033 to at least partially close the first opening 1018 to the interior space 1013 of the closeable pocket 1010; wherein the adjustable connector strap 1001 is affixed lengthwise to the medial interior surface 1014 of the closeable pocket, or to the medial exterior surface 1011 of the closeable pocket such that the first end 1002 and the second end 1003 of the adjustable connector strap 1001 protrude past the first exterior end margin 1016 and the second exterior end margin 1017 of the pocket 1010.

In some embodiments of the portable exercise apparatus, the first exterior end margin 1016 comprises a third edge 1020 and a fourth edge 1021, forming a second opening 1034 to the interior space 1013 of the pocket 1010, wherein the at least one securing mechanism 1004 is configured to releasably capture the third edge 1020, the fourth edge 1021, first edge 1032 and the second edge 1033 to at least partially close the first opening 1018 and the second opening 1034 to the interior space 1013 of the closeable pocket 1010.

In some embodiments of the portable exercise apparatus 1000, the second exterior end margin 1017 comprises a fifth edge 1022 and a sixth edge 1023, forming a third opening 1036 to the interior space 1013, wherein the at least one securing mechanism 1004 is configured to releasably capture the third edge 1020, the fourth edge 1021, first edge 1032, the second edge 1033, the fifth edge 1022 and the sixth edge 1023, to at least partially close the second opening 1034, the first opening 1018, and the third opening 1036 to the interior space 1013 of the closeable pocket 1010.

In some embodiments, the first pocket opening 1018 only adjoins the second pocket opening 1034 to create two adjoining openings. In some embodiments, the first pocket opening 1018 adjoins only the third pocket opening 1036 to create two different adjoining openings. In some embodiments, the first pocket opening 1018 adjoins the second pocket opening 1034 and the third pocket opening 1036 to create a contiguous opening.

In some embodiments, the first opening 1018, the second opening 1034 and the third opening 1036 of the closeable pocket 1010 each individually comprise a separate securing mechanism 1004, such that there is one closure mechanism when there is one pocket opening, two closure mechanisms when there are two pocket openings or three closure mechanisms when there are three pocket openings. Further still, in some embodiments, the closeable pocket can comprise only two closure mechanisms when there are three pocket openings, wherein one closure mechanism can secure two adjoining pocket openings, and a second closure mechanism secures the third pocket opening. Still further, in some embodiments, there can be multiple closure mechanisms to secure each pocket opening of the closeable pocket.

In some embodiments, the portable exercise apparatus 1000 comprises: an adjustable connector strap 1001 comprising a first end 1002 and a second end 1003 spaced lengthwise from each other; a coupling mechanism assembly 1006 comprising a first coupling component 1007 at the first end of the adjustable connector strap and a second coupling component 1008 at or near the second end adjustable connector strap for releasably securing the first end 1002 of the adjustable connector strap to a section of the adjustable connector strap at or near the second end 1003 of the adjustable connector strap; a closeable pocket 1010 affixed lengthwise to the adjustable connector strap comprising at least a first medial exterior surface 1011 and a first lateral exterior surface 1012, an interior space 1013 within the closeable pocket comprising, a first medial interior surface 1014 and a first lateral interior surface 1015; a first exterior end margin 1016 and a second exterior end margin 1017; a first exterior lengthwise margin 1030 comprising a first edge 1032 and a second edge 1033, forming a first opening 1018 to the interior space; and a second exterior lengthwise margin 1031 spaced apart from the first exterior lengthwise margin, forming a closed bottom to the interior space of the pocket; the first exterior end margin 1016 comprising a third edge 1020 and a fourth edge 1021, forming a second opening 1034 to the interior space, the second exterior 1017 end margin comprising a fifth edge 1022 and a sixth edge 1023, forming a third opening 1036 to the interior space, wherein the first end margin 1016 and the second end margin 1017 are spaced apart from each other at opposite ends of the pocket 1010, wherein the first exterior lengthwise margin 1030 and the second exterior lengthwise margin 1031 adjoin the first end margin 1016 and the second end margin 1017, and wherein the first and the second lengthwise margin are positioned longitudinally between the first end margin and second end margin along the length of the adjustable connector strap 1001; at least one securing mechanism 1004 configured to releasably capture the third edge 1020, the fourth edge 1021, the first edge 1032, the second edge 1033, the fifth edge 1022 and the sixth edge 1023, to at least partially close the second pocket opening 1034, the first pocket opening 1018, and the third pocket opening 1036 to the interior space 1013 of the closeable pocket (pouch) 1010; and wherein the adjustable connector strap 1001 is affixed lengthwise to the medial interior surface 1014 of the closeable pocket (pouch), such that the first end 1002 and the second end 1003 of the adjustable connector strap 1001 protrude past the first exterior end margin 1016 and the second exterior end margin 1017 of the pocket 1010.

In some embodiments, the medial layer (interior and exterior surfaces) and lateral layer (interior and exterior surfaces) of the pocket 1010 are formed from a single piece of folded material. In some embodiments, the medial layer and lateral layer are formed from two or more pieces of material and joined along at least one the margins, typically the bottom (inferior) margin of the pocket 1010.

In some embodiments of the portable exercise apparatus, the closeable pocket 1010 is at least partially closable along the first exterior lengthwise margin 1030.

In some embodiments of the portable exercise apparatus, the closeable pocket 1010 is at least partially closable at the first end margin 1016.

In some embodiments of the portable exercise apparatus, the closeable pocket 1010 is at least partially closable at the second end margin 1017.

In some embodiments of the portable exercise apparatus, the closeable pocket 1010 is at least partially closable along the first exterior lengthwise margin 1030 and either one of, or both of, the first end margin 1016 or the second end margin 1017.

One of skill in the art would recognize that more than one type of securing mechanism could be utilized to secure any one of or all the pocket openings. For example, a zipper could be utilized to close one pocket opening; whereas a button or compression snap or magnet(s) could be utilized, (as non-limiting examples), to close other pocket openings. In some embodiments of the portable exercise apparatus, any one of or all the pocket openings comprise multiple securing mechanisms.

In some embodiments, the portable exercise apparatus 1000 further comprises a first auxiliary storage sleeve 1040 having a first end 1041, a second end 1042 and a first cavity 1043 therebetween, affixed to the apparatus on or about the second exterior lengthwise margin 1031, at or near the first exterior end margin 1016.

In some embodiments, the portable exercise apparatus 1000 further comprises a second auxiliary storage sleeve 1044 having a third end 1045, a fourth end 1046 and a second cavity 1047 therebetween, affixed to the apparatus on or about the second exterior lengthwise margin 1031, at or near the second exterior end margin 1017. In some embodiments, the first auxiliary storage sleeve 1040 and second auxiliary storage sleeve 1044 are spaced apart lengthwise from each other and affixed on or about the second exterior lengthwise margin 1031.

Figure 12:
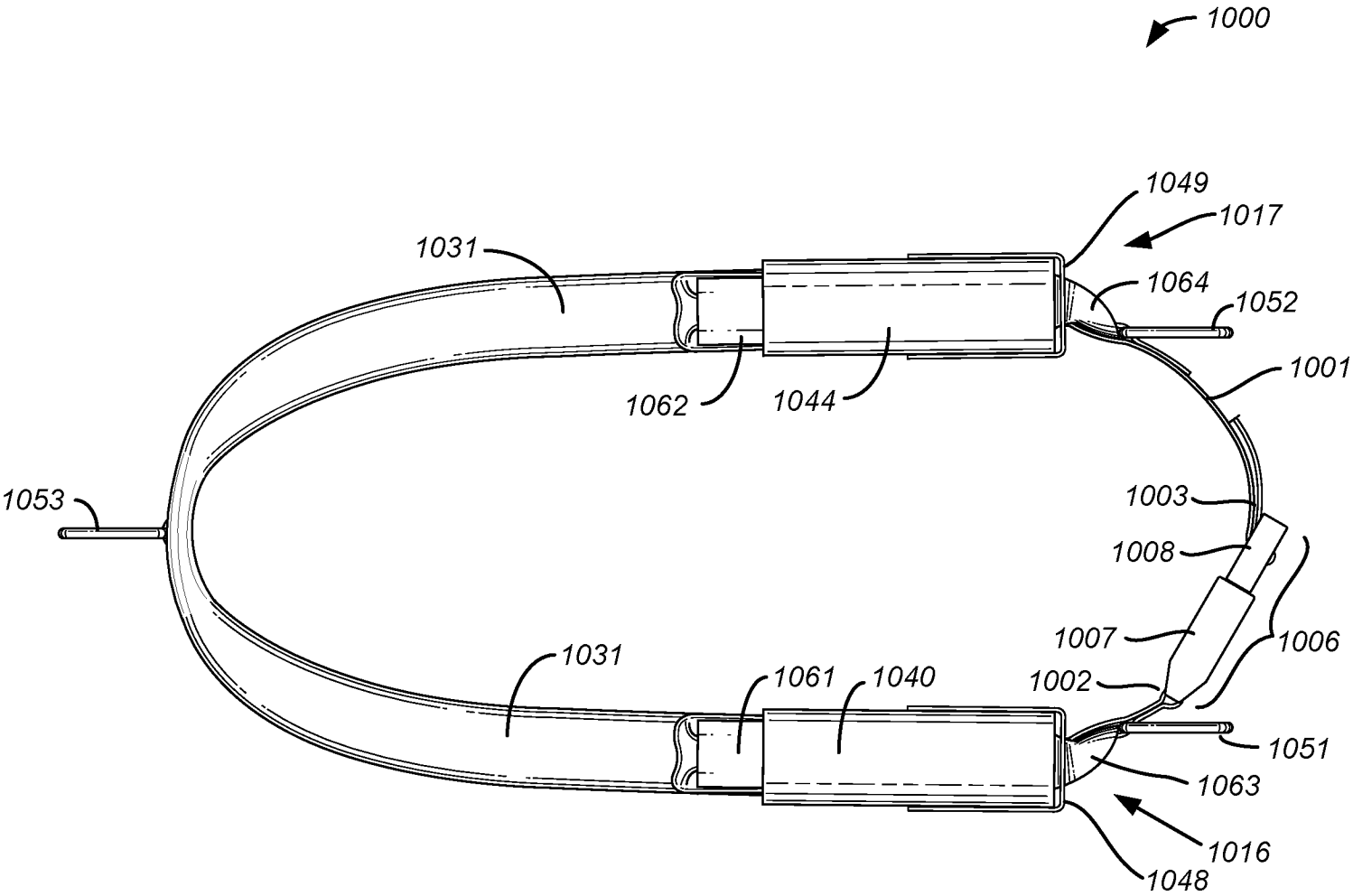
FIG. 12 is a bottom plan view of the exemplary portable exercise apparatus of FIG. 10 with a single closeable continuous pocket.

In some embodiments, as illustrated in FIGS. 10, 11 and 12, the portable exercise apparatus further comprises a first fixation ring 1051; and a second fixation ring 1052; wherein the first fixation ring 1051 is permanently affixed to the adjustable connector strap 1001 between the first coupling component 1007 at or near the first end 1002 of the adjustable connector strap 1001 and the first exterior end margin 1016 of the pocket 1010 and wherein the second fixation ring 1052 is permanently affixed to the adjustable connector strap 1001 between the second coupling component 1008 at or near the second end 1002 of the adjustable connector strap 1001 and the second exterior end margin 1017 of the pocket 1010.

In some embodiments, the portable exercise apparatus 1000 further comprises a first fixation ring 1051; and a second fixation ring 1052; wherein the first fixation ring is a releasably affixable carabiner 1072 affixable to the adjustable connector strap 1001 between the first coupling component 1007 at the first end 1002 of the adjustable connector strap and the first exterior end margin 1016 of the pocket 1010, and wherein the second fixation ring 1052 is a releasably affixable carabiner 1072 affixable to the adjustable connector strap 1001 between the second coupling component 1008 at the second end 1003 of the adjustable connector strap 1001 and the second exterior end margin 1017 of the pocket 1010. In some embodiments, the adjustable connector strap 1001 is configurable with a special (e.g.: fabric or metal) loop, button-like hole or opening on the adjustable connector strap to provide an attachment point for the releasably affixable carabiner 1072.

Alternatively, as described earlier in FIG. 6B or 6C, an additional fixation ring is configurable inside any of the pockets, typically near an end margin with an opening, to provide an attachment point for the releasably affixable carabiner 1072.

Figure 13:
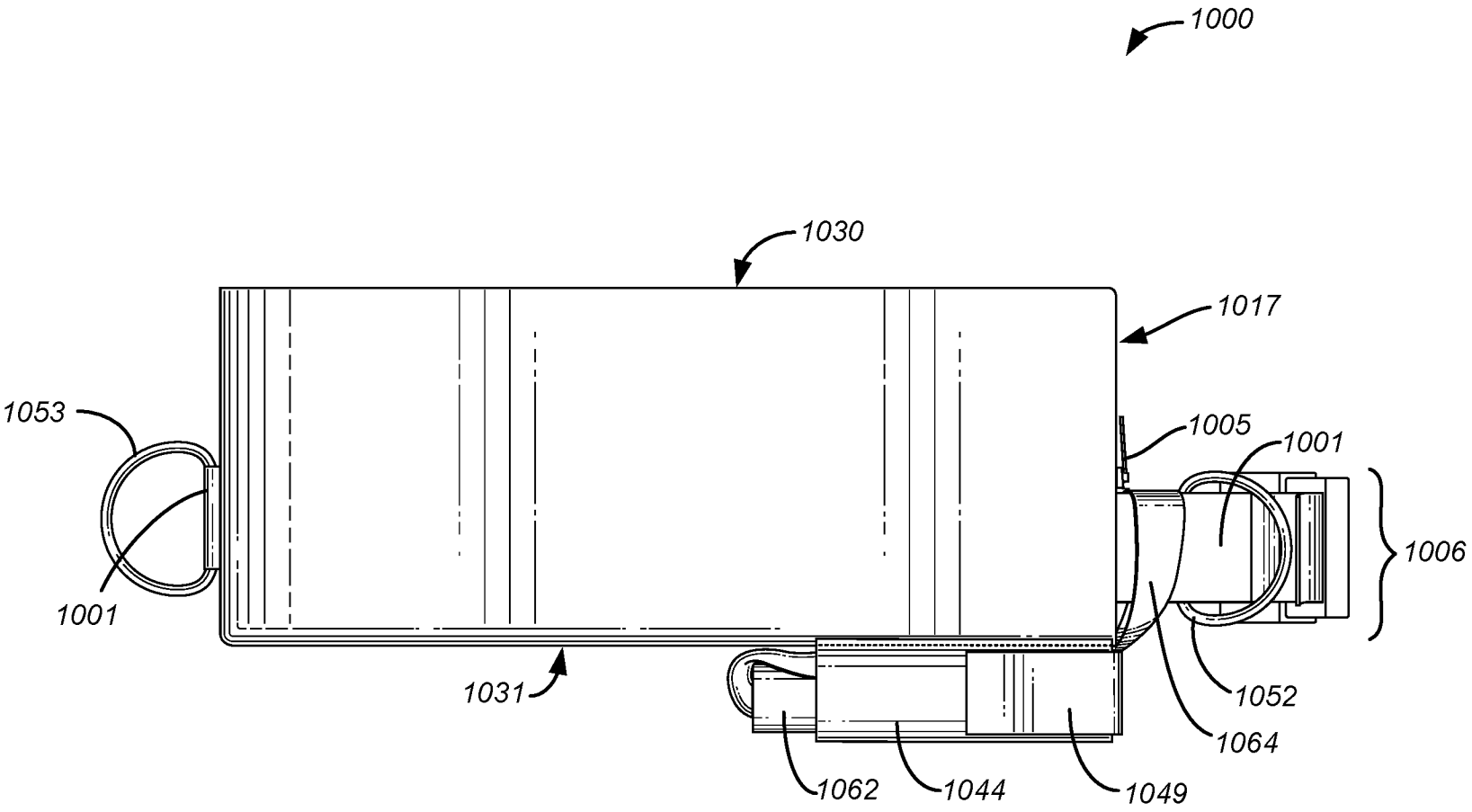
FIG. 13 is a right-side elevation view of the exemplary portable exercise apparatus of FIG. 10 with a single closeable continuous pocket.
Figure 14:
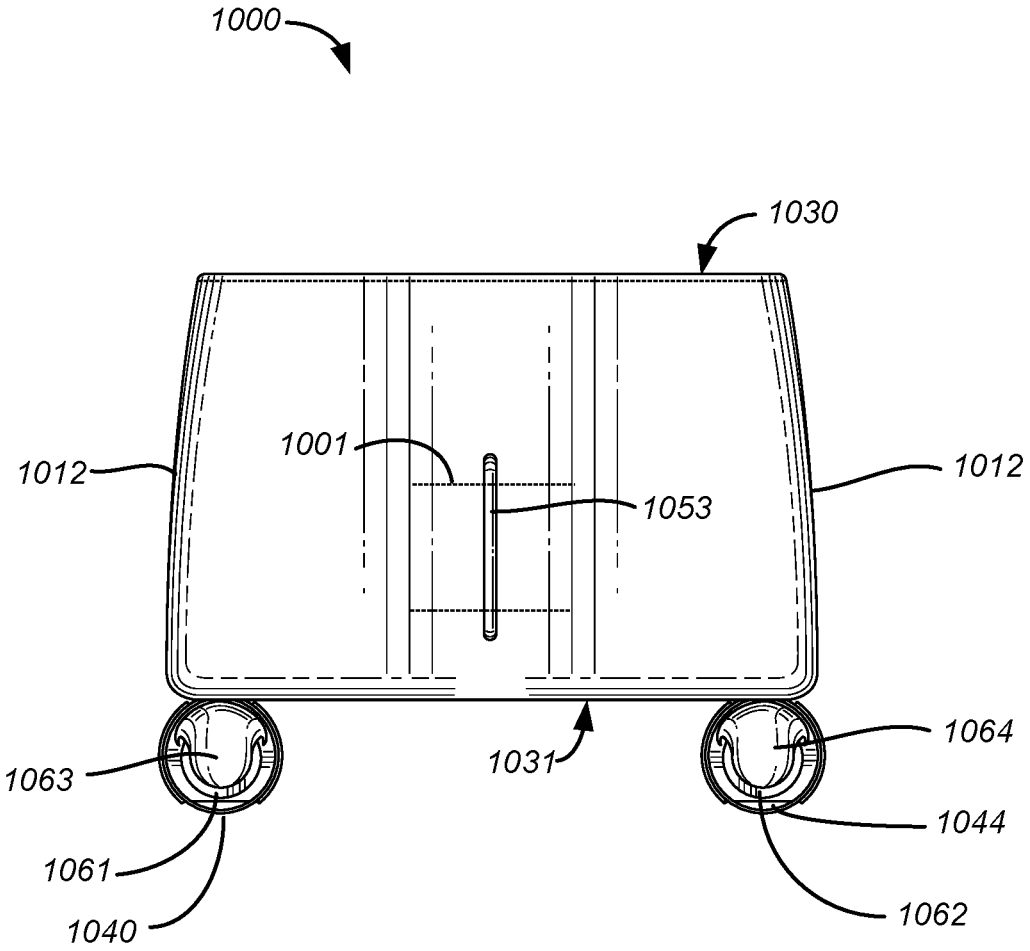
FIG. 14 is a rear elevation view of the exemplary portable exercise apparatus of FIG. 10 with a single closeable continuous pocket.

In some embodiments, as illustrated in FIGS. 12, 13 and 14, the portable exercise apparatus 1000 further comprises a third fixation ring 1053; wherein the third fixation ring 1053 is permanently affixed to the portable exercise apparatus at or about the approximate lengthwise center of the closeable pocket 1010, approximately equidistant between the first fixation ring 1051 and the second fixation ring 1052.

In some embodiments, the third fixation ring 1053, is a releasably affixable carabiner 1072 affixable to the adjustable connector strap 1001 at or about the approximate lengthwise center of the closeable pocket. In some embodiments, the adjustable connector strap is configurable with a special (e.g.: fabric or metal) loop, button-like hole or opening on the adjustable connector strap that protrudes through, around or outside the pocket to provide an attachment point for the releasably affixable carabiner 1072. Alternatively, as described earlier in FIG. 6D, an additional fixation ring is configurable such that it protrudes through an opening at or about the approximate lengthwise center of the closeable pocket to provide an attachment point for the releasably affixable carabiner 1072.

In any one of the embodiments, a fixation ring 1051, 1052, 1053 or a releasably affixable carabiner 1072 can have virtually any shape (e.g.: round, square, rectangular, oval, pear-shaped, D-ring, offset D-ring, Pearl/HMS, etc.).

In some embodiments, the portable exercise apparatus comprises a first handgrip 1061 with a first flexible connector strap 1063.

In some embodiments, the portable exercise apparatus further comprises a second handgrip 1062 with a second flexible connector strap 1064.

In some embodiments of the portable exercise apparatus, the first handgrip 1061 is permanently affixed to the adjustable connector strap 1001 with the first flexible connector strap 1063 between the first coupling component 1007 at or near the first end 1002 of the adjustable connector strap 1001 and the first exterior end margin 1016 of the pocket 1010.

In some embodiments of the portable exercise apparatus, the second handgrip 1062 is permanently affixed to the adjustable connector strap 1001 with the second flexible connector strap 1064 between the second coupling component 1008 at or near the second end 1003 of the adjustable connector strap 1001 and the second exterior end margin 1017 of the pocket 1010.

In still other embodiments of the portable exercise apparatus 1000, the first handgrip 1061 with the first flexible connector strap 1063 is releasably affixable with a carabiner to the first fixation ring 1051 that is affixed to the adjustable connector strap 1001 between the first coupling component 1007 at or near the first end 1002 of the adjustable connector strap and the first exterior end margin 1016 of the pocket 1010.

In still other embodiments of the portable exercise apparatus, the second handgrip 1062 with the second flexible connector strap 1064 is releasably affixable with a carabiner to the second fixation ring 1052 that is affixed to the adjustable connector strap 1001 between the second coupling component 1008 at or near the second end 1003 of the adjustable connector strap and the second exterior end margin 1017 of the pocket 1010.

Figure 18:
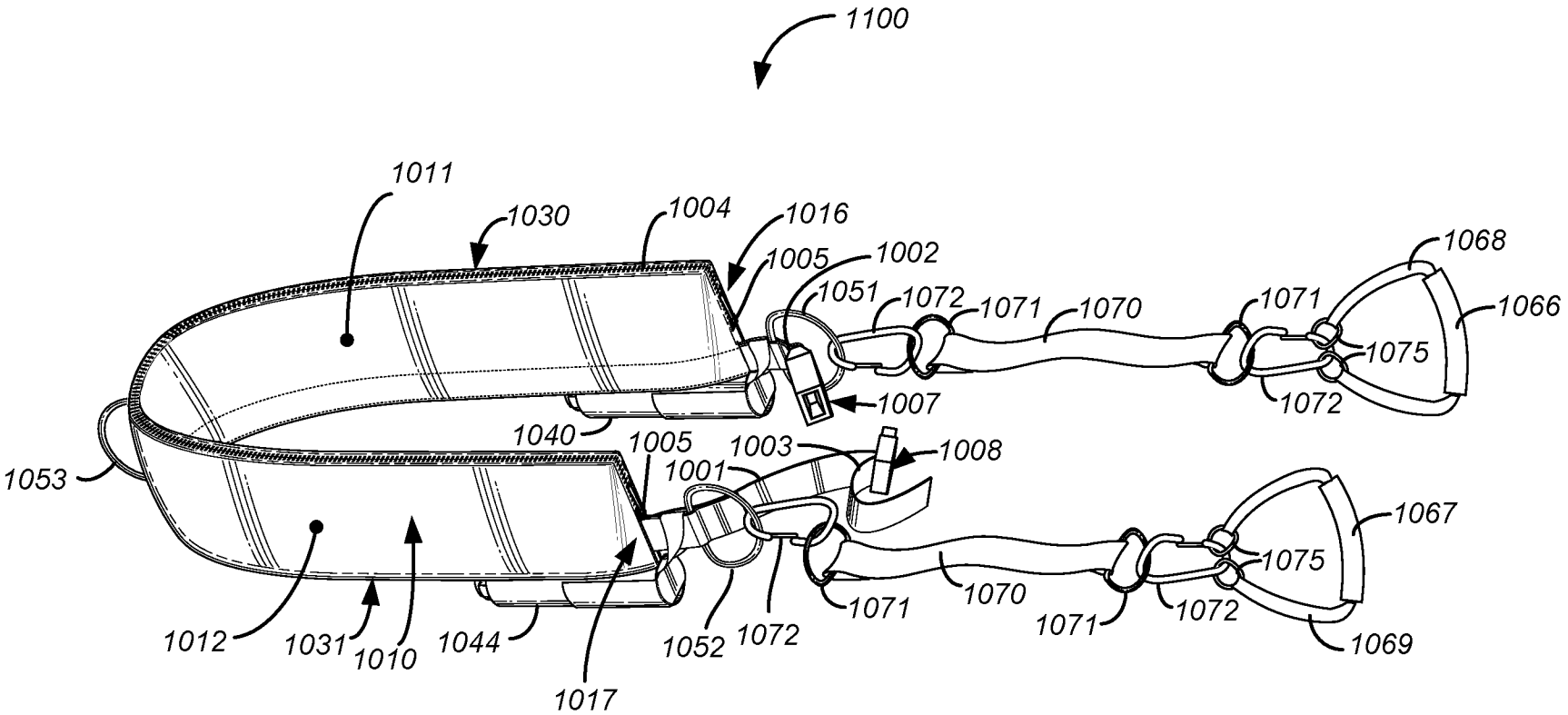
FIG. 18 is another perspective view of the exemplary portable exercise apparatus of FIG. 10 with a single closeable continuous pocket with the permanently attached handgrips in their auxiliary storage sleeves, the attachment strap coupling mechanism uncoupled and D-rings configured to receive a variety of attachments, such as auxiliary handgrips and elastic bands.
Figure 19:
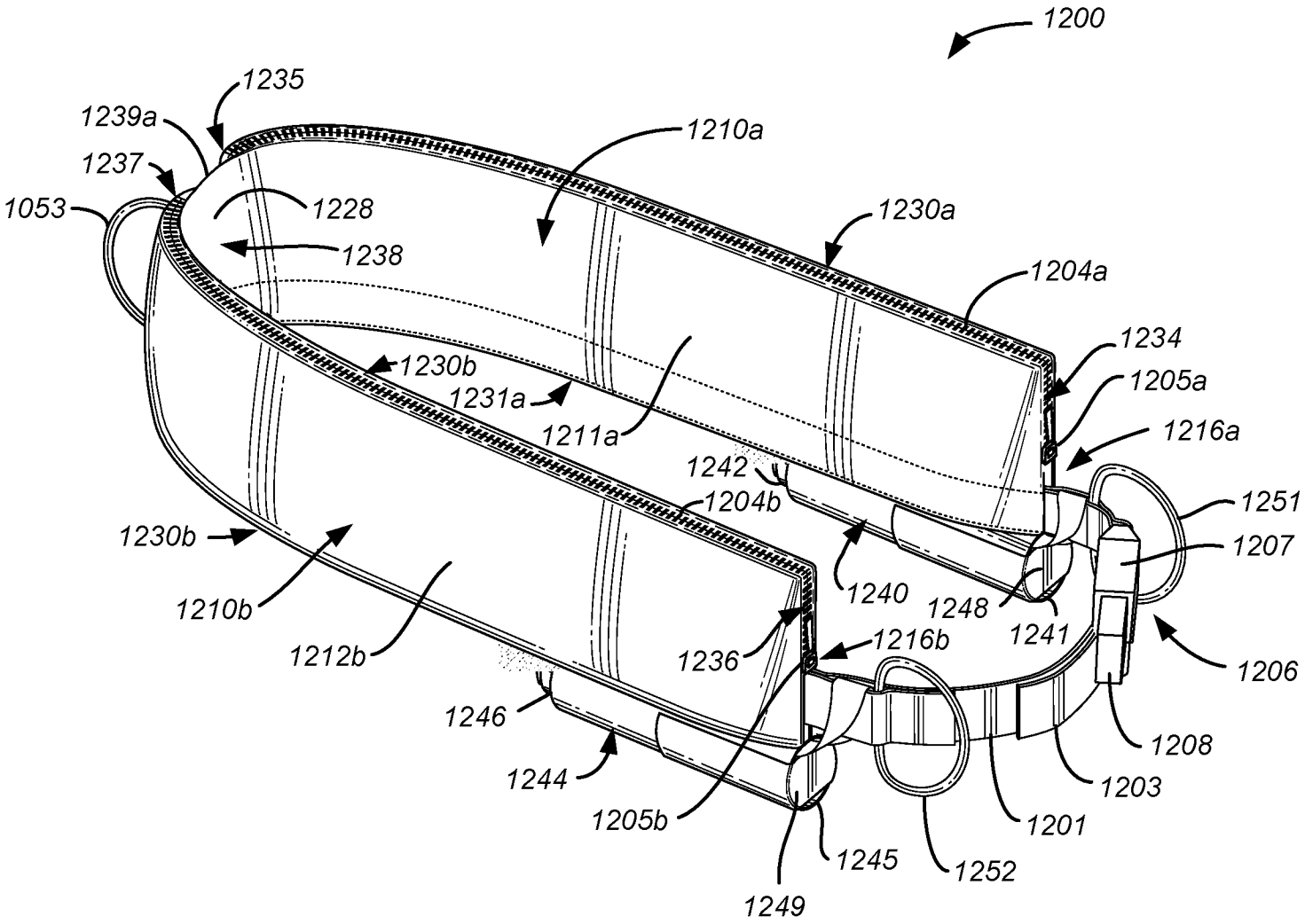
FIG. 19 is a perspective view of still another exemplary portable exercise apparatus with two closeable pockets affixed to an adjustable connector strap with a coupling mechanism assembly and an auxiliary storage sleeve configured along the inferior edge of each closeable continuous pocket.
Figure 20:
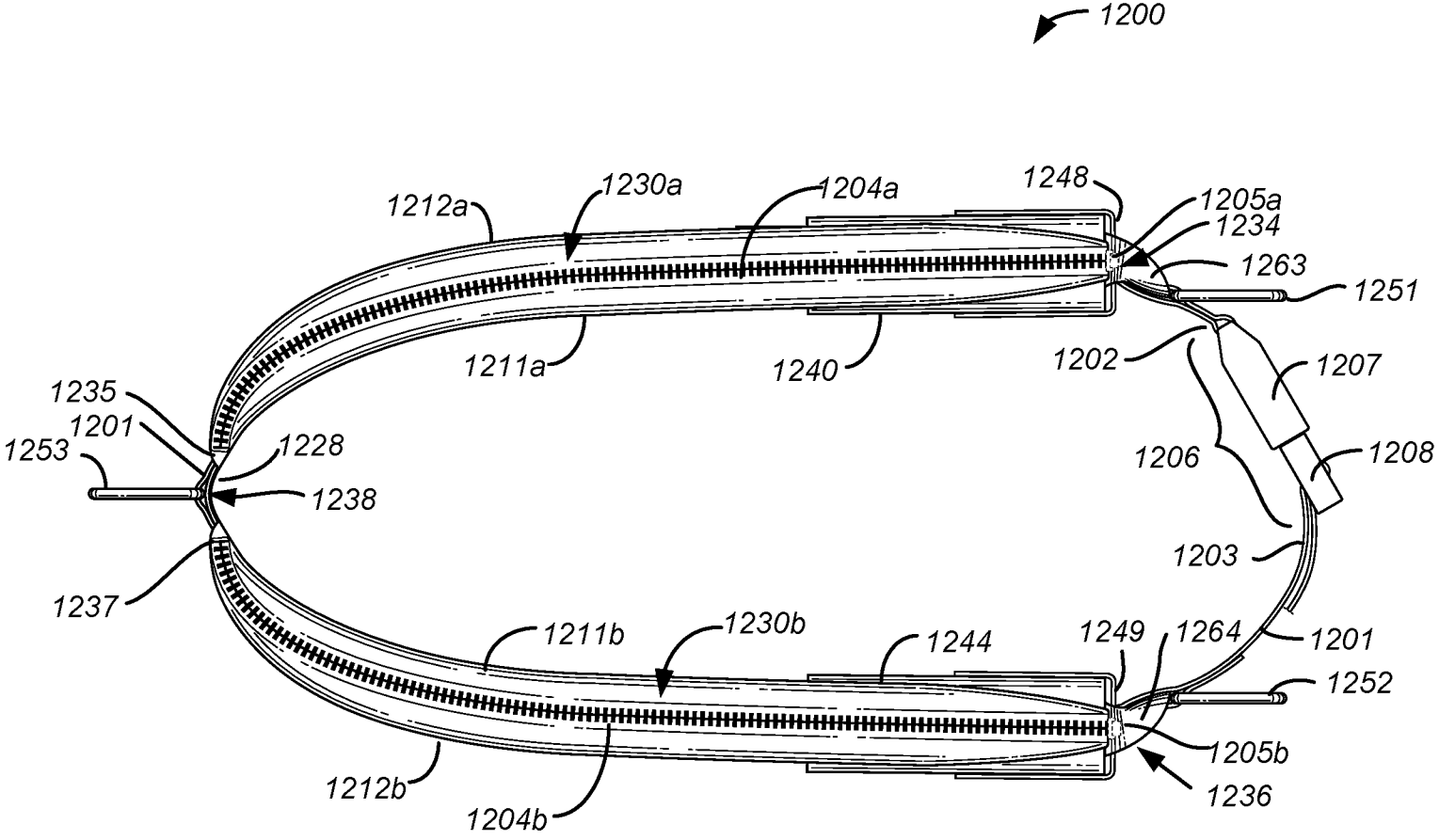
FIG. 20 is a top plan view of the exemplary portable exercise apparatus of FIG. 19 with two closeable pockets.
Figure 21:
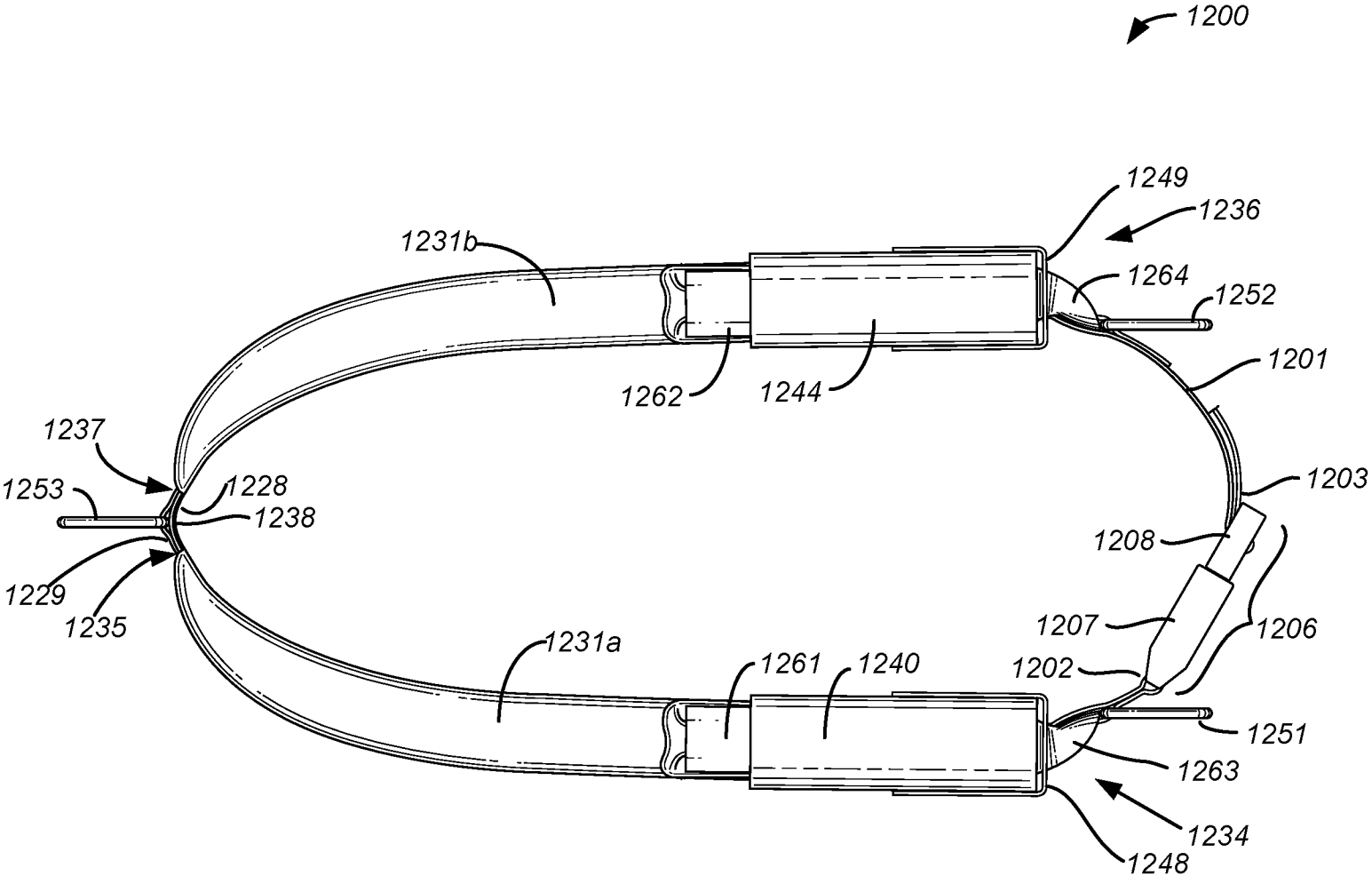
FIG. 21 is a bottom plan view of the exemplary portable exercise apparatus of FIG. 19 with two closeable pockets.
Figure 22:
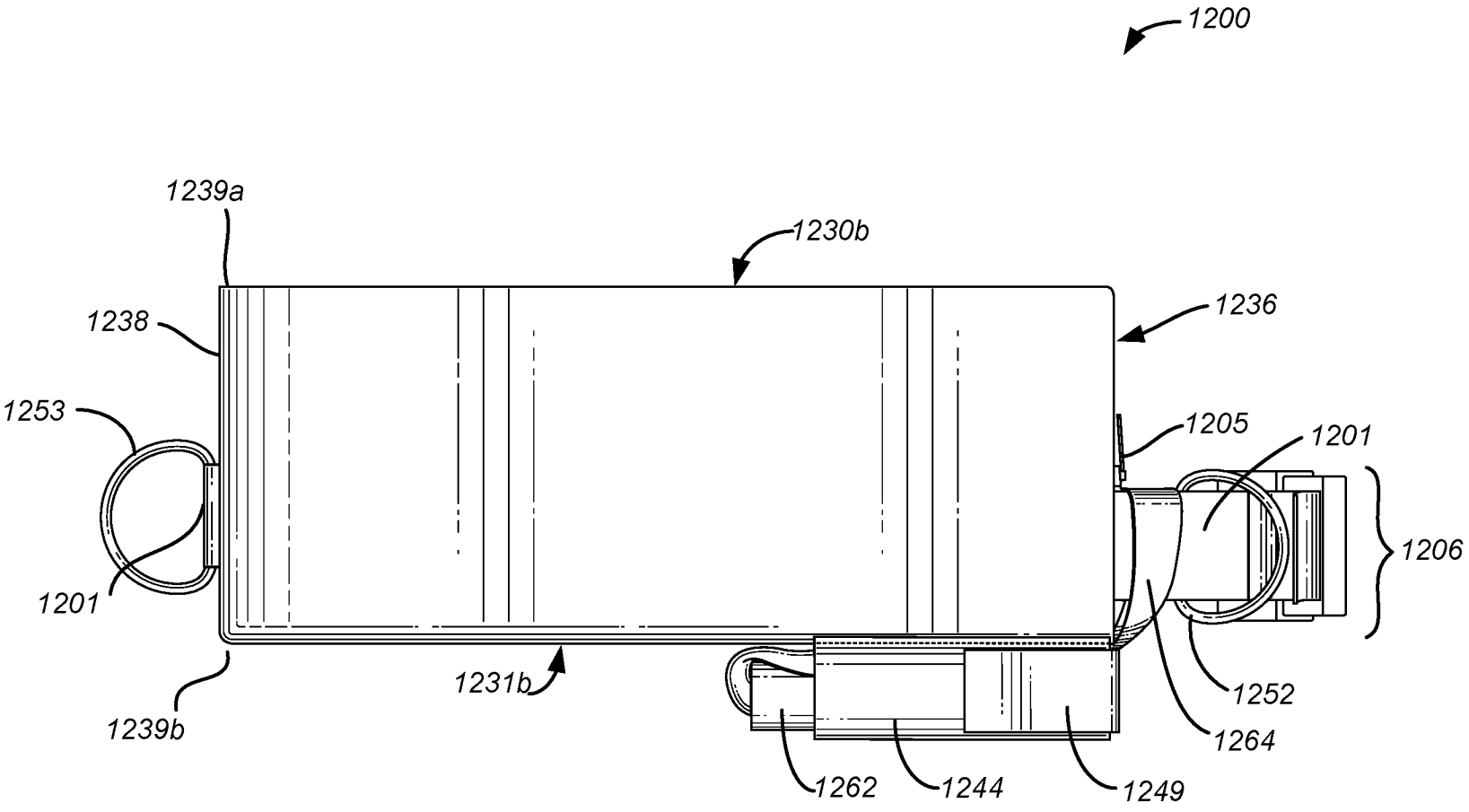
FIG. 22 is a right-side elevation view of the exemplary portable exercise apparatus of FIG. 19 with two closeable pockets.

In some embodiments, the portable exercise apparatus 1000 comprises an assembly 1100 having a plurality of accessories as illustrated in FIGS. 17 and 18.

In some embodiments, the portable exercise apparatus is an assembly 1100 comprising a third handgrip 1066 with a third flexible connector strap 1068.

In some embodiments, the portable exercise apparatus is an assembly 1100 further comprising a fourth handgrip 1067 with a second flexible connector strap 1069.

In some embodiments, any one or more of the first handgrip 1061, the second handgrip 1062, the third handgrip 1066, and the fourth handgrip 1067 are configurable with flexible handgrips. In some embodiments, any one or more of the first handgrip 1061, the second handgrip 1062, the third handgrip 1066, and the fourth handgrip 1067 are configurable with inflexible handgrips.

In some embodiments, any of the flexible connector straps for the handgrips are configurable with one or more connector strap fixation rings 1075 for attachment to other components of the apparatus, typically using a carabiner 1072. In some embodiments, each of the ends of the flexible connector straps for the handgrips are configurable with a fixation ring. In some embodiments, both ends of the flexible connector strap are sewn together creating a closed loop around the handgrip and further affixed with a single fixation ring 1075. In some embodiments, the fixation rings themselves are carabiners 1072.

In any one of the embodiments, the third handgrip 1066 with the third flexible connector strap 1068 and the fourth handgrip 1067 with the second flexible connector strap 1069 are releasably affixable to any of the fixation rings 1051, 1052, 1053 or to a releasably affixable carabiner 1072, for fixation to another accessory of the apparatus.

In any one of the embodiments, the third handgrip 1066 with the third flexible connector strap 1068 and the fourth handgrip 1067 with the second flexible connector strap 1069 are releasably affixable to tension bands 1070 or suspension lines 1080.

In some embodiments of the portable exercise apparatus, the first handgrip 1061 and the second handgrip 1062 with flexible connector straps 1063 and 1064 are configured for storage within the first auxiliary storage sleeve 1040 and the second auxiliary storage sleeve 1044.

In some embodiments of the portable exercise apparatus, the third handgrip 1066 and the fourth handgrip 1067 with flexible connector straps 1068 and 1069 are configured for storage within the pocket 1010. In some embodiments of the portable exercise apparatus, the third handgrip 1066 and the fourth handgrip 1067 with flexible connector straps 1068 and 1069 are configured for storage within the first auxiliary storage sleeve 1040 and the second auxiliary storage sleeve 1044.

In some embodiments, the first auxiliary storage sleeve 1040 further comprises a first cavity closure mechanism 1048 to restrain, capture and temporarily store a handgrip (1061, 1066), with a flexible connector strap (1063, 1068).

In some embodiments, the second auxiliary storage sleeve 1044 further comprises a second cavity closure mechanism 1049 to restrain, capture and temporarily store a handgrip (1062, 1067), with a flexible connector strap (1064, 1069).

Further still, the third handgrip 1066 with the third flexible connector strap 1068 and the fourth handgrip 1067 with the second flexible connector strap 1069 are releasably affixable to other auxiliary apparatus such as a tension band 1070 or a suspension line 1080 using a releasably affixed carabiner 1072.

In some embodiments, the tension band 1070 comprises a permanently affixed auxiliary fixation ring 1071 at each end. In some embodiments, the tension band comprises a releasably affixed carabiner 1072 at each end. In some embodiments, the tension band comprises a permanently affixed carabiner 1072 at each end.

In some embodiments, the suspension line 1080 comprises a permanently affixed auxiliary fixation ring 1071 at each end. In some embodiments, the suspension line comprises a releasably affixed carabiner 1072 at each end. In some embodiments, the tension bands comprise a permanently affixed carabiner 1072 at each end.

In some embodiments, the suspension line 1080 further comprises an adjustment device, friction hitch, or knot used to attach a loop of cord around a rope or to create a length adjustment. In some embodiments, the adjustment device is a ring 1071 or a carabiner 1072. In some embodiments, the adjustment device, friction hitch, or knot is a Prusik knot 1085.

In any one of the embodiments, the third handgrip 1066 with the third flexible connector strap 1068 and the fourth handgrip 1067 with the second flexible connector strap 1069, the tension band(s) 1070 and/or the suspension line(s) 1080, are releasably affixable to any one or more of the fixation rings 1051, 1052, 1053, to create a multi-functional exercise apparatus assembly 1100 configurable for a plurality of variable tension, compression or suspension exercises intended to improve a user's strength, endurance and/or flexibility.

In any one of the embodiments, the portable exercise apparatus assembly 1100 comprising the adjustable connector strap 1001, the pocket 1010, any one or more of the handgrips 1061, 1062, 1066, 1067 with flexible straps 1063, 1064, 1068, 1069, can be suspended from a plurality of structures such as a tree limb, a rafter or swing set cross-bar, to create a suspended exercise apparatus incorporating tension band(s) 1070 and/or the suspension line(s) 1080.

Alternatively, the portable exercise apparatus assembly 1100 described above can be wrapped around a vertical structure, such as a pole or tree trunk, or attached to a wall anchor to create a stationary tension-training device incorporating tension band(s) 1070 and/or the suspension line(s) 1080.

Further still, the third handgrip 1066 with the third flexible connector strap 1068 and the fourth handgrip 1067 with the second flexible connector strap 1069, are configurable with a door handgrip attachment feature that allows for secure fixation of the portable exercise apparatus 1000 using auxiliary fixation rings and carabiners to configure the apparatus for indoor use when weather or travel conditions preclude outdoor exercise. In some embodiments, a doorframe attachment feature comprises a bundled material knot in the flexible connector strap configurable for insertion between a closed door and the doorframe. In some embodiments, the doorframe attachment feature comprises a buckle or fixation ring feature 1075 in the flexible connector strap configurable for insertion between a closed door and the doorframe.

In some embodiments of the portable exercise apparatus 1000, the at least one securing mechanism 1004 for the pocket (pouch) 1010 comprises: a zipper; a Velcro connection; a compression snap; a magnet; a buckle; a button; a clasp; a lace; a flexible material strap; a hook or a combination thereof.

Figure 16:
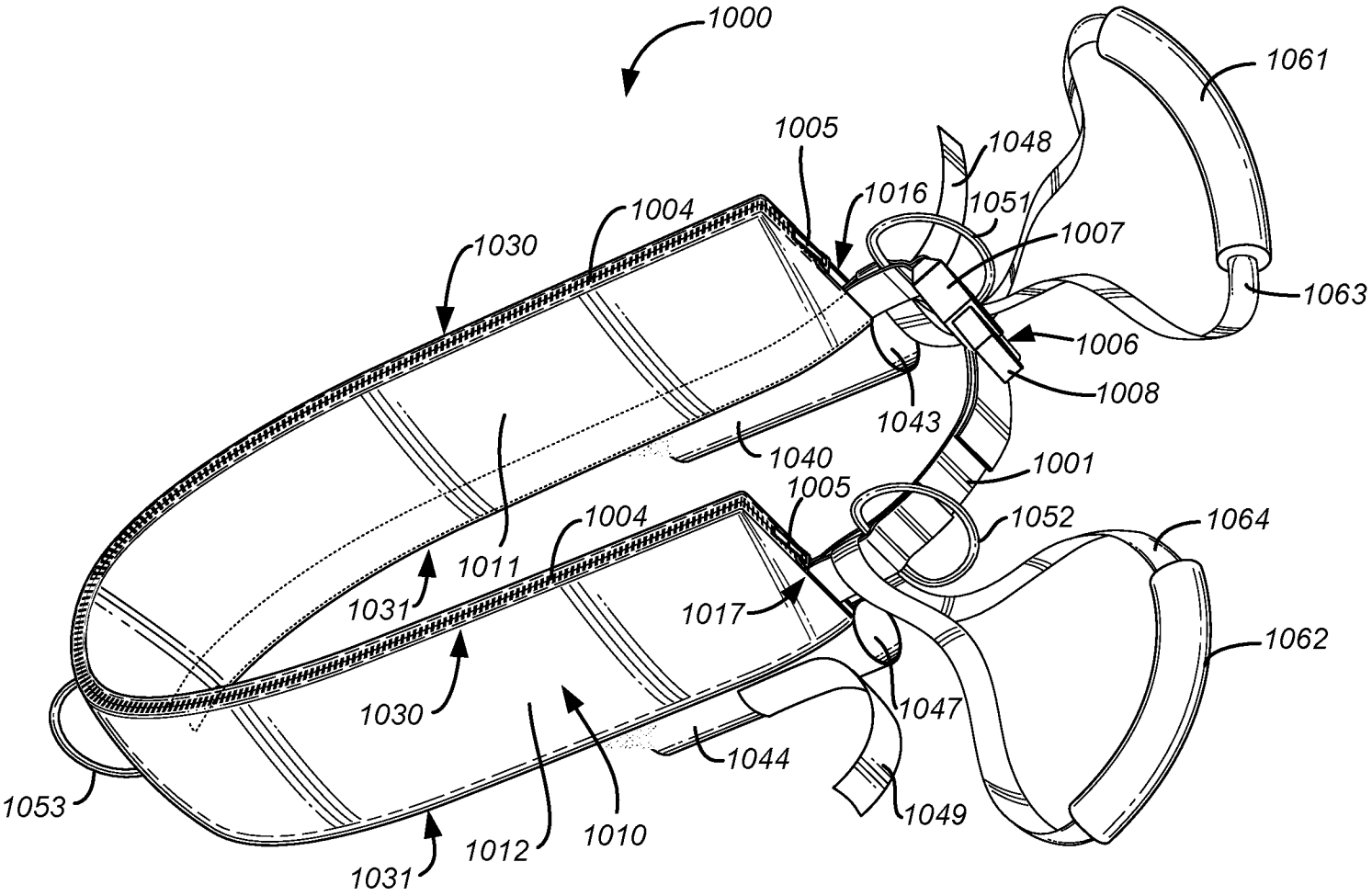
FIG. 16 is a perspective of the exemplary portable exercise apparatus of FIG. 10 with a single closeable continuous pocket and with the permanently attached handgrips withdrawn from their auxiliary storage sleeve s and fully extended.

In some embodiments of the portable exercise apparatus 1000, the at least one securing mechanism 1004 for the pocket (pouch) 1010 comprises a zipper 1004 with a zipper pull tag 1005 or a securing mechanism assist component, as illustrated in FIG. 16.

In some embodiments of the portable exercise apparatus 1000, the auxiliary storage sleeves (1040, 1044) further comprises a cavity closure mechanism 1048, 1049 comprising a flexible material strap with a Velcro connection, (also illustrated in FIG. 16); a zipper; a compression snap; a magnet; a clasp; a hook or a combination thereof.

As further illustrated in FIG. 17, in some embodiments of the portable exercise apparatus assembly 1100, the portable exercise apparatus 1000 further comprises detachable flexible or solid handgrips 1066, 1067 with flexible straps 1068, 1069, a door handle attachment feature, or doorframe attachment feature; tension bands 1070, suspension lines 1080 with Prusik knot 1085; a suspension harness (not shown); a running parachute (not shown); a parachute cord (not shown); a coupling mechanism (e.g.: carabiner 1072); a flexible water canteen (not shown); a drinking tube (not shown); a flow valve (not shown); at least one glove (not shown); first aid materials; or one or more of a plurality of safety features (e.g.: reflectors; flashing light; etc.).

In some embodiments of the portable exercise apparatus assembly 1100, doorframe attachment feature is configurable for securing itself between a door and a door frame such that when the door is closed within the frame, an attachment ring 1075 or similar feature protrudes from the door attachment feature to provide an attachment point for a releasable connecting attachment feature or specialized type of shackle, such as a carabiner, so that the portable exercise apparatus can be releasably attached thereto. Therein, the portable exercise apparatus assembly is configurable for indoor use.

In any one of the embodiments, the portable exercise apparatus assembly comprises a solid handgrip with a flexible connector strap that is convertible to a doorframe attachment device configured with connector strap fixation rings for attachment to the portable exercise apparatus, or any of a plurality of exercise apparatus accessories.

Figure 24:
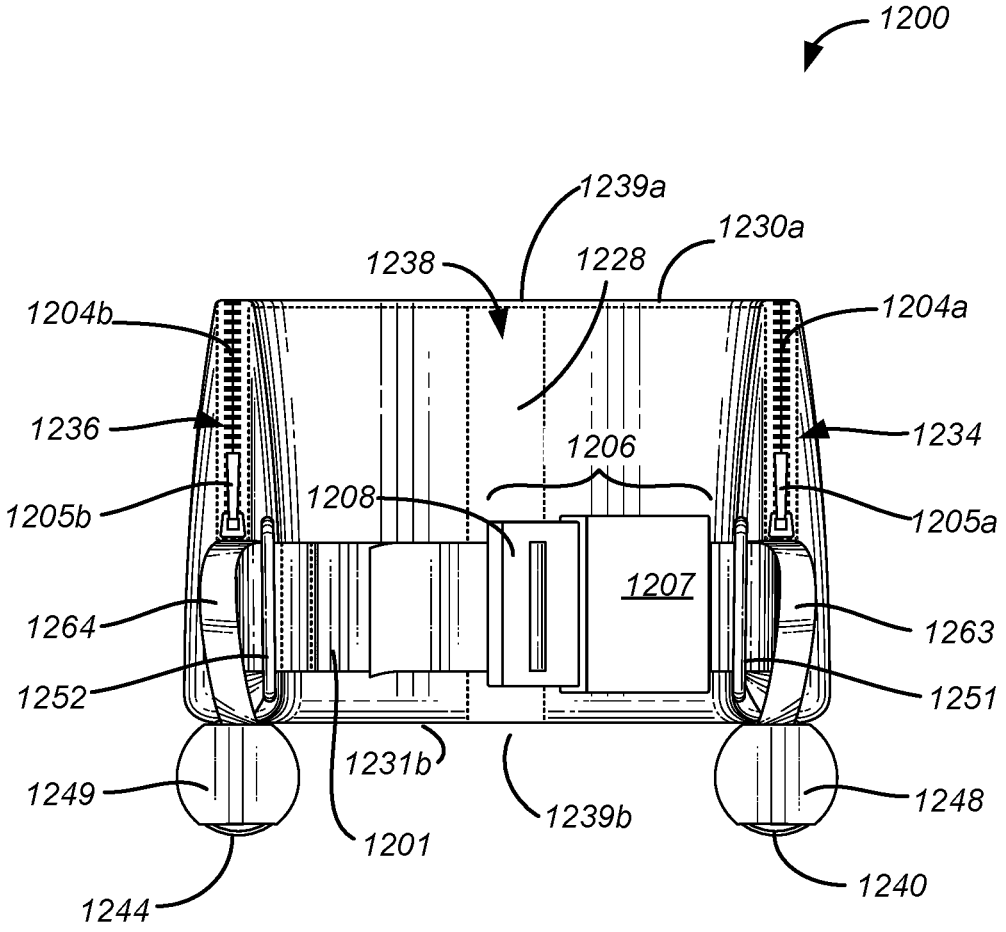
FIG. 24 is a front elevation view of the exemplary portable exercise apparatus of FIG. 19 with two closeable pockets.

Referring now to FIGS. 19, 20, 21 and 26, provided herein is a portable exercise apparatus 1200 comprising: an adjustable connector strap 1201 comprising a first end 1202 and a second end 1203 spaced lengthwise from each other; a coupling mechanism assembly 1206, as further illustrated in FIG. 24, comprising; a first coupling component 1207 at the first end 1202 of the adjustable connector strap 1201 and a second coupling component 1208 at or near the second end 1203 of the adjustable connector strap for releasably securing the first end of the adjustable connector strap to a section of the adjustable connector strap at or near the second end of the adjustable connector strap; a first closeable pocket (pouch) 1210*a* attached to and spaced along a first section of the adjustable connector strap 1201 comprising; at least a first medial exterior surface 1211*a* and a first lateral exterior surface 1212*a*, an first interior space 1213*a* within the first closeable pocket 1210*a* comprising a first medial interior surface 1214*a* and a first lateral interior surface 1215*a*; a first exterior end margin 1234 and a first interior end margin 1235; wherein the first exterior end margin 1234 and the first interior end margin 1235 are spaced apart lengthwise from each other along the first section of the adjustable connector strap 1201, at opposite ends of the first closeable pocket 1210*a*, a first exterior lengthwise margin 1230*a* adjoining the first exterior end margin 1234 and the first interior end margin 1235, the first exterior lengthwise margin comprising a first edge 1220 and a second edge 1221, forming a first opening 1218*a* to the interior space 1213*a*; and a second exterior lengthwise margin 1231*a* spaced apart from the first exterior lengthwise margin 1230*a*, forming a closed bottom to the first interior space 1213*a* of the first closeable pocket 1210*a*; wherein the first exterior lengthwise margin 1230*a* and second exterior lengthwise margin 1231*a* are positioned longitudinally along the adjustable connector strap 1201 between the first exterior end margin 1234 and first interior end margin 1235; at least a first pocket securing mechanism 1204*a* configured to releasably capture the first edge 1220 and the second edge 1221 to at least partially close the first opening 1218*a* to the interior space 1213*a* of the first closeable pocket 1210*a*; a second closeable pocket (pouch) 1210*b* attached to and spaced along a second section of the adjustable connector strap 1201 comprising: at least a second medial exterior surface 1211*b* and a second lateral exterior surface 1212*b*, a second interior space 1213*b* within the second closeable pocket 1210*b* comprising at least a second medial interior surface 1214*b* and a second lateral interior surface 1215*b*, a second exterior end margin 1236 and a second interior end margin 1237; wherein the second exterior end margin 1236 and the second interior end margin 1237 are spaced apart lengthwise from each other at opposite ends of the second closeable pocket (pouch) 1210*b* along the second section of the adjustable connector strap 1201, a third exterior lengthwise margin 1230*b* adjoining the second exterior end margin 1236 and the second interior end margin 1237, the third exterior lengthwise margin comprising a third edge 1224 and a fourth edge 1225, forming a first opening 1218*b* to the second interior space 1213*b* within the second closeable pocket 1210*b*; and a fourth exterior lengthwise margin 1231*b* spaced apart from the third exterior lengthwise margin 1230*b*, forming a closed bottom to the second interior space 1213*b* of the second closeable pocket 1210*b*; wherein the third exterior lengthwise margin 1230*b* and fourth exterior lengthwise margin 1231*b* are positioned longitudinally along a second section of the adjustable connector strap 1201 between the second exterior end margin 1236 and second interior end margin 1237; at least a second pocket securing mechanism 1204*b* configured to releasably capture the third edge 1224 and the fourth edge 1225 to at least partially close the first opening 1218*b* to the second interior space 1213*b* of the second closeable pocket 1210*b*; a connecting section 1238 comprising at least a medial surface 1228 and a lateral surface 1229, a superior margin 1239*a* and an inferior margin 1239*b* spaced apart from each other and positioned between the first interior end margin 1235 of the first closeable pocket 1210*a* and the second interior end margin 1237 of the second closeable pocket 1210*b*; wherein the adjustable connector strap 1201 is affixed lengthwise to the first medial interior surface 1214*a* of the first closeable pocket (pouch) 1210*a*, the lateral surface 1229 or the medial surface 1228 of the connecting section 1238 and the second medial interior surface 1215*b* of the second closeable pocket (pouch) 1210*b*, or wherein the adjustable connector strap 1201 is affixed lengthwise to the first medial exterior surface 1211*a* of the first closeable pocket (pouch) 1210*a*, the lateral surface 1229 or the medial surface 1228 of the connecting section 1238 and the second medial exterior surface 1211*b* of the second closeable pocket (pouch) 1210*b*, or, a combination thereof, such that the first end 1202 and the second end 1203 of the adjustable connector strap 1201 protrude past the first exterior end margin 1234 of the first pocket 1210*a* and the second exterior end margin 1236 of the second pocket 1210*b*.

In some embodiments of the portable exercise apparatus 1200, the connecting section 1238 comprises: a separate intermediate piece of material, an extension at the end of the first pocket 1210*a*, beyond the first interior end margin 1235 of the first pocket joined to an extension at the end of the second pocket 1210*b* beyond the second interior end margin 1237 of the second pocket, the adjustable connector strap 1201, or a combination thereof.

In some embodiments of the portable exercise apparatus, the first exterior end margin 1234 further comprises a fifth edge 1222 and a sixth edge 1223, forming a second opening 1216*a* to the first interior space 1213*a* of the first closeable pocket 1210*a*, and wherein the first interior end margin 1235 forms a closed end to the first interior space of the first closeable pocket.

In some embodiments of the portable exercise apparatus, the first opening 1218*a* to the first interior space 1213*a* of the first closeable pocket 1210*a* adjoins the second opening 1216*a* to the first interior space of the first closeable pocket.

In some embodiments, the first opening 1218*a* and the second opening 1216*a* of the first closeable pocket 1210*a* comprise one closure mechanism 1204*a* to secure both the first and the second opening. In some embodiments, the first opening 1218*a* and the second opening 1216*a* of the first closeable pocket 1210*a* each individually comprise a separate securing mechanism 1204*a*, such that there are two closure mechanisms when there are two openings.

In some embodiments, the at least one securing mechanism 1204*a*, 1204*b* for the first pocket 1210*a* or second pocket 1210*b* comprises a zipper 1204*a*, 1204*b* with a zipper pull tag 1205*a*, 1205*b* or a comparable securing mechanism assist component.

Still further, in some embodiments, there can be multiple closure mechanisms 1204*a* to secure each of the first and second openings 1218*a*, 1216*a* of the first closeable pocket 1210*a*. Similarly, in some embodiments, there can be multiple closure mechanisms 1204*b* to secure each of the first and second openings 1218*b*, 1216*b* of the second closeable pocket 1210*b*.

In some embodiments of the portable exercise apparatus 1200, the second exterior end margin 1236 comprises a seventh edge 1226 and an eighth edge 1227, forming a second opening 1216*b* to the second interior space 1213*b* of the second closeable pocket 1210*b*, and wherein the second interior end margin 1237 forms a closed end to the second interior space 1213*b* of the second closeable pocket 1210*b*.

In some embodiments, the first opening 1218*b* and the second opening 1216*b* of the second closeable pocket 1210*b* comprise one closure mechanism 1204*b* to secure both the first and the second opening.

In some embodiments, the first opening 1218*b* and the second opening 1216*b* of the second closeable pocket 1210*b* each individually comprise a separate securing mechanism 1204*b*, such that there are two closure mechanisms when there are two openings.

In some embodiments, the at least one closure mechanism is a zipper, or zipper mechanism 1204. In some embodiments, the zipper comprises a zipper assist or pull tab 1205. In some embodiments, the closure mechanism comprises: a lace, a flap; a Velcro connection; compression snaps; magnets; buckles; buttons; clasps; a flexible material strap; or hooks.

In some embodiments of the portable exercise apparatus, the closure mechanism for the first pocket 1210*a* or the second pocket 1210*b* comprises: a zipper; a Velcro connection; a compression snap; a magnet; a buckle; a button; a clasp; a lace; a flexible material strap; a hook or a combination thereof.

Still further, in some embodiments, there can be multiple closure mechanisms to secure each of the first and second openings 1218*b*, 1216*b* of the second closeable pocket 1210*b*.

In some embodiments, the portable exercise apparatus 1200 or assembly 1300 further comprises, a first auxiliary storage sleeve 1240 having a first end 1241, a second end 1242 and a first cavity 1243 therebetween, affixed to the apparatus on or about the second exterior lengthwise margin 1231*a*, at or near the first exterior end margin 1234.

Figure 27:
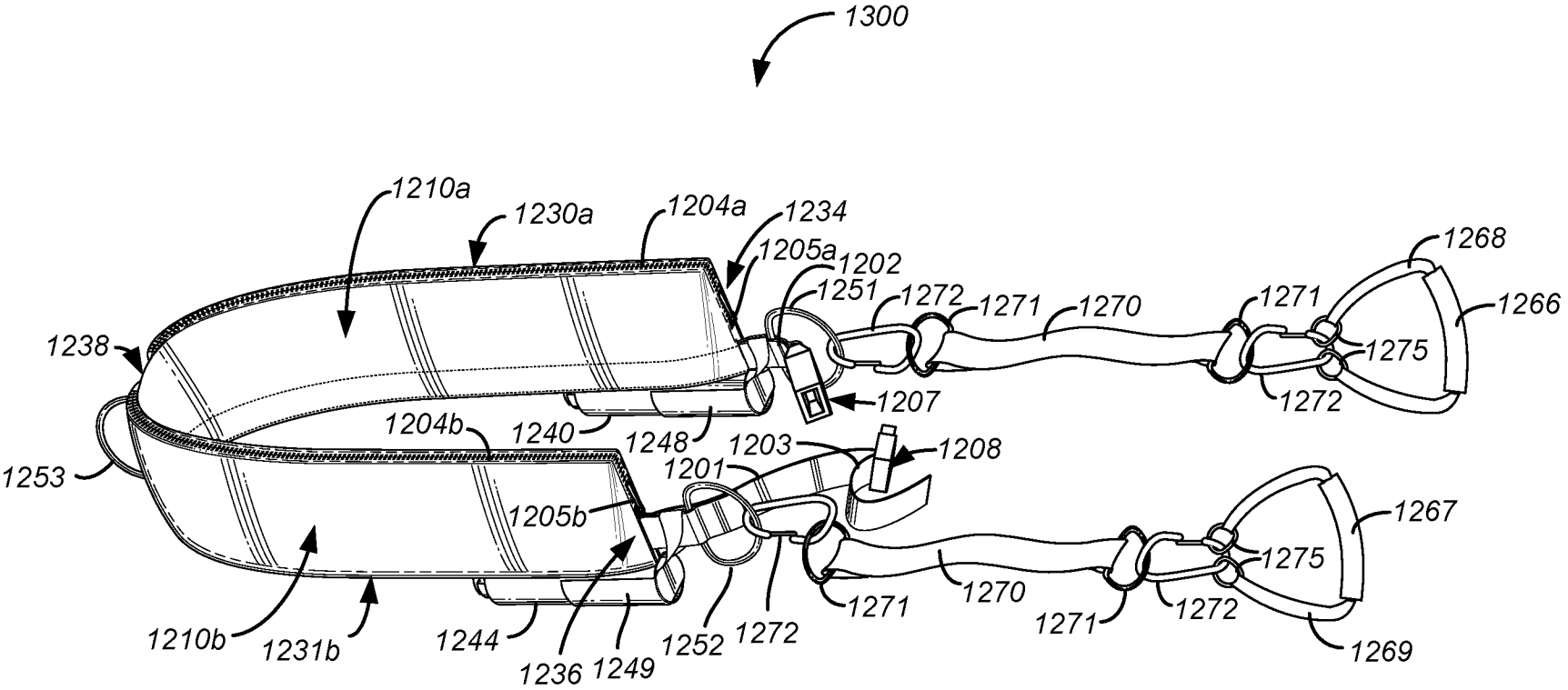
FIG. 27 is another perspective view of the exemplary portable exercise apparatus of FIG. 19 with two closeable pockets, with the permanently attached handgrips in their auxiliary storage sleeves, the attachment strap coupling mechanism uncoupled and D-rings configured to receive a variety of attachments, such as auxiliary handgrips and elastic bands.

In some embodiments, the portable exercise apparatus 1200 comprises an assembly 1300 having a plurality of accessories as illustrated in FIG. 27.

In some embodiments, the portable exercise apparatus 1200 or assembly 1300 further comprises, a second auxiliary storage sleeve 1244 having a third end 1245, a fourth end 1246 and a second cavity 1247 therebetween, affixed on or about the fourth exterior lengthwise margin 1231*b*, at or near the second exterior end margin 1236.

In some embodiments of the first auxiliary storage sleeve 1240 and the second auxiliary storage sleeve 1244 are spaced apart lengthwise from each other on or about the second exterior lengthwise margin 1231*a* and the fourth exterior lengthwise margin 1231*b*.

In some embodiments of the portable exercise apparatus 1200 or assembly 1300, the first and/or the second auxiliary storage sleeve 1240, 1244 further comprises a cavity closure mechanism comprising: a zipper; a Velcro connection; a compression snap; a magnet; a clasp; a flexible material strap; a hook or a combination thereof.

In some embodiments, as illustrated in FIGS. 19-22, the portable exercise apparatus 1200 or assembly 1300 comprises a first fixation ring 1251 and a second fixation ring 1252, wherein the first fixation ring 1251 is permanently affixed to the adjustable connector strap 1201 between the first coupling component 1207 at or near the first end 1202 of the adjustable connector strap 1201 and the first exterior end margin 1234 of the first pocket 1210*a*, and wherein the second fixation ring 1252 is permanently affixed to the adjustable connector strap 1201 between the second coupling component 1208 at or near the second end 1203 of the adjustable connector strap 1201 and the second exterior end margin 1236 of the second pocket 1210*b*. In some embodiments, the portable exercise apparatus 1200 or assembly 1300 further comprises a first fixation ring 1251 and a second fixation ring 1252; wherein the first fixation ring 1251 is a releasably affixable carabiner 1272 affixable to the adjustable connector strap 1201 between the first coupling component 1207 at or near the first end 1202 of the adjustable connector strap and the first exterior end margin 1234 of the first pocket 1210*a*, and wherein the second fixation ring 1252 is a releasably affixable carabiner affixable to the adjustable connector strap 1201 between the second coupling component 1208 at the second end 1203 of the adjustable connector strap and the second exterior end margin 1236 of the second pocket 1210*b*.

Figure 25:
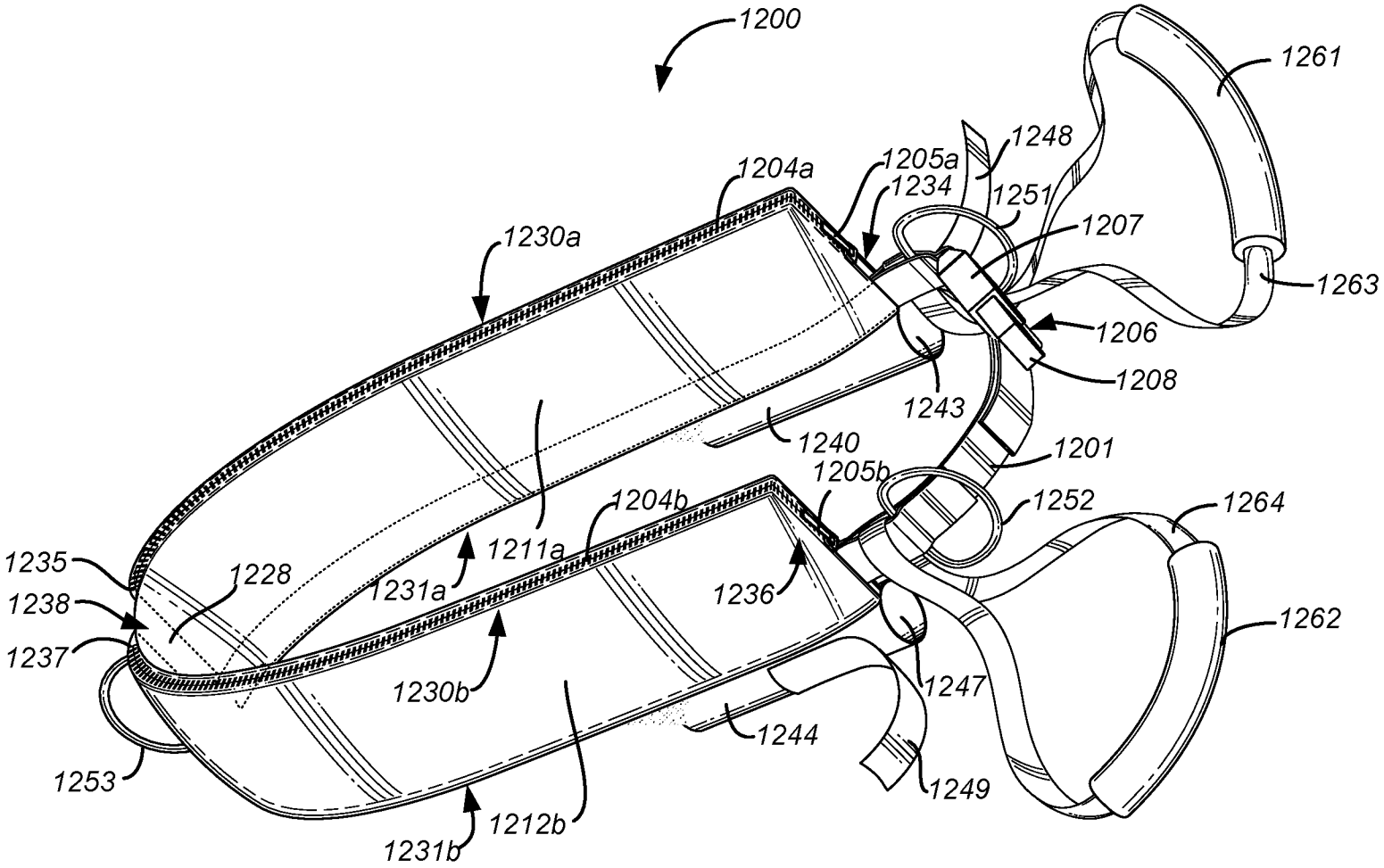
FIG. 25 is a perspective of the exemplary portable exercise apparatus of FIG. 19 with two closeable pockets and with the permanently attached handgrips withdrawn from their auxiliary storage sleeves and fully extended.
Figure 26:
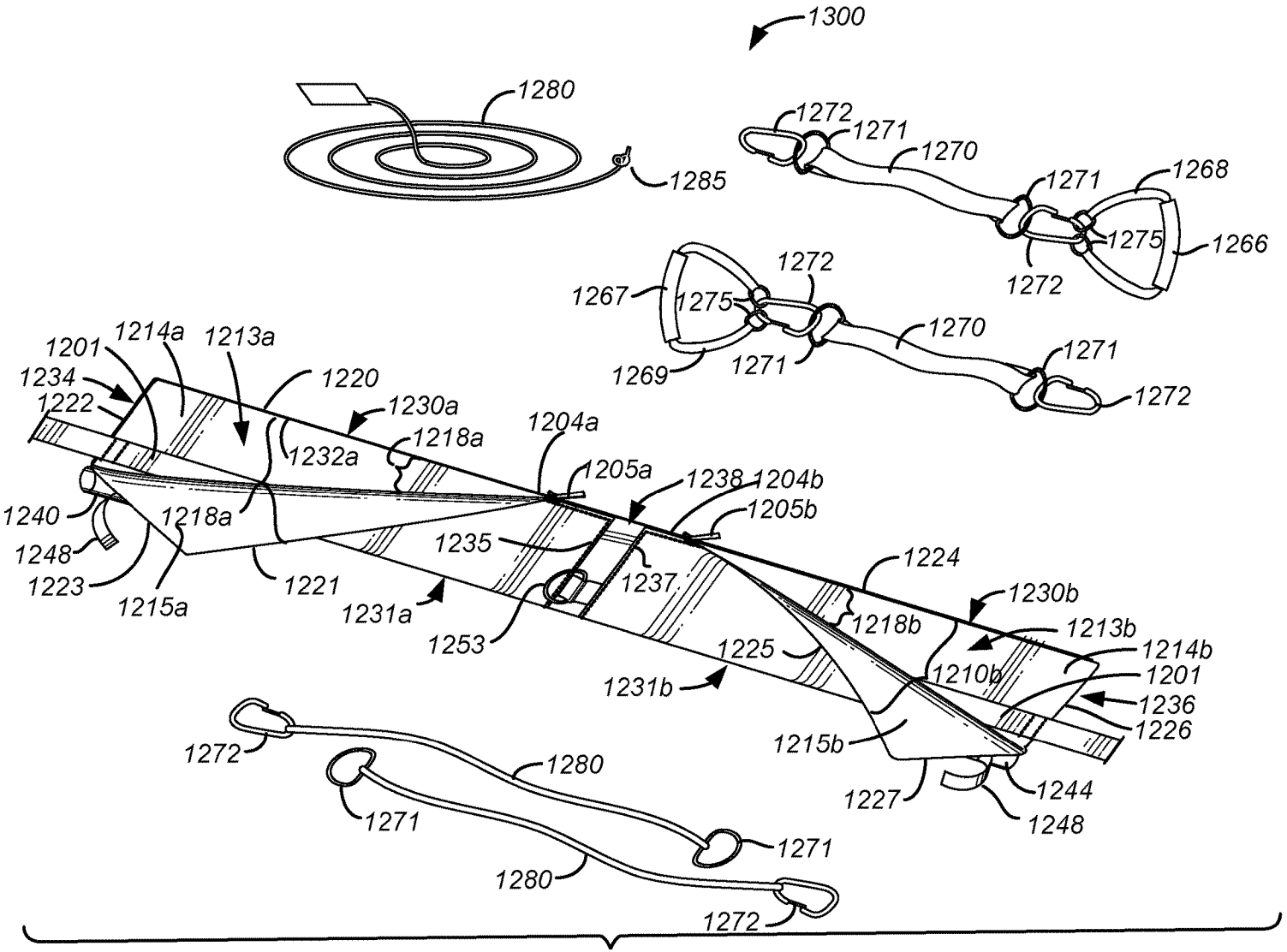
FIG. 26 is another perspective view of the exemplary portable exercise apparatus of FIG. 19, in a fully extended state, illustrating the two open, closeable pockets for holding accessories, each with a securing mechanism shown in an open pocket state and the attachment strap affixed therein and a plurality of accessories comprising tension bands, suspension lines, attachment couplings and additional releasable handgrips.

In some embodiments, as illustrated in FIGS. 23 and 25, the portable exercise apparatus 1200 or assembly 1300 further comprises, a third fixation ring 1253, wherein the third fixation ring is permanently affixed to the portable exercise apparatus between the first pocket 1210*a* and the second pocket 1210*b*, at the connecting section 1238, at or about the approximate lengthwise center of the working length of the adjustable connector strap 1201, and approximately equidistant between the first fixation ring 1251 and the second fixation ring 1252. In some embodiments, the portable exercise apparatus 1200 or assembly 1300 further comprises, a third fixation ring 1253, wherein the third fixation ring is a releasably affixable carabiner 1272 affixable to the portable exercise apparatus at the connecting section between the first pocket 1210*a* and the second pocket 1210*b*, at the connecting section 1238 and approximately equidistant between the first fixation ring 1251 and the second fixation ring 1252.

In some embodiments of the portable exercise apparatus 1200 or assembly 1300, the connecting section 1238 comprises: a separate intermediate piece of material, an extension at the end of the first pocket 1210*a*, beyond the first interior end margin 1235 of the first pocket joined to an extension at the end of the second pocket 1210*b*, beyond the second interior end margin 1237 of the second pocket, the adjustable connector strap 1201, or a combination thereof.

In some embodiments, the portable exercise apparatus 1200 or assembly 1300 comprises a first handgrip 1261 with a first flexible strap 1263.

In some embodiments, the portable exercise apparatus 1200 or assembly 1300 further comprises a second handgrip 1262 with a second flexible strap 1264.

In some embodiments of the portable exercise apparatus 1200 or assembly 1300, the first handgrip 1261 with the first flexible connector strap 1263 is permanently affixed to the adjustable connector strap 1201 between the first coupling component 1207 at or near the first end 1202 of the adjustable connector strap 1201 and the first exterior end margin 1234 of the first pocket 1210*a*.

In some embodiments of the portable exercise apparatus 1200 or assembly 1300, the second handgrip 1262 with the second flexible connector strap 1264 is permanently affixed to the adjustable connector strap 1201 between the second coupling component 1208 at or near the second end 1203 of the adjustable connector strap 1201 and the second exterior end margin 1236 of the second pocket 1210*b*.

In still other embodiments of the portable exercise apparatus 1200 or assembly 1300, the first handgrip 1261 with the first flexible connector strap 1263 is releasably affixable to a first fixation ring 1251 that is affixed to the adjustable connector strap 1201 between the first coupling component 1207 at or near the first end 1202 of the adjustable connector strap 1201 and the first exterior end margin 1234 of the first pocket 1210*a*.

In still other embodiments of the portable exercise apparatus 1200 or assembly 1300, the second handgrip 1262 with the second flexible connector strap 1264 is releasably affixable to a second fixation ring 1252 that is affixed to the adjustable connector strap 1201 between the second coupling component 1208 at or near the second end 1203 of the adjustable connector strap and the second exterior end margin 1236 of the second pocket 1210*b*.

In some embodiments, the first handgrip 1261 and first flexible connector strap 1263 is configurable for storage within the first cavity 1243 of the first auxiliary storage sleeve 1240. In some embodiments, the second handgrip 1262 and second flexible connector strap 1264 is configurable for storage within the second cavity 1247 of the second auxiliary storage sleeve 1244.

Further still, in some embodiments, the portable exercise apparatus 1200 or assembly 1300 comprises at least a third handgrip 1266 with a third flexible strap 1268. Still further, in some embodiments, the portable exercise apparatus 1200 or assembly 1300 comprises a fourth handgrip 1267 with a fourth flexible strap 1269.

In some embodiments, the handgrip 1261, 1262, 1266, and 1267 is flexible. In some embodiments, the handgrip 1261, 1262, 1266, and 1267 is not flexible.

In some embodiments of the portable exercise apparatus 1200 or assembly 1300, any of the flexible connector straps 1263, 1264, 1268, 1269 for the handgrips 1261, 1262, 1266, 1267 are configurable with connector strap fixation rings 1275 for attachment to other components of the apparatus or assembly, typically using a carabiner 1272. In some embodiments, each of the ends of the flexible connector straps for the handgrips is configurable with a fixation ring 1275. In some embodiments, both ends of the flexible connector strap are sewn together creating a closed loop around the handgrip and further affixed with a single fixation ring 1275. In some embodiments, the fixation rings themselves are carabiners 1272.

In some embodiments of the portable exercise apparatus 1200 or assembly 1300, any of the tension bands 1270 are configurable with auxiliary fixation rings 1271 for attachment to the apparatus 1200 or assembly 1300 or other components thereof, typically using a carabiner 1272. In some embodiments, the auxiliary fixation rings themselves are carabiners 1272.

In any one of the embodiments of the portable exercise apparatus 1000, 1200, or assembly 1100, 1300, the tension bands 1070, 1270 are provided in pairs, each pair comprising matched tensions. In some embodiments, the assembly comprises multiple pairs of tension bands.

In any one of the embodiments of the portable exercise apparatus assembly 1100, 1300 the tension band pairs are provided in tension ranges between about 5.0 lbs. and about 75.0 lbs., between about 5.0 lbs. and about 70.0 lbs., between about 5.0 lbs. and about 65.0 lbs., between about 5.0 lbs. and about 60.0 lbs., between about 5.0 lbs. and about 55.0 lbs., between about 5.0 lbs. and about 50.0 lbs., between about 5.0 lbs. and about 45.0 lbs., between about 5.0 lbs. and about 40.0 lbs., between about 5.0 lbs. and about 35.0 lbs., between about 5.0 lbs. and about 30.0 lbs., between about 5.0 lbs. and about 25.0 lbs., between about 5.0 lbs. and about 20.0 lbs., between about 5.0 lbs. and about 15.0 lbs., or between about 5.0 lbs. and about 10.0 lbs.

In any one of the embodiments of the portable exercise apparatus assembly 1300 the elastic tension band ranges are provided, in increments of about 2.5 lbs., in increments of about 5.0 lbs., in increments of about 7.5 lbs., in increments of about 10.0 lbs., in increments of about 12.5 lbs., in increments of about 15.0 lbs., in increments of about 17.5 lbs., in increments of about 20.0 lbs., in increments of about 22.5 lbs., or in increments of about 25.0 lbs.

In some embodiments of the portable exercise apparatus assembly 1100, 1300, the at least one releasably attachable elastic tension band 1270 ranges in length from about: 0.5-to about 2.0 feet, from about 1.0-to about 2.0 feet, from about 1.5-to about 2.0 feet; from about 1.5-to about 3.0 feet; from about 1.5-to about 4.0 feet; from about 1.5-to about 5.0 feet; from about 1.5-to about 6.0 feet; from about 1.5-to about 7.0 feet; from about 1.5-to about 8.0 feet; from about 1.5-to about 9.0 feet; and from about 0.5-to about 10.0 feet.

In still other embodiments of the portable exercise apparatus 1200 or assembly 1300, the first pocket securing mechanism 1204*a* for the first pocket 1210*a* and the second pocket securing mechanism 1204*b* for the second pocket 1210*b* comprise a zipper; a Velcro connection; a compression snap; a magnet; a buckle; a button; a clasp; a lace; a flexible material strap; a hook or a combination thereof.

In some embodiments of the portable exercise apparatus, the auxiliary storage sleeve 1240, 1244 further comprises a cavity closure mechanism 1248, 1249 comprising a zipper; a Velcro connection; a compression snap; a magnet; a clasp; a flexible material strap; a hook or a combination thereof.

In some embodiments of the portable exercise apparatus 1200 or assembly 1300, the apparatus further comprises additional accessory components comprising: at least a third handgrip 1266 with a third flexible strap 1268; at least one suspension line 1280 configured to safely support the weight of a human adult; at least one tension band 1270; at least one accessory attachment connection device 1271, 1272; a door attachment device, doorknob attachment device or door frame attachment device (not shown).

In some embodiments, the suspension line 1280 comprises a permanently affixed auxiliary fixation ring 1271 at each end. In some embodiments, the suspension line comprises a releasably affixed carabiner 1272 at each end.

In some embodiments, the suspension line 1280 further comprises an adjustment device, friction hitch, or knot used to attach a loop of cord around a rope or to create a length adjustment. In some embodiments, the adjustment device is a ring 1271 or a carabiner 1272. In some embodiments, the adjustment device, friction hitch, or knot is a Prusik knot 1285.

In some embodiments of the portable exercise apparatus 1200 or assembly 1300, the apparatus further comprises detachable flexible or solid handgrips 1266, 1267 with flexible straps 1268, 1269; a door handle or hinge attachment feature (not shown); a suspension harness (not shown); a running parachute (not shown); a parachute cord (not shown); a coupling mechanism; a flexible water canteen; a drinking tube; a flow valve; a glove, first aid articles and one or more of a plurality of safety features.

In any one of the embodiments of the portable exercise apparatus 1200 or assembly 1300, the apparatus comprises wear-resistant material comprising: nylon; moleskin; polyester; polypropylene; aramid polymer fabric; Kevlar®; technical fabric; SuperFabric®; Cordura®, Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix© Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

In any one of the embodiments of the portable exercise apparatus 1200 or assembly 1300, the apparatus further comprises one or more of a plurality of safety features comprising: reflective tape; neon coloring; florescent coloring; a flashing light unit (not shown); RFID tracking device (not shown); GPS tracking device (not shown); or a geolocation device (not shown).

Provided herein is a portable exercise apparatus kit 1300 comprising: an adjustable connector strap 1201 comprising a first end 1202 and a second end 1203 spaced lengthwise from each other; a coupling mechanism assembly 1206 comprising a first coupling component 1207 at or near the first end of the adjustable connector strap and a second coupling component 1208 at or near the second end of the adjustable connector strap for releasably securing the first end of the adjustable connector strap to a section of the adjustable connector strap at or near the second end of the adjustable connector strap; a first closeable pocket 1210*a* attached to and spaced along a first section of the adjustable connector strap comprising; an first interior space 1213*a* within the first closeable pocket; a first exterior end margin 1234 and a first interior end margin 1235; a first exterior lengthwise margin 1230*a* adjoining the first exterior end margin and the second end margin, the first exterior lengthwise margin 1230*a* comprising a first edge 1220 and a second edge 1221, forming a first opening 1216*a* to the first interior space; and a second exterior lengthwise margin 1231*a* spaced apart from the first exterior lengthwise margin, forming a closed bottom to the first interior space of the first closeable pocket; at least a first pocket securing mechanism 1204*a* configured to releasably capture the first edge and the second edge to at least partially close the first opening to the first interior space of the first closeable pocket; a second closeable pocket 1210*b* attached to and spaced along a second section of the adjustable connector strap comprising: a second interior space 1213*b* within the second closeable pocket, a second exterior end margin 1236 and a second interior end margin 1237; a third exterior lengthwise margin 1230*b* adjoining the second exterior end margin and the second interior end margin, the third exterior lengthwise margin 1230*b* comprising a third edge 1224 and a fourth edge 1225, forming a first opening 1216*b* to the second interior space within the second closeable pocket; and a fourth exterior lengthwise margin 1231*b* spaced apart from the third exterior lengthwise margin, forming a closed bottom to the second interior space of the second closeable pocket; at least a second pocket securing mechanism 1204*b* configured to releasably capture the third edge and the fourth edge to at least partially close the first opening to the second interior space of the second closeable pocket; a connecting section 1238 positioned between the first interior end margin 1235 of the first closeable pocket 1210*a* and the second interior end margin 1237 of the second closeable pocket 1210*b*; wherein the adjustable connector strap 1201 is affixed lengthwise to a surface of the first closeable pocket 1210*a*, optionally affixed to a surface of the connecting section 1238, and affixed to a surface of the second closeable pocket 1210*b*, such that the first end 1202 and the second end 1203 of the adjustable connector strap 1201 protrude past the first exterior end margin 1234 of the first pocket and the second exterior end margin 1236 of the second pocket, a first fixation ring 1251; a second fixation ring 1252; and a third fixation ring 1253; wherein the first fixation ring is affixed to the adjustable connector strap near the first end of the adjustable connector strap, the second fixation ring is affixed to the adjustable connector strap near the second end of the adjustable connector strap, and the third fixation ring is affixed to apportion of the portable exercise apparatus between the first pocket and the second pocket approximately equidistant between the first fixation ring and the second fixation ring, at least one handgrip 1261, 1262 with at least one flexible strap 1263, 1264; at least one auxiliary storage sleeve 1240, 1244; at least one suspension line 1280 configured to safely support the weight of human adult; at least one tension band 1270; at least one accessory attachment connection device 1271, 1272; a door attachment device or doorframe attachment device.

In some embodiments of the portable exercise apparatus kit 1300, the portable exercise apparatus comprises a first fixation ring 1251 and a second fixation ring 1252; wherein the first fixation ring is a releasably affixable carabiner 1272 affixable to the adjustable connector strap between the first coupling component 1207 at or near the first end of the adjustable connector strap and the first exterior end margin 1234 of the first pocket, and wherein the second fixation ring is a releasably affixable carabiner affixable to the adjustable connector strap between the second coupling component 1208 at the second end of the adjustable connector strap and the second exterior end margin 1236 of the second pocket.

In some embodiments of the portable exercise apparatus kit 1300, the portable exercise apparatus comprises a third fixation ring 1253, wherein the third fixation ring is a releasably affixable carabiner 1272 affixable to the portable exercise apparatus between the first pocket and the second pocket at the connecting section, approximately equidistant between the first fixation ring and the second fixation ring. In some embodiments of the kit, the third fixation ring is a releasably affixable carabiner affixed to the adjustable connector strap between the first pocket and the second pocket at the connecting section.

In some embodiments of the portable exercise apparatus kit 1300, the connecting section 1238 comprises: a separate intermediate piece of material, an extension at the end of the first pocket 1210*a*, beyond the first interior end margin 1235 of the first pocket joined to an extension at the end of the second pocket 1210*b*, beyond the second interior end margin 1237 of the second pocket, the adjustable connector strap 1201, or a combination thereof.

In some embodiments of the portable exercise apparatus kit 1300, the kit further comprises additional accessory components comprising: at least a third handgrip 1266 with a third flexible strap 1268; at least one suspension line 1280 configured to safely support the weight of a human adult; at least one tension band 1270; at least one accessory attachment connection device 1271, 1272; a door attachment device, doorknob attachment device or door frame attachment device (not shown).

In some embodiments of the portable exercise apparatus kit 1300, any of the tension bands 1270 are configurable with auxiliary fixation rings 1271 for attachment to the apparatus 1200 or assembly 1300 or other components thereof, typically using a carabiner 1272. In some embodiments, the auxiliary fixation rings themselves are carabiners 1272. In some embodiments of the kit, the suspension line 1280 comprises a permanently affixed auxiliary fixation ring 1271 at each end. In some embodiments, the suspension line comprises a releasably affixed carabiner 1272 at each end.

In some embodiments of the portable exercise apparatus kit 1300, the kit comprises multiple pairs of tension bands. In any one of the embodiments of the kit, the tension band pairs are provided in tension ranges between about 5.0 lbs. and about 75.0 lbs., between about 5.0 lbs. and about 70.0 lbs., between about 5.0 lbs. and about 65.0 lbs., between about 5.0 lbs. and about 60.0 lbs., between about 5.0 lbs. and about 55.0 lbs., between about 5.0 lbs. and about 50.0 lbs., between about 5.0 lbs. and about 45.0 lbs., between about 5.0 lbs. and about 40.0 lbs., between about 5.0 lbs. and about 35.0 lbs., between about 5.0 lbs. and about 30.0 lbs., between about 5.0 lbs. and about 25.0 lbs., between about 5.0 lbs. and about 20.0 lbs., between about 5.0 lbs. and about 15.0 lbs., or between about 5.0 lbs. and about 10.0 lbs.

In any one of the embodiments of the portable exercise apparatus kit 1300, the elastic tension band ranges are provided, in increments of about 2.5 lbs., in increments of about 5.0 lbs., in increments of about 7.5 lbs., in increments of about 10.0 lbs., in increments of about 12.5 lbs., in increments of about 15.0 lbs., in increments of about 17.5 lbs., in increments of about 20.0 lbs., in increments of about 22.5 lbs., or in increments of about 25.0 lbs.

In any one of the embodiments of the portable exercise apparatus kit 1300, the at least one releasably attachable elastic tension band 1270 ranges in length from about: 0.5-to about 2.0 feet, from about 1.0-to about 2.0 feet, from about 1.5-to about 2.0 feet; from about 1.5-to about 3.0 feet; from about 1.5-to about 4.0 feet; from about 1.5-to about 5.0 feet; from about 1.5-to about 6.0 feet; from about 1.5-to about 7.0 feet; from about 1.5-to about 8.0 feet; from about 1.5-to about 9.0 feet; and from about 0.5-to about 10.0 feet.

In some embodiments of the kit 1300, the suspension line 1280 further comprises an adjustment device, friction hitch, or knot used to attach a loop of cord around a rope or to create a length adjustment. In some embodiments, the adjustment device is a ring 1271 or a carabiner 1272. In some embodiments, the adjustment device, friction hitch, or knot is a Prusik knot 1285.

In some embodiments of the portable exercise apparatus kit 1300, the apparatus further comprises detachable flexible or solid handgrips 1266, 1267 with flexible straps 1268, 1269; a door handle or hinge attachment feature (not shown); a suspension harness (not shown); a running parachute (not shown); a parachute cord (not shown); a coupling mechanism; a flexible water canteen; a drinking tube; a flow valve; a glove, first aid materials, and one or more of a plurality of safety features.

Still further, in any one of the embodiments of the portable exercise apparatus kit 1300, the portable exercise apparatus comprises a handgrip with a flexible connector strap that is convertible to a doorframe attachment device configured with connector strap fixation rings, wherein the handgrip is configurable for placement between a doorframe and a closed door such that the flexible connector strap with connector strap fixation rings extend past the frame and the closed door and can be attached to the portable exercise apparatus, or any of a plurality of the exercise apparatus accessories.

In some embodiments of the portable exercise apparatus kit 1300, the apparatus is configured from or comprises wear-resistant material comprising: nylon; moleskin; polyester; polypropylene; aramid polymer fabric; Kevlar®; technical fabric; SuperFabric®; Cordura®, Spectra Shield®; Dyneema®; Tegris™ polypropylene; Innegra™; HB51; Protech®; Gold Shield®; polyethylene naphthalate (PEN); Vectran®; high-modulus polyethylene; ABC-Matrix© Technora®, Vectran®; Ultra High Molecular Weight Polyethylene (UHMWPE); Twaron®; Zylon®; Carbon Fiber; Mylar®; Chlorosulfonated polyethylene (Hypalon, CSPE, CSM) and/or leather.

In some embodiments of the portable exercise apparatus kit 1300, the apparatus further comprises one or more of a plurality of safety features comprising: reflective tape; neon coloring; florescent coloring; a flashing light unit (not shown); RFID tracking device (not shown); GPS tracking device (not shown); or a geolocation device (not shown).

Provided herein is a method of using an exercise apparatus comprising: providing a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; providing at least one pocket between the first layer and the second layer; attaching a connector strap comprising a first end and a second end and affixed to the outside surface or inside surface of the first layer, wherein the connector strap comprises a coupling mechanism for releasably securing the first end and second end of the connector strap to each other; affixing a first handgrip and a second handgrip to the connector strap or directly to an outside surface of the exercise apparatus, wherein each first handgrip and second handgrip is spaced approximately equidistant from the lengthwise center of the strap-like apparatus; affixing a first fixation ring adjacent to a first end of the strap-like apparatus, extending outside of the pocket; and affixing a second fixation ring adjacent to a second end of the strap-like apparatus, extending outside of the pocket; affixing a third fixation ring to the to the connector strap at the approximate lengthwise center of the strap-like apparatus connector strap and making it accessible through an access point in the layers of the strap-like apparatus; wherein the strap-like apparatus is adapted for exercising various muscle groups of the body of a user when performing suspension exercises, resistance exercises, stretching exercises, aerobic exercises, or other combination exercises with said apparatus as a component of a total body workout.

In some embodiments of the method, the strap-like apparatus is removed from the user's body and wrapped about a stable vertical or horizontal structure such as a tree or pole, wherein a first end of a first elastic band and a first end of a second elastic band are affixed to any two of the fixation rings of the strap-like apparatus, wherein the user performs resistance or stretching exercises with the elastic bands while holding the bands with the hands.

In some embodiments of the method, the resistance exercises comprise pulling; pushing; spinal flexion; spinal extension; spinal rotation; shoulder internal rotation; shoulder external rotation; lateral flexion; shoulder abduction; shoulder adduction; shoulder flexion; and shoulder extension. In some embodiments of the method, the resistance exercises comprise arm curls; and arm extensions.

In some embodiments of the method, the stretching exercises comprise pulling; pushing; leg extension, hamstring extension, spinal flexion; spinal extension; spinal rotation; shoulder internal rotation; shoulder external rotation; lateral flexion; shoulder abduction; shoulder adduction; shoulder flexion; and shoulder extension.

In some embodiments of the method, the strap-like apparatus is removed from the user's body and wrapped about a stable vertical or horizontal structure such as a tree or pole, wherein a first end of a first elastic band is affixed to any one of the fixation rings of the strap-like apparatus, a detachable flexible handgrip is wrapped around the user's ankle or foot and attached the second end of the first elastic band, wherein the user performs limb resistance exercises with the elastic bands with their legs.

In some embodiments of the method, the resistance exercises comprise hip abduction; hip adduction; dorsiflexion; plantarflexion; knee extension; knee flexion; hip flexion; hip extension; eversion; inversion; and lateral resistance steps.

In some embodiments of the method, the strap-like apparatus is removed from the user's body and suspended about a hanging structure capable of supporting the user, wherein the user performs pull-ups or chin-ups utilizing any the handgrips affixed to the strap-like apparatus.

In some embodiments of the method, the strap-like apparatus is removed from the user's body and suspended about a hanging structure capable of supporting the user, wherein the first end of a first elastic band and the first end of a second elastic band are each affixed to any of the fixation rings; a first end of a flexible strap handgrip is connected to the second end of the first elastic band and a second end of the detachable flexible handgrip is connected to the second end of the second strap-like apparatus, creating a suspended strap step; wherein the user can step or kneel on the suspended strap step while grasping any of the affixed handgrips of the strap-like apparatus and performing assisted suspension exercises, such as assisted pull-ups or chin-ups.

In some embodiments of the method, the first end of at least a first elastic band is affixed to any of the fixation rings of the strap-like apparatus, wherein the user performs limb resistance exercises with an elastic band while holding the band in a hand with the strap-like apparatus secured about the user's waist.

In some embodiments of the method, the first end of a first elastic band is affixed to any of the fixation rings of the strap-like apparatus, wherein the user performs limb resistance exercises with an elastic band in a hand while holding the band and standing on the strap-like apparatus with the user's feet or kneeling on the strap-like apparatus.

In some embodiments of the method, the resistance exercises comprise elbow flexion; elbow extension; shoulder abduction; shoulder internal rotation, shoulder external rotation; shoulder extension; shoulder flexion; lateral flexion; and tension squatting exercises.

In some embodiments of the method, the first end of a first elastic band is affixed to the fixation ring located on the outside surface of the strap-like apparatus, the second end of the first elastic band comprising a quick-release attachment coupling is affixed to an anchoring point of a stationary structure, wherein the user performs resistance running exercises with the elastic band providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising a quick-release attachment coupling with a detachable handgrip is held by another person, wherein the user performs resistance running exercises with the elastic band and other person providing a resistance force while the strap-like apparatus is secured about the user's waist.

In some embodiments of the method, the first end of a first elastic band is affixed to the fixation ring located on the outside surface of the strap-like apparatus, (the center of connecting strap) the second end of the first elastic band comprising an attached handgrip is held by another person, wherein the user performs resistance running exercises with the elastic band while the strap-like apparatus is secured about the user's waist.

In some embodiments of the method, the first end of a first elastic band is affixed to the fixation ring located on the outside surface of the strap-like apparatus, (center of connecting strap) the second end of the first elastic band comprising a quick-release attachment coupling is affixed to an anchoring point of a stationary structure, wherein the user performs resistance running exercises with the elastic band while the strap-like apparatus is secured about the user's body as a bandolier or waist.

In some embodiments of the method, the first end of a first elastic band is affixed to the fixation ring located in the lengthwise center of the strap-like apparatus, the second end of the first elastic band comprising an optional handgrip is held by another person, wherein the user performs resistance running exercises with the elastic band while the strap-like apparatus is secured about the user's body as a bandolier or waist.

In some embodiments of the method, at least a second band is affixed to the fixation ring located in outer surface of the first layer of the strap-like apparatus for additional resistance.

In some embodiments of the method, the first end of a first elastic band and the first end of a second elastic band are each affixed to any of the fixation rings; the second end of the first elastic band and the second end of the second elastic band each comprising a quick-release attachment coupling are each affixed to an anchoring point of a stationary structure above the user capable of supporting the user's weight, wherein the user can step on the suspended strap-like apparatus, while grasping the stationary structure above the user's head and performing assisted suspension exercises.

Provided herein is a kit for an exercise apparatus comprising a strap-like apparatus adapted to be worn about the user's body, wherein the strap-like apparatus comprises at least a first layer and a second layer, wherein the first layer comprises a first inside surface and a first outside surface and the second layer comprises a second inside surface and a second outside surface; at least one pocket between the first layer and the second layer; a connector strap comprising a first end and a second end and affixed to the outside surface or inside surface of the first layer, wherein the connector strap comprises a coupling mechanism for releasably securing the first end and second end of the connector strap to each other; a first handgrip and a second handgrip affixable to the connector strap or directly to an outside surface of the exercise apparatus, wherein each first handgrip and second handgrip is spaced approximately equidistant from the lengthwise center of the strap-like apparatus; at least one fixation ring affixed to the apparatus; and at least one releasably attachable elastic band.

In some embodiments of the kit, the strap-like apparatus comprises a third layer, wherein the third layer comprises a third inside surface and a third outside surface.

In some embodiments of the kit, the third layer is an extension of the first layer and folds over the second layer to enclose the at least one pocket between the first inside surface and the second inside surface.

In some embodiments of the kit, the layers are formed from a single piece of folded material.

In some embodiments of the kit, the layers are formed from two or more pieces of material and joined along their lengthwise edges.

In some embodiments of the kit, the at least one fixation ring is located at the approximate lengthwise center of the connector strap and accessible through an access point in the layers of the strap-like apparatus.

In some embodiments, the kit further comprises a detachable flexible or solid handgrips with flexible straps; a running parachute; a suspension cord; a suspension harness; a parachute cord; a coupling mechanism; a flexible water canteen; a glove; a drinking tube; a flow valve and one or more of a plurality of safety features.

In some embodiments, the kit further comprises a second fixation ring affixed adjacent to a first end of the strap-like apparatus, extending outside of the pocket and a third fixation ring affixed adjacent to a second end of the strap-like apparatus, extending outside of the pocket, wherein the second and third fixation rings are affixed between the first and second layers and to the connector strap or are affixed directly to the connector strap.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein could be employed in practicing the invention. It is intended that the following claims define the scope of the invention and that methods and structures within the scope of these claims and their equivalents be covered thereby.

What is claimed is:

1. A portable exercise system comprising:

a belt assembly comprising;

an adjustable connector strap having a first end and a second end spaced lengthwise from each other;

at least one closeable pocket, affixed along the adjustable connector strap between the first end and the second end;

a first fixation ring affixed to the adjustable connector strap between the first end and a first exterior end margin of the at least one closeable pocket; and a second fixation ring affixed to the adjustable connector strap between the second end and a second exterior end margin of the at least one closable pocket;

a first elastic suspension sub-assembly and a second elastic suspension sub-assembly, each sub-assembly comprising:

a plurality of releasably attachable elastic bands or elastic cords, creating a set;

a releasably attachable shroud comprising at least a first half of a releasable hook and loop closure mechanism and a releasably attachable suspension strap having a first end and a second end affixed to the shroud;

a first non-elastic suspension strap assembly and a second non-elastic suspension strap assembly comprising a plurality of attachment features or loops; and a first adjustable-length handgrip assembly and a second adjustable-length handgrip assembly.

2. The portable exercise system of claim 1, further comprising:

a coupling mechanism assembly comprising a first coupling component at the first end of the adjustable connector strap and a second coupling component slidably affixed along the adjustable connector strap in proximity to the second end for releasably securing the first end of the adjustable connector strap to a section of the adjustable connector strap near the second end; and a third fixation ring affixed to or about the approximate lengthwise center of the adjustable connector strap, or affixed to the approximate lengthwise center of the closeable pocket, approximately equidistant between the first fixation ring and the second fixation ring.

3. The portable exercise system of claim 1, wherein each one of the plurality of releasably attachable elastic bands or elastic cords creating the set of the first elastic suspension sub-assembly and the set of second elastic suspension sub-assembly comprises:

a first end and a second end, a specified length and a known tension property;

wherein each first end comprises a first attachment feature and each second end comprises a second attachment feature, and wherein each attachment feature further comprises a quick-release attachment coupling.

4. The portable exercise system of claim 3, wherein each releasably attachable elastic band or elastic cord of the first elastic suspension sub-assembly comprises a different known tension property from the other releasably attachable elastic bands or elastic cords in the first sub-assembly;

wherein each releasably attachable elastic band or elastic cord of the second elastic suspension sub-assembly comprises a different known tension property from the other releasably attachable elastic bands or elastic cords in the second sub-assembly; and wherein the tension properties of each set of releasably attachable elastic bands or elastic cords in the first elastic suspension sub-assembly and the second elastic suspension sub-assembly are the same.

5. The portable exercise system of claim 3, wherein the first adjustable-length handgrip with the flexible connector strap and the second adjustable-length handgrip assembly are releasably affixable to any one or more of the attachment features of the first elastic suspension sub-assembly.

6. The portable exercise system of claim 1, wherein each releasably attachable suspension strap affixed to the shroud further comprises a second half of a releasable hook and loop closure mechanism, at or about an area of fixation to the shroud, to enclose the shroud around the plurality of releasably attachable elastic bands or elastic cords, and wherein the first end comprises a first attachment feature and the second end comprises a second attachment feature, and wherein each attachment feature further comprises a quick-release attachment coupling.

7. The portable exercise system of claim 1, wherein the first non-elastic suspension strap assembly and the second non-elastic suspension strap assembly each comprises:

a first non-elastic strap, band or line having a first end and a second end; the first end of the first non-elastic strap, band or line comprising a closed loop, and the second end of the first non-elastic strap, band or line having no attachments, a second non-elastic strap, band or line having a first end and a second end; and a strap buckle comprising a securing bar, and strap clasping mechanism;

wherein the second end of the second non-elastic strap, band or line is folded over the securing bar, back onto a portion of the second non-elastic strap, band or line and permanently secured thereto, capturing the first securing bar, and wherein the second end of the first non-elastic strap, band or line is pulled through the strap buckle such that the second end is adjustably secured by the strap clasping mechanism.

8. The portable exercise system of claim 1, wherein the first adjustable-length handgrip assembly and the second adjustable-length handgrip assembly each comprises:

a handgrip with a flexible connector strap, wherein the handgrip is hollow, wherein the flexible connector strap further comprises a first attachment feature at the end of the flexible connector strap and at least a second attachment feature along the length of the flexible connector strap, and wherein the first attachment feature further comprises a quick-release attachment coupling.

9. The portable exercise system of claim 8, wherein each of the first adjustable-length handgrip assembly and the second adjustable-length handgrip assembly further comprises an auxiliary loop feature suspended from the handgrip.

10. The portable exercise system of claim 8, wherein the first adjustable-length handgrip assembly and the second adjustable-length handgrip assembly are releasably affixable to at least one of the first, second and third fixation rings.

11. The portable exercise system of claim 1, wherein the first adjustable-length handgrip assembly and the second adjustable-length handgrip assembly are releasably affixable to any one or more of the plurality of attachment features or loops of the first non-elastic suspension strap sub-assembly or the second non-elastic suspension strap sub-assembly.

12. The portable exercise system of claim 1, further comprising a third fixation ring or an auxiliary attachment feature at any location along the length of the flexible connector strap.

13. The portable exercise system of claim 1, further comprising a second closeable pocket, affixed along the adjustable connector strap between the first end and the second end.

14. The portable exercise system of claim 1, further comprising at least one permanently affixed handgrip with a first flexible handgrip connector strap affixed to the adjustable connector strap.

15. The portable exercise system of claim 14, further comprising a second permanently affixed handgrip with a second flexible handgrip connector strap affixed to the adjustable connector strap, wherein the first permanently affixed handgrip and the second permanently affixed handgrip are hollow.

16. The portable exercise system of claim 15, further comprising a second auxiliary storage sleeve having a third end, a fourth end and a second cavity therebetween and affixed on or about an exterior margin of the at least one closable pocket.

17. The portable exercise system of claim 16 wherein the second auxiliary storage sleeve is sized and configured to store the second permanently affixed handgrip with the second flexible handgrip connector strap.

18. The portable exercise system of claim 14, further comprising a first auxiliary storage sleeve having a first end, a second end and a first cavity therebetween, and affixed on or about an exterior margin of the at least one closable pocket.

19. The portable exercise system of claim 18 wherein the first auxiliary storage sleeve is sized and configured to store the at least one permanently affixed handgrip with the first flexible handgrip connector strap.

20. The portable exercise system of claim 1, wherein any one or all of:

the first elastic suspension sub-assembly;
the second elastic suspension sub-assembly;
the first non-elastic suspension strap assembly;
the second non-elastic suspension strap assembly;
the first adjustable-length handgrip assembly; and
the second adjustable-length handgrip assembly;
are configurable to be stored and transported within the at least one closeable pocket, affixed along the adjustable connector strap.

* * * * *